US011739526B2

(12) United States Patent
Armstrong

(10) Patent No.: US 11,739,526 B2
(45) Date of Patent: Aug. 29, 2023

(54) COMPOSITE CONCRETE STRUCTURE FORMWORK AND METHOD OF FABRICATION

(71) Applicant: Forma Technologies Inc., Dallas, TX (US)

(72) Inventor: Scott Armstrong, Dallas, TX (US)

(73) Assignee: Forma Technologies Inc., Austin, TX (US)

( * ) Notice: Subject to any disclaimer, the term of this patent is extended or adjusted under 35 U.S.C. 154(b) by 0 days.

(21) Appl. No.: 16/949,681

(22) Filed: Nov. 10, 2020

(65) Prior Publication Data

US 2022/0145646 A1 May 12, 2022

Related U.S. Application Data

(63) Continuation of application No. 16/949,678, filed on Nov. 10, 2020, which is a continuation of application (Continued)

(51) Int. Cl.
*E04B 2/86* (2006.01)
*E04G 9/05* (2006.01)

(Continued)

(52) U.S. Cl.
CPC ..... *E04B 2/8635* (2013.01); *E04C 5/168* (2013.01); *E04G 9/05* (2013.01); *E04G 11/02* (2013.01);

(Continued)

(58) Field of Classification Search
CPC ..... E04G 11/02; E04G 11/06; E04G 11/38; E04H 9/00; E04H 9/14
See application file for complete search history.

(56) References Cited

U.S. PATENT DOCUMENTS 1,271,874 A * 7/1918 English ..... E04G 11/02 249/40
1,685,012 A * 9/1928 Yager ..... E04G 11/082 249/20

(Continued)

FOREIGN PATENT DOCUMENTS

CN 1991052 A * 7/2007
CN 104264982 A * 1/2015 ..... E04B 1/161

(Continued)

OTHER PUBLICATIONS

"MFG Fiberglass Column Forms" formtechninc.com https://www.formtechinc.com/formwork/column-forms/MFG-fiberglass.html (Last accessed Jun. 2, 2020).

(Continued)

*Primary Examiner* — Brian D Mattei
*Assistant Examiner* — Omar F Hijaz
(74) *Attorney, Agent, or Firm* — Schultz & Associates, P.C.

(57) ABSTRACT

The disclosure presents a composite concrete structure formwork which comprises stay in place fiberglass profiles and reinforcement to form various building and shelter structures. The structures include an interior container maintained at a set distance within an exterior container to form a void. The void is filled with wet concrete which is allowed to cure. All of the components in a preferred embodiment are formed of a fiberglass material.

16 Claims, 50 Drawing Sheets

Related U.S. Application Data

No. 16/949,675, filed on Nov. 10, 2020, which is a continuation of application No. 16/949,670, filed on Nov. 10, 2020.

(51) Int. Cl.

| | |
|---|---|
| ***E04C 5/16*** | (2006.01) |
| ***E04G 17/075*** | (2006.01) |
| ***E04G 11/02*** | (2006.01) |
| ***E04G 11/06*** | (2006.01) |
| ***E04G 11/38*** | (2006.01) |
| ***E04G 11/36*** | (2006.01) |
| ***E04G 11/46*** | (2006.01) |
| ***E04H 9/00*** | (2006.01) |
| ***E04H 9/14*** | (2006.01) |

(52) U.S. Cl.

CPC ..... *E04G 11/06* (2013.01); *E04G 11/365* (2013.01); *E04G 11/38* (2013.01); *E04G 11/46* (2013.01); *E04G 17/0754* (2013.01); *E04B 2002/8676* (2013.01); *E04H 9/00* (2013.01); *E04H 9/14* (2013.01)

(56) References Cited

U.S. PATENT DOCUMENTS

| | | | | |
|---|---|---|---|---|
| 3,669,401 | A | 6/1972 | Nevarez | |
| 3,835,608 | A * | 9/1974 | Johnson | E04B 2/8635 52/426 |
| 3,938,776 | A | 2/1976 | Frazier | |
| 4,149,351 | A | 4/1979 | Belt | |
| 4,598,519 | A * | 7/1986 | Reid | E04B 2/8647 249/43 |
| 4,728,073 | A | 3/1988 | Smith | |
| 4,742,985 | A | 5/1988 | Mathis | |
| 5,088,578 | A * | 2/1992 | Gates | E04G 11/06 249/20 |
| 5,392,580 | A | 2/1995 | Baumann | |
| 5,473,849 | A | 12/1995 | Jones et al. | |
| 5,860,262 | A | 1/1999 | Johnson | |
| 6,178,711 | B1 | 1/2001 | Laird et al. | |
| 6,295,782 | B1 | 10/2001 | Fyfe | |
| 6,409,433 | B1 | 6/2002 | Hubbell et al. | |
| 6,412,231 | B1 * | 7/2002 | Palatin | E04H 9/10 52/79.14 |
| 6,581,349 | B1 | 6/2003 | Riley | |
| 7,934,693 | B2 * | 5/2011 | Bravinski | E04G 11/18 249/40 |
| 8,322,085 | B2 * | 12/2012 | Plumley | E04H 9/14 52/79.14 |
| 8,844,223 | B2 | 9/2014 | Zhong | |
| 8,863,445 | B2 | 10/2014 | Zhong | |
| 8,997,420 | B2 | 4/2015 | Amend | |
| 9,097,016 | B2 | 8/2015 | Propst | |
| 9,115,503 | B2 | 8/2015 | Ciuperca | |
| 9,315,987 | B2 | 4/2016 | Richardson et al. | |
| 9,453,345 | B2 | 9/2016 | Richardson et al. | |
| 9,593,487 | B2 | 3/2017 | Harvey | |
| 9,945,120 | B1 | 4/2018 | Wu | |
| 10,465,397 | B2 | 11/2019 | Hollmann | |
| 2009/0202307 | A1 | 8/2009 | Au et al. | |
| 2010/0058693 | A1 * | 3/2010 | Plumley | E04H 9/14 52/384 |
| 2014/0308509 | A1 | 10/2014 | Gaddes et al. | |
| 2014/0319316 | A1 | 10/2014 | Bergman | |
| 2015/0322664 | A1 * | 11/2015 | Manning | E04B 1/161 52/742.15 |
| 2017/0218614 | A1 * | 8/2017 | Ciuperca | E04G 9/10 |
| 2020/0001548 | A1 | 1/2020 | Zamani et al. | |

FOREIGN PATENT DOCUMENTS

| | | | | |
|---|---|---|---|---|
| EP | 1923185 | A1 * | 5/2008 | B28B 1/24 |
| EP | 2221425 | B1 | 5/2012 | |
| WO | WO2004001139 | A1 | 12/2003 | |
| WO | WO2009078692 | A1 | 6/2009 | |
| WO | WO2015059594 | A1 | 4/2015 | |
| WO | WO2019109056 | A1 | 6/2019 | |

OTHER PUBLICATIONS

"Sigma DG Fiberglass Systems" Sigmadg.com https://web.archive.org/web/20141221062331/http://sigmadg.com/mateenfrp/ Home.html (Dec. 21, 2014).

"ETW: Wall—ICF Wall Construction" buildingscience.com https://www.buildingscience.com/documents/enclosures-that-work/high-r-value-wall-assemblies/high-r-wall-icf-wall-construction (Nov. 15, 2014).

"Plastic Formwork Concrete Formwork Fiberglass Made in China" okorder.com https://web.archive.org/web/20170618224933/https://www.okorder.com/p/plastic-formwork-concrete-formwork-fiberglass-made-in-china_934553.html Discloses a fiberglass formwork (Jun. 18, 2017).

"Insulating Removable Form Walls" concreteconstruction.net https://www.concreteconstruction.net/how-to/construction/insulating- removable-form-walls_o (Mar. 22, 2007).

* cited by examiner

COMPOSITE CONCRETE STRUCTURE FORMWORK AND METHOD OF FABRICATION

CROSS-REFERENCE TO RELATED APPLICATIONS

This application is a continuation of U.S. application Ser. No. 16/949,678 filed on Nov. 10, 2020, which is a continuation of U.S. application Ser. No. 16/949,675 filed on Nov. 10, 2020, which is a continuation of U.S. application Ser. No. 16/949,670 filed on Nov. 10, 2020. The patent applications identified above are incorporated herein by reference in its entirety to provide continuity of disclosure.

FIELD OF THE INVENTION

The present invention relates to the use of fiber reinforced polymers as formwork and reinforcement for concrete structures.

BACKGROUND OF THE INVENTION

Concrete foundations are common in modern building structures. Typical concrete foundations are created in disposable forms which are built directly on a supporting soil surface. The supporting soil surface can vary widely in composition. Some soil compositions, such as clay soils overlying a shale or limestone rock strata, exhibit large volumetric changes due to variations in moisture content. For example, when the moisture content of clay soil increases, the volume increases. When the moisture content of clay soil decreases, the volume decreases. Volumetric changes can impose extreme stress on concrete foundations and so must be considered when the foundations are designed. To compensate for the stress, significant reinforcement is generally required.

Traditional reinforcement of concrete foundations consists of either drilled piers, or grade beams and walls.

Drilled piers transfer building loads directly to the soil and/or rock strata. Drilled piers are excavated to specified depths with a drilling auger. The excavation is lined with rebar and then filled with concrete. In regions with clay soils, the piers must be designed for upward skin friction stress induced by the soil swelling. The piers are embedded into the underlying rock strata. It is not uncommon for the embedment depth to be governed by this upward skin friction stress, rather than the downward stress imposed by the building.

It is also not uncommon for ground water to seep into the pier excavation before concrete is placed. Excessive ground water in the excavation is considered detrimental, as it can cause erosion of soil into the pier shaft and can reduce the strength of the concrete. In these situations, a temporary casing is often utilized to prevent water from entering the pier excavation. The casing is commonly a large steel pipe that is placed in the excavation and removed after concrete placement.

Grade beams transfer building loads to the piers. Clay soils necessitate specific requirements for the construction of grade beams. One requirement is that the sides of the grade beams must have smooth vertical surfaces so that the soil can expand adjacent to the concrete surface without imposing significant upward skin friction stress. Another requirement is that the grade beams typically are cast over wax-impregnated cardboard void forms. Void forms support the grade beams during concrete placement and until the concrete has cured to design strength. Over time the void forms deteriorate due to prolonged exposure to subgrade moisture. The resulting void between the bottom of the grade beam and the top of the soil surface allows the soil to expand vertically without imposing an upward pressure on the grade beam. When void forms are used, it is common to install precast retainer boards on each side of the void form. The purpose of the retainer boards is to prevent soil from eroding into the void and thus decreasing its effective depth.

Walls transfer building loads to the grade beams. Below grade walls have requirements similar to those of grade beams in order to overcome clay soil volumetric changes.

The traditional process for constructing the grade beams or walls is extremely labor intensive, time consuming and costly. A trench must first be excavated. The trench must be wider than the grade beam or wall in order to allow space for construction workers. Temporary wooden forms are then constructed to frame of the grade beams or walls. The wooden forms must generally be reinforced to compensate for the outward pressure caused during concrete placement. The wooden forms further require loose plastic "chairs" placed at various positions inside the frame to support steel rebar. Then the rebar is installed prior to pouring concrete. Once the concrete is cured (2-3 days), the wood forms must be removed and discarded to avoid termite activity. Soil is then backfilled against the sides of the resulting concrete beam or wall.

Another challenge to traditional construction techniques is the delay required between completion of the building pad and the beginning of construction work. This delay creates risk to the contractor because the prepared building pad is exposed to weather until the grade beams and walls are completed. It is not uncommon for the building pad to be compromised by a heavy rain during the grade beam or wall construction, requiring further delay to rework the soil.

Challenges to the construction of below-grade concrete structures include exposure to high moisture content in the soil, and corrosive chemicals and corrosive minerals, such as salts, which corrode or spall the concrete pipes. As a result of this exposure, underground concrete structures, especially drainage and culvert systems, often require repair and replacement which can be costly and dangerous.

Similar construction techniques are used for molding various building and civil concrete structures utilizing steel forms. For example, pre-cast or tunnel-form concrete structures may be utilized for multi-unit residential or hospitality structures, and storm shelters. As another example, pipes for culverts, storm sewers, sanitary sewers, low-pressure systems, and manholes are pre-cast by using inner and outer steel forms with a circular, elliptical or rectangular cross sections. As yet another example, inner and outer steel forms are used to form precast concrete stormwater detention systems, lift stations, catch basins, utility tunnels, and pedestrian undercrossings. In each case, the steel formwork is removed once the concrete sets in the desired shape.

A challenge to using steel formwork is the high construction and maintenance costs. For instance, steel formwork is custom made and is generally large and heavy. Overhead cranes are required to move the steel forms into position and remove the inner and outer steel forms once concrete structures are set. Furthermore, the steel structures must be periodically maintained and repaired due to excessive use and corrosion caused by the construction process.

Another challenge to the use of temporary forms is the delay required between the construction of a concrete roof and floor system and the attachment of non-structural electrical, HVAC, and plumbing systems. Contractors may not start working on a floor for 2-3 days after constructing a roof because non-structural systems, such as ductwork, plumbing, conduits and ceiling support grillage may not be attached to structural members of the roof until concrete has set. This delay greatly increases labor costs due to delay and time required to attach the non-structural system.

The prior art has attempted to address these many challenges in a number of ways.

For example, U.S. Pat. No. 9,593,487 to Harvey discloses an integrated foundation form which incorporates fiberglass exterior wall panels attached by spacers and spacer bolts. However, Harvey does not disclose or suggest the use of a fiber reinforced polymer in forming and constructing various concrete structures, such as walls or grade beams.

As another example, U.S. Publication No. 2014/0308509 to Gaddes, et al. describes fiberglass panels connected by support ties which include horizontal reinforcing members. However, Gaddes does not disclose or suggest use of fiberglass as rebar, rebar retaining cages, or integrated fiberglass rebar tie downs or positioners.

Similarly, U.S. Publication No. 2009/0202307 to Au, et al. discloses a polystyrene pier form held in place with plastic connectors with integral rebar positioning chairs. However, Au does not disclose or suggest fiberglass forms which can be extended with adjacent form connections.

Deficiencies exist in the prior art related to the efficiency and strength of formwork. Thus, there is a need in the art for an improved system for forming and reinforcing concrete structures.

SUMMARY OF THE INVENTION

This invention addresses inefficiencies in the process of building foundations and concrete structures. "Stay-in-place" formwork systems are disclosed which utilizes fiber reinforced polymer (FRP) panels to both mold and reinforce various concrete structures. In a preferred embodiment, a Glass Fiber Reinforced Polymer (GFRP) is utilized for the FRP panels. The use of fiberglass is an important material in the design because of the weight savings over prior art steel formwork. However, fiberglass is not an obvious design choice because of the inherent problem of bowing out during a concrete pour. The invention remedies this through the use of stanchions as will be further described.

The formwork systems may be manufactured in segments or profiles which conform to the intended dimensions of the concrete structures. FRP formwork systems are manufactured either by molding and bonding or by vacuum formation. Once assembled, the formwork is filled with concrete. The formwork functions as reinforcement and external shielding for the concrete structure.

In one embodiment, formwork for drilled piers and grade beams and/or walls is provided. Other embodiments include concrete superstructures such as cast-in-place floor and roof systems, concrete columns, walls, two-way slab systems, one-way slab and beam systems, pan joist systems and tunnel-form systems. Other embodiments include storm shelters, and multi-unit residential and hospitality structures. Other embodiments include, pre-cast concrete structures, such as, circular, elliptical or rectangular pipes for culverts, storm sewers, sanitary sewers, low-pressure systems, manholes, as well as stormwater detention systems, catch basins, lift stations, utility tunnels, and pedestrian undercrossings.

In other embodiments, cast-in-place systems are comprised of FRP formwork segments which are assembled on site to create the formwork for the intended concrete structure. Concrete is poured into the assembled FRP formwork and allowed to cure. The FRP formwork remains in place after field placement of concrete.

In below grade embodiments, the FRP formwork greatly reduces the exposure to moisture, salts, and other corrosive minerals. The FRP formwork also increases the shear and flexural capacity of structural members.

In another embodiment, pre-cast systems are comprised of FRP formwork segments which are preassembled and filled with concrete prior to shipping. The pre-cast system segments are relatively light and so are easy and inexpensive to transport and assemble on site.

Other embodiments include FRP stanchions for positioning the various sections and panels and structural rebar of the system. The stanchions are bonded to the interior the FRP panels to maintain the required clearance of the rebar. The stanchions also prevent the panels from deflecting outwardly during concrete placement.

In some embodiments, FRP rebar may be integrated into the concrete structure. In this embodiment, FRP rebar is bonded between FRP panels and suspended by integrated FRP chairs or stanchions. The formwork incorporates FRP rebar as a reinforcement system for the concrete. The formwork may also include external FRP ribs to strengthen the FRP formwork to compensate for stress imposed during concrete placement.

In another embodiment, side retainers for a void form are integral with the beam or wall forms.

In another embodiment, structural support for ductwork, electrical conduit, piping, fireproofing and other systems may be incorporated into the formwork systems. Architectural, mechanical, electrical and plumbing systems that are commonly suspended from structural members may be incorporated into the formwork.

In another embodiment, the formwork can be adapted to create permanent buildings and shelters of immense strength. Such shelters are strong enough to resist tornadic impacts from wind pressures and wind-driven debris. The FRP formwork for storm shelters may also include fire resistant coatings.

In general, the systems disclosed greatly reduce the expense of framing concrete structures and foundations and increase their strength and durability.

BRIEF DESCRIPTION OF THE DRAWINGS

In the detailed description of the preferred embodiments presented below, reference is made to the accompanying drawings.

DETAILED DESCRIPTION OF THE INVENTION

In the description that follows, like parts are marked throughout the specification and figures with the same numerals, respectively. The figures are not necessarily drawn to scale and may be shown in exaggerated or generalized form in the interest of clarity and conciseness.

Figure 1A:
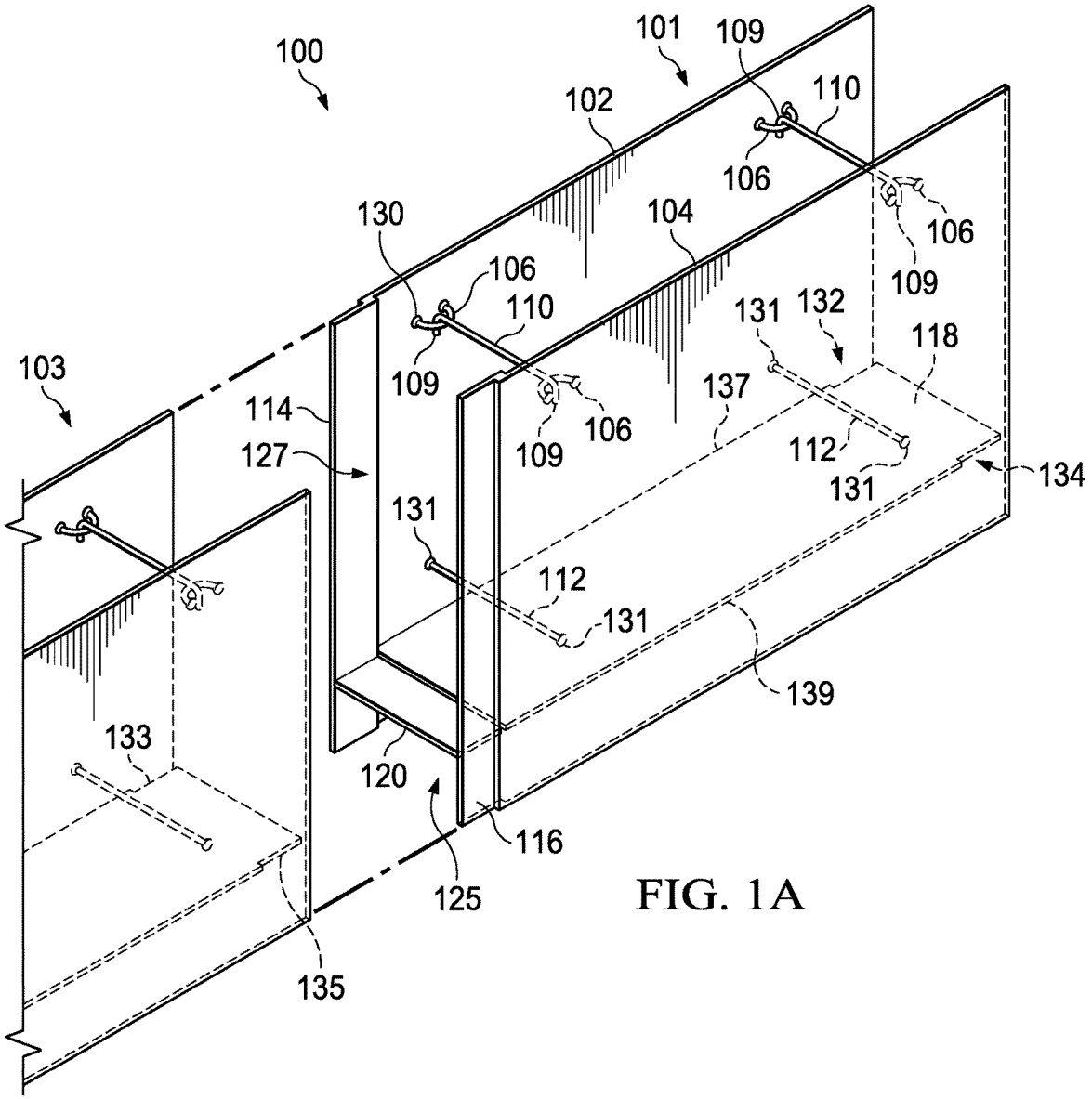
FIG. 1A is an exploded isometric view of a preferred embodiment of a formwork system.
Figure 1B:
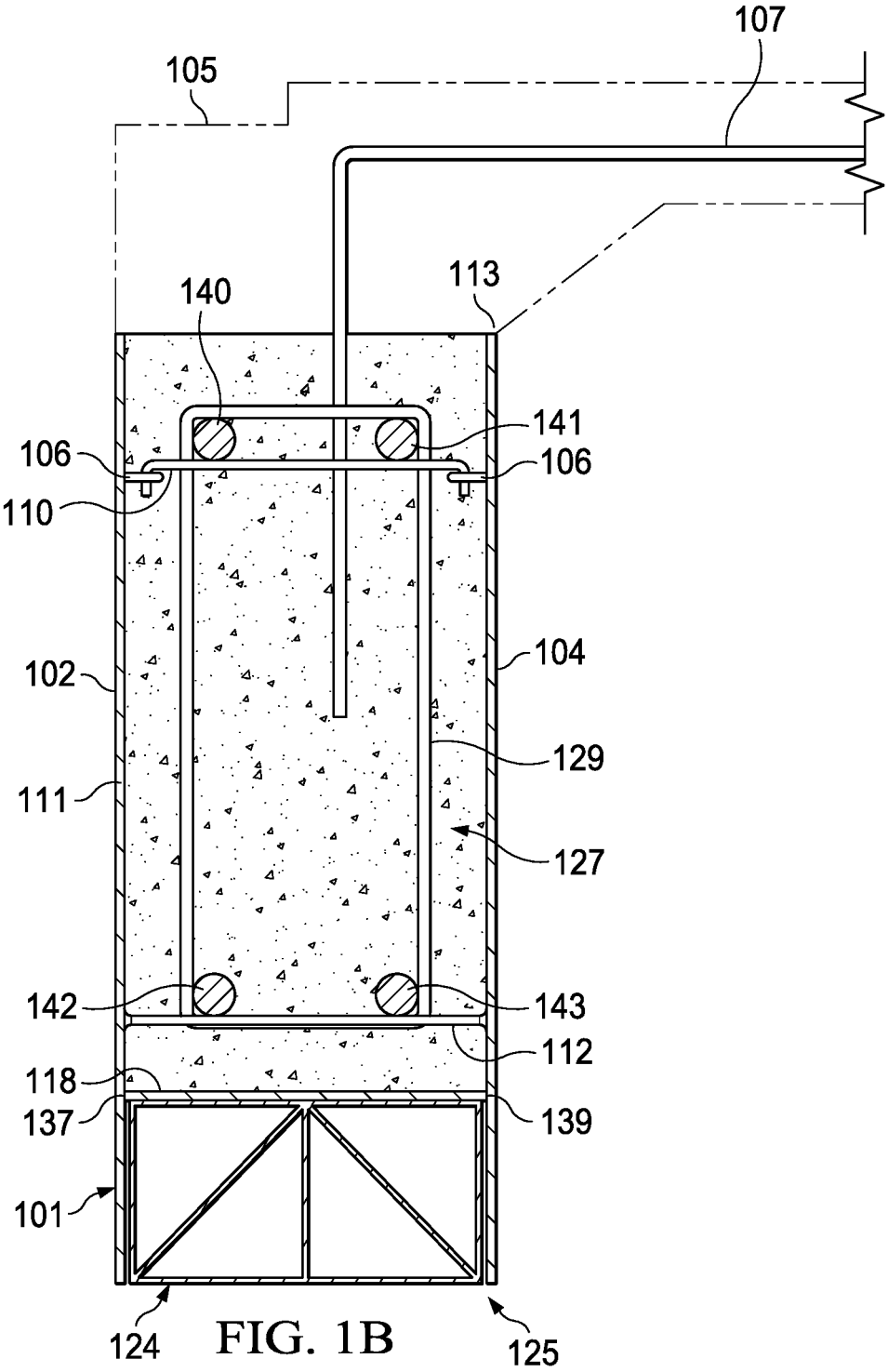
FIG. 1B is cross-sectional view of a preferred embodiment of a formwork segment.

Referring to FIGS. 1A and 1B, formwork system 100 is comprised of multiple segments, such as segment 101 and segment 103. Segments 101 and 103 connect to form a central section of either a grade beam or a wall, as will be further described.

Segment 101 is comprised of sidewall 102 and sidewall 104, and base panel 118. Each of the sidewalls and base panels are generally rectangular having a thickness of between about ⅛" and about ¼". In a preferred embodiment, a Glass Fiber Reinforced Polymer (GFRP) is utilized for the sidewalls and base panels. However, alternate material formulations may be used, such as Carbon Fiber Reinforced Polymer (CFRP), Basalt Fiber Reinforced Polymer (BFRP), and Aramid Fiber Reinforced Polymer (AFRP). In a further preferred embodiment, UV light curing may be used to speed curing times and increase resin strength. Preferably, thermoset resins including halogens or bromine are employed to create self extinguishing fire resistant structures.

Sidewall 102 is generally parallel to sidewall 104. Base panel 118 is generally perpendicular to each of the sidewalls. Lower cavity 125 is formed below base panel 118. Upper cavity 127 is formed above base panel 118. In one embodiment, sidewall 102 is bonded to base panel 118 along interface line 137, using a suitable epoxy. Likewise, sidewall 104 is bonded to base panel 118 along interface line 139 using with a suitable epoxy. In another embodiment, the sidewalls and base panel are integrally formed using vacuum molding.

Sidewalls 102 and 104 include connection flanges 114 and 116, respectively. Base panel 118 includes connection flange 120 adjacent connection flanges 114 and 116. In one embodiment, the connection flanges are integrally formed by extrusion, casting or vacuum molding.

Base panel 118 further includes notches 132 and 134. Notches 132 and 134 are rectangular. Connection flanges 114 and 116 mate with notches 133 and 135, respectively. The notches are adapted to receive the connection flanges within a tolerance of about ±¼".

Each formwork segment is adapted to connect with an adjacent formwork segment. In a preferred embodiment, the connection flanges of a formwork segment are always positioned on the opposite of the formwork from the segment notches. The position of flanges and notches on a segment may be reversed. When the formwork segments are connected, the panels of the first segment are flush with the panels of the second segment, creating a smooth and continuous exterior surface. The segments preferably are filled with concrete material after placement. The connection flanges act to prevent concrete leakage. The segments are secured by a suitable resin or an industrial epoxy. Alternatively, other connection means may include mechanical fasteners, such as screws or rivets.

Segment 101 is further comprised of retaining rings 106. Retaining rings 106 are generally semicircular loops having a diameter between about ¼" and about ⅜" and a radius of about ½". These dimensions can vary based on strength requirements. The chairs are each attached to the interior of the side panels via bonds 130. Bonds 130 may be comprised of epoxy, or another suitable adhesive. The retaining rings are preferably positioned diametrically opposed to each other and in lines along the interiors of each the side panels.

Latch bars 110 are preferably positioned in each pair of diametrically opposed retaining rings. The latch bars are generally "U" shaped, each having two downwardly facing extensions 109. Each extension is positioned through a pair of the retaining rings. In a preferred embodiment, the latch bars are removable so that rebar may be placed in the form from above, vertically downward, thereby speeding preparation of the form during use. In a preferred embodiment, the latch bars are made of FRP bar stock between about ¼" and about ½" in diameter. Alternatively, the latch bars may be comprised of steel rebar.

Segment 101 is further comprised of stanchions 112. Stanchions 112 are preferably cylindrical bar stock. Stanchions 112 are bonded to the interior of the sidewalls at seats 131 with epoxy or a suitable industrial adhesive. Stanchions 112 are generally perpendicular to the side walls and generally coplanar with the latch bars. The stanchions are preferably about ¼" to about ½" in diameter and are comprised of FRP or GFRP rod stock.

The retaining rings, latch bars and stanchions function to prevent the panels from deflecting due to pressure from concrete placement and to position rebar in the segment, as will be further described. In a preferred embodiment, the chairs, latch bars and stanchions are positioned at about 2' centers along the length of the form. However, other centers may be employed based on the width or length of the formwork system.

Referring then to FIG. 1B, longitudinal rebar 140 and longitudinal rebar 141 are supported by latch bar 110 and resin bonded in place. Likewise, longitudinal rebar 142 and longitudinal rebar 143 are supported by stanchion 112 and resin bonded in place. Longitudinal rebars 140, 141, 142 and 143 are preferably comprised of an FRP bar stock material. Steel rebar may also be employed.

Stirrup 129 surround longitudinal rebars 140, 141, 142 and 143 and secure them in place with respect to latch bar 110 and stanchions 112. In a preferred embodiment, stirrup 129 are a rectangular boxes comprised of FRP bar stock which is resin bonded to the longitudinal rebar, and can be resin bonded to either or both latch bar 110 and/or stanchions 112. In a preferred embodiment, longitudinal rebars 140, 141, 142 and 143 are between about ¼" and about 1" in diameter.

In a preferred embodiment, concrete slab 105 may be positioned above segment 101. Concrete 111 is set in upper cavity 127 and interfaces concrete slab 105 at interface 113. Rebar dowel 107 is positioned in the concrete slab and is either drilled through interface 113 into concrete 111 after the concrete is set, or positioned in concrete 111 before the concrete is cured.

In a preferred embodiment, wax-impregnated cardboard void form 124 is positioned in lower cavity 125.

Figure 1C:
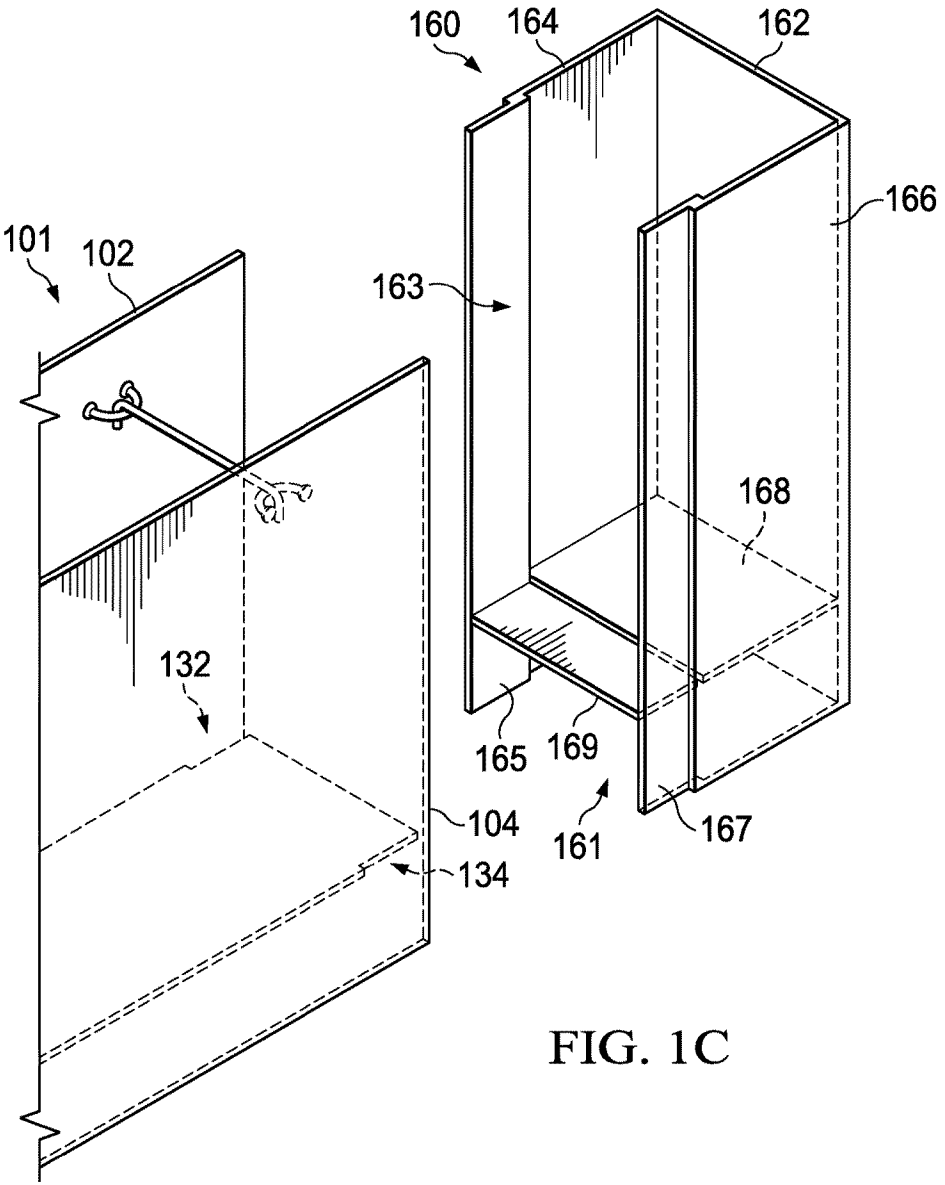
FIG. 1C is an exploded isometric view of a preferred embodiment of a formwork system.

Referring then to FIG. 1C, end cap 160 will be described. End cap 160 is comprised of side panel 164 and side panel 166. Side panel 164 and side panel 166 are bonded to rear panel 162. Side panel 164 is generally parallel to side panel 166. Side panel 164 and side panel 166 are generally perpendicular to rear panel 162. Adjacent side panel 164, side panel 166 and rear panel 162 is base panel 168. Base panel 168 is generally perpendicular to both side panel 164, side panel 166 and rear panel 162. Upper cavity 163 is formed above base panel 168. Lower cavity 161 is formed below base panel 168. Side panel 164 is further comprised of connection flange 165. Side panel 166 is further comprised of connection flange 167. Base panel 168 is further comprised of connection flange 169. Connection flange 165, 167 and 169 are adapted to interface with segment 101 and are preferably bonded in place.

End cap 160 is adapted to terminate segment 101.

Figure 1D:
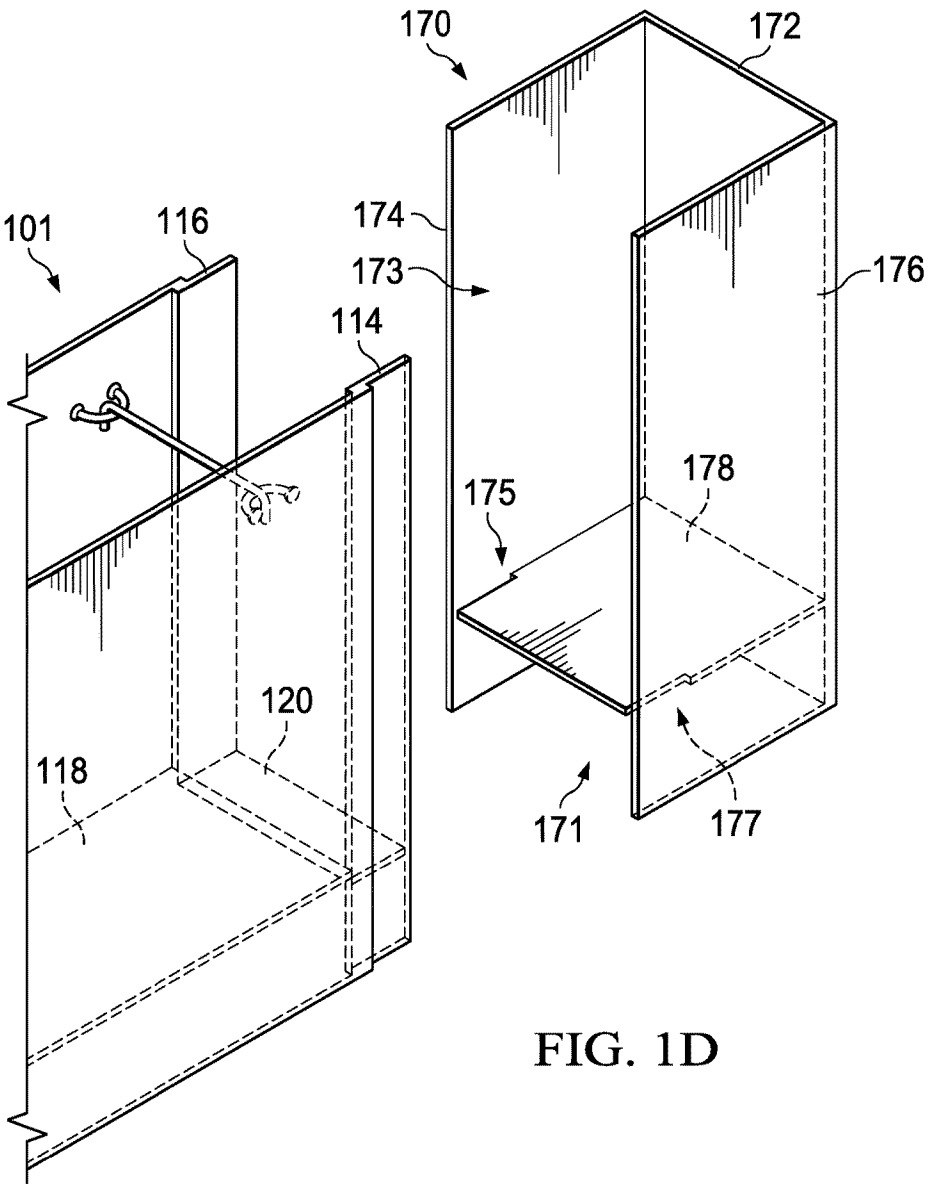
FIG. 1D is an exploded isometric view of a preferred embodiment of a formwork system.

Referring then to FIG. 1D, end cap 170 will be described.

End cap 170 is comprised of side panel 174 and side panel 176. Side panel 174 and side panel 176 are bonded to rear panel 172. Side panel 174 is generally parallel to side panel 176. Both side panel 174 and side panel 176 are generally perpendicular to rear panel 172. Base panel 178 is positioned adjacent side panel 174, rear panel 172 and side panel 176. Base panel 178 is generally perpendicular to each of side panel 174, rear panel 172 and side panel 176. Base panel 178 is further comprised of notch 175 and notch 177. Lower cavity 171 is formed below base panel 178. Upper cavity 173 is formed above base panel 178.

End cap 170 is adapted to interface with connection flange 114, connection flange 116 and connection flange 120 of segment 101. Once bonded in place, end cap 170 is adapted to terminate segment 101.

Figure 1E:
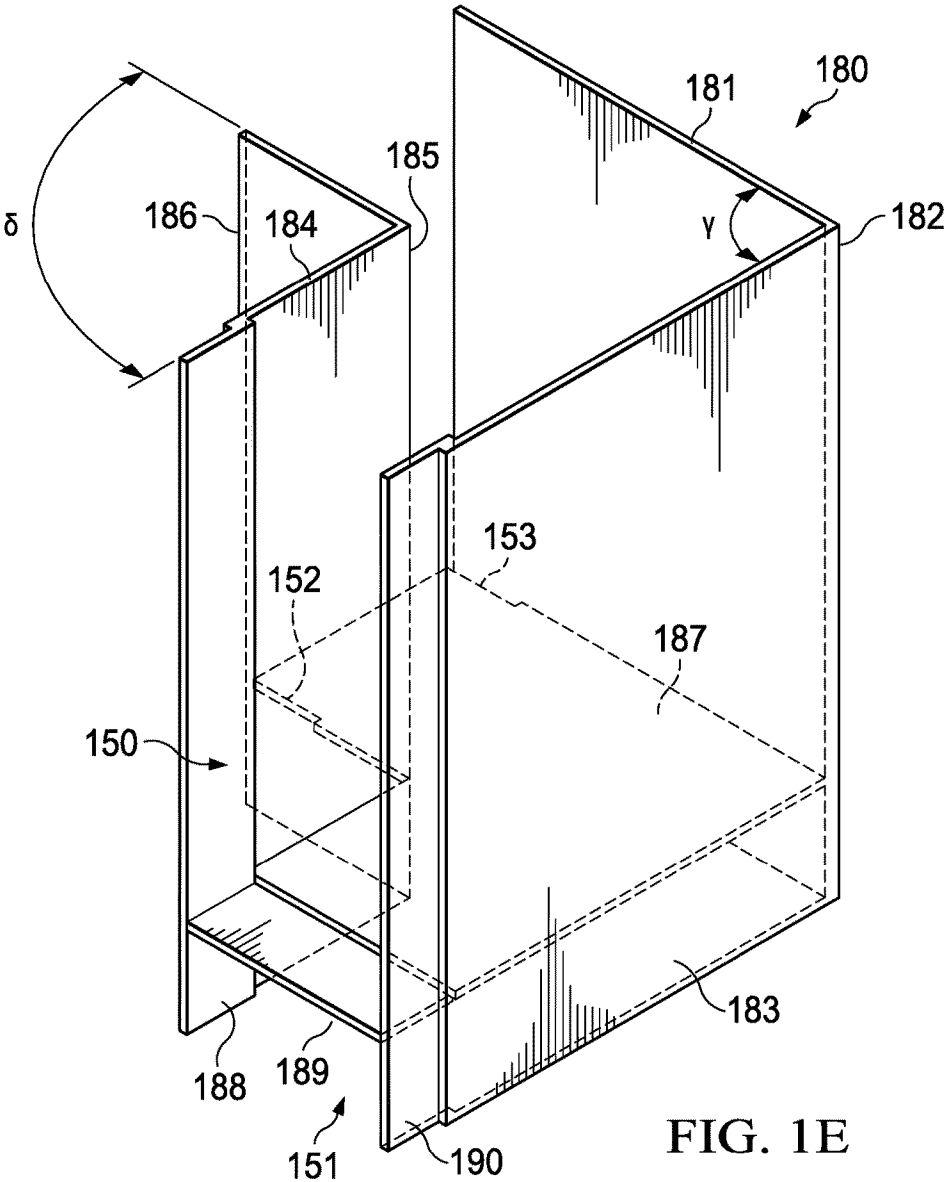
FIG. 1E is an isometric view of a preferred embodiment of a formwork system.

Referring to FIG. 1E, corner cap 180 will be described.

Corner cap 180 is comprised of outer panel 181 and outer panel 183, and connected at corner 182. The outer panels are generally vertically oriented. Outer panel 181 is generally perpendicular to outer panel 183 as indicated by angle $\gamma$. However, in other embodiments angle $\gamma$ can be different. In other preferred embodiments, $\gamma$ can assume angles of 30°, 45° and 60°.

Corner cap 180 is further comprised of inner panel 186 and inner panel 184, and connected at corner 185. The inner panels are generally vertically oriented. Outer panel 181 is generally parallel with inner panel 186. Outer panel 183 is generally parallel to inner panel 184. Inner panel 186 is generally perpendicular to inner panel 184 as indicated by angle $\delta$. However, other angles such as 30°, 45° and 60° may also be used.

Connection flange 190 is integrally formed with outer panel 183. Connection flange 188 is connected with inner panel 184. Connection flange 189 is integrally formed with base panel 187. Connection flange 190 is connected to connection flange 188 by connection flange 189. Outer panels 181 and 183 are connected to inner panels 186 and 184 by base panel 187. Base panel 187 is generally horizontally oriented and perpendicular to outer panels 181 and 183 and inner panels 186 and 184. Upper cavity 150 is formed above base panel 187. Lower cavity 151 is formed below base panel 187.

In a preferred embodiment, base panel 187 is further comprised of notches 152 and 153. In an alternate embodiment, base panel 187 may include a secondary connection flange instead of notches 152 and 153. In this embodiment, inner panel 184 and outer panel 181 would each include a connection flange connected to the secondary connection flange of the base panel.

Corner cap 180 is adapted to interface with connection flange 114, connection flange 116 and connection flange 120 of segment 101. Corner cap 180 is similarly adapted to interface with notches 132 and 134 of segment 101, and notches 133 and 135 of segment 103. Once bonded in place, corner cap 180 is adapted to terminate segment 101.

Figure 1F:
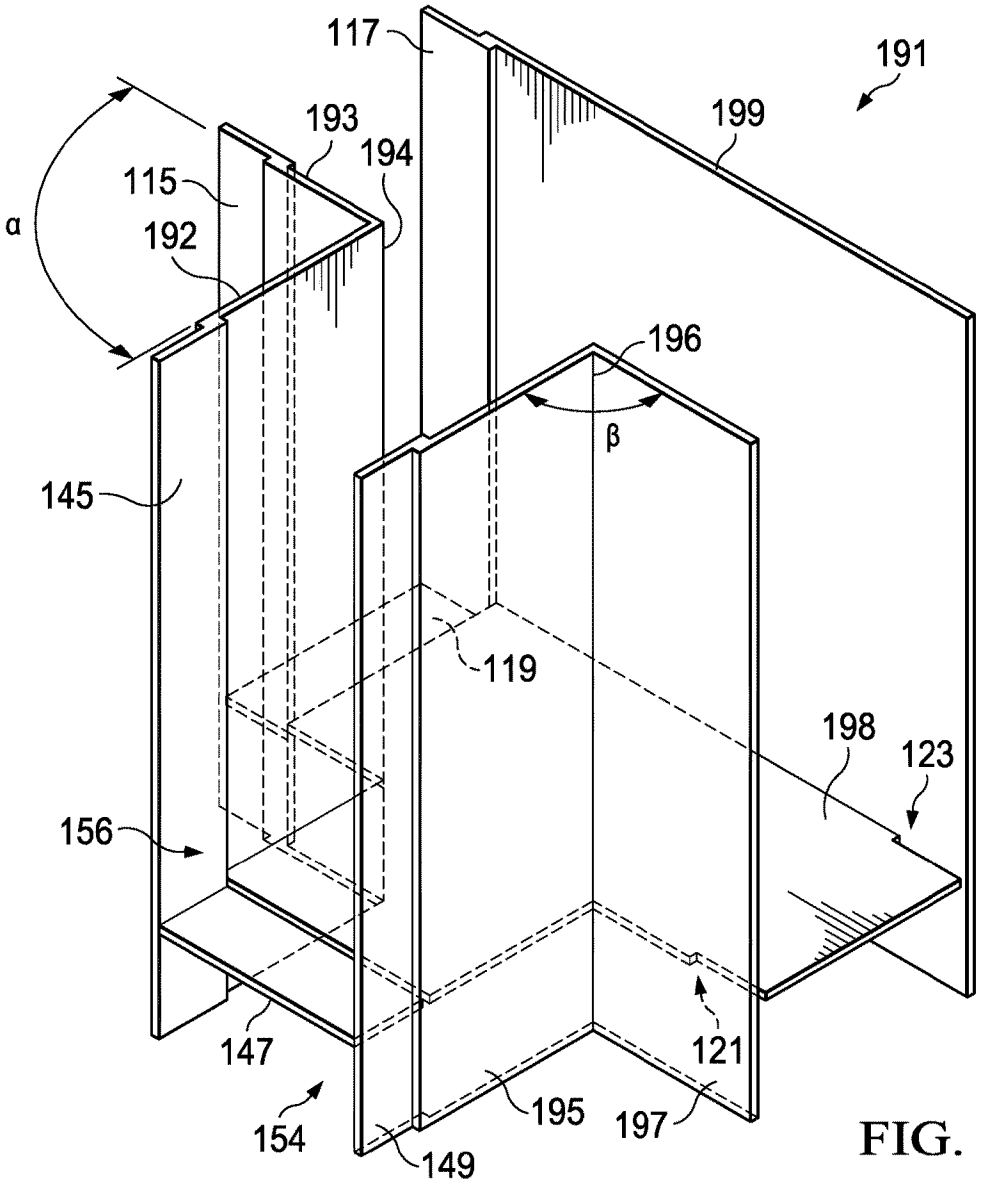
FIG. 1F is an isometric view of a preferred embodiment of a formwork system.

Referring to FIG. 1F, T-segment 191 will be described.

T-segment 191 is comprised of inner panel 197 and inner panel 195 connected at corner 196. Inner panel 192 is bonded to inner panel 193 at corner 194. Inner panel 195 is positioned generally parallel inner panel 192. Inner panel 192 is positioned adjacent inner panel 195. Inner panel 192 is generally parallel to inner panel 195. Inner panels 197, 195, 192 and 193 are all generally vertically oriented. Inner panel 197 is generally perpendicular to inner panel 195 as indicated by angle β. However, in other embodiments angle β can be different. In other preferred embodiments, β can assume angles of 30°, 45° and 60°. Inner panel 193 is generally perpendicular to inner panel 192 as indicated by angle α. However, in other embodiments angle α can be different. In other preferred embodiments, α can assume angles of 30°, 45° and 60°. Angle β is supplementary with angle α.

Inner panel 193 is generally coplanar with inner panel 197. Inner panel 193 and inner panel 197 are positioned adjacent outer panel 199. Inner panel 193 and inner panel 197 are generally parallel with outer panel 199. Inner panels 192 and 195 are generally perpendicular to outer panel 199.

Outer panel 199, inner panel 192, inner panel 193, inner panel 197 and inner panel 195 are each connected to base panel 198. Base panel 198 is generally perpendicular to each of the inner panels and the outer panel. Upper cavity 156 is formed above base panel 198. Lower cavity 154 is formed below base panel 198. Base panel 198 is further comprised of notch 121 and notch 123, adjacent outer panel 199 and inner panel 197, respectively. The notches are adapted to engage connection flanges 114 and 116 of segment 101.

Inner panel 195 is further integrally formed with connection flange 149. Inner panel 192 is further integrally formed with connection flange 145. Connection flange 149 is generally parallel to connection flange 145. Connection flange 147 is integrally formed with base panel 198 and to connection flanges 145 and 149. In an alternate embodiment, connection flange 145 is bonded to inner panel 192, connection flange 149 is bonded to inner panel 195 and connection flange 147 is bonded to base panel 198.

Connection flanges 145, 147 and 149 are adapted to interface with notches 132 and 134 of segment 101.

Inner panel 193 is further integrally formed with connection flange 115. Outer panel 199 is further integrally formed with connection flange 117. Connection flange 115 is generally parallel to connection flange 115. Connection flange 119 is integrally formed with base panel 198 and to connection flanges 115 and 117. In an alternate embodiment, connection flange 115 is bonded to inner panel 193, connection flange 117 is bonded to outer panel 199 and connection flange 119 is bonded to base panel 198.

Connection flanges 115, 119 and 117 are adapted to interface with notches 132 and 134 of segment 101.

It should be appreciated that in alternate embodiments, the notches and connection flanges of T-segment 191 may be configured differently.

Figure 2A:
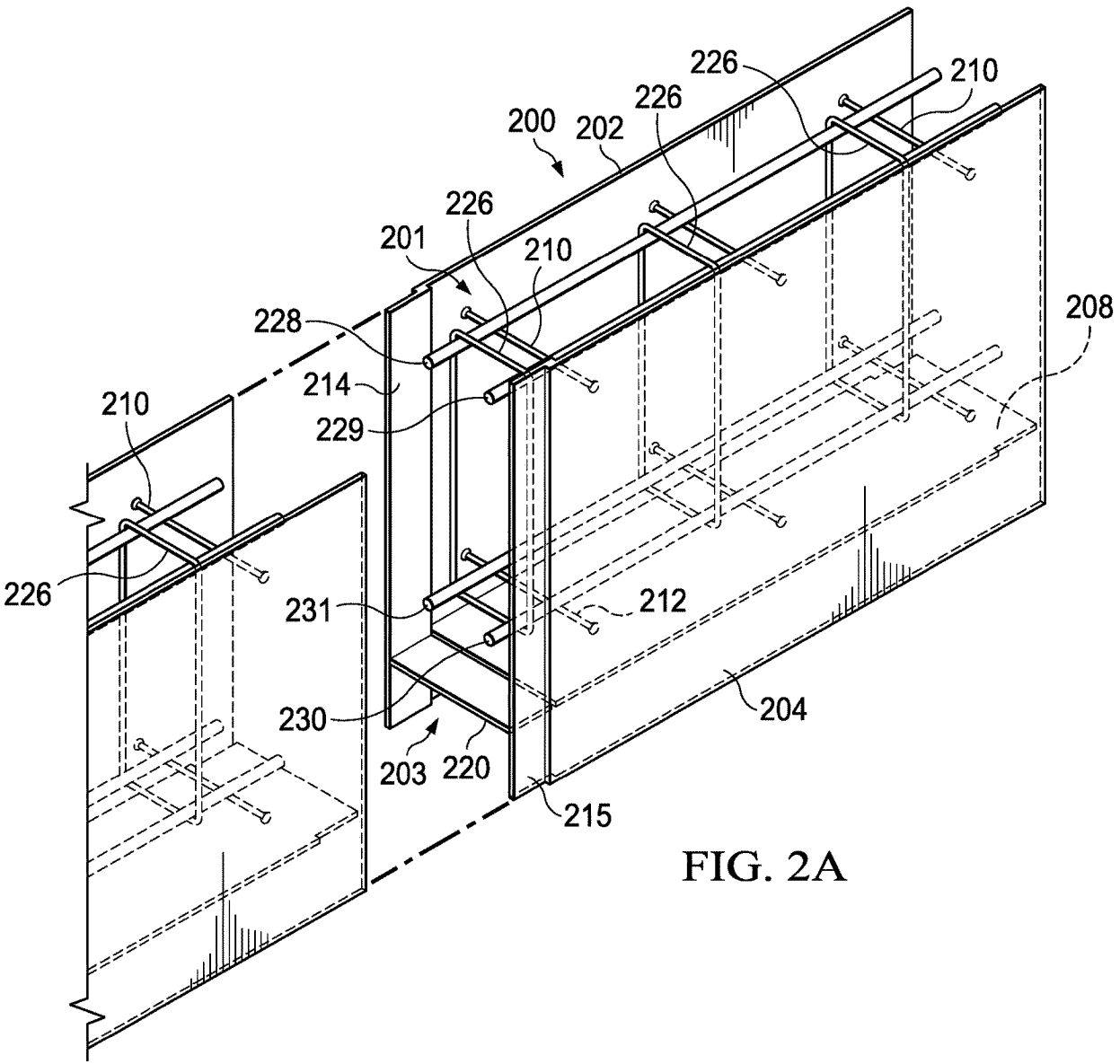
FIG. 2A is an exploded isometric view of a preferred embodiment of a formwork system.
Figure 2B:
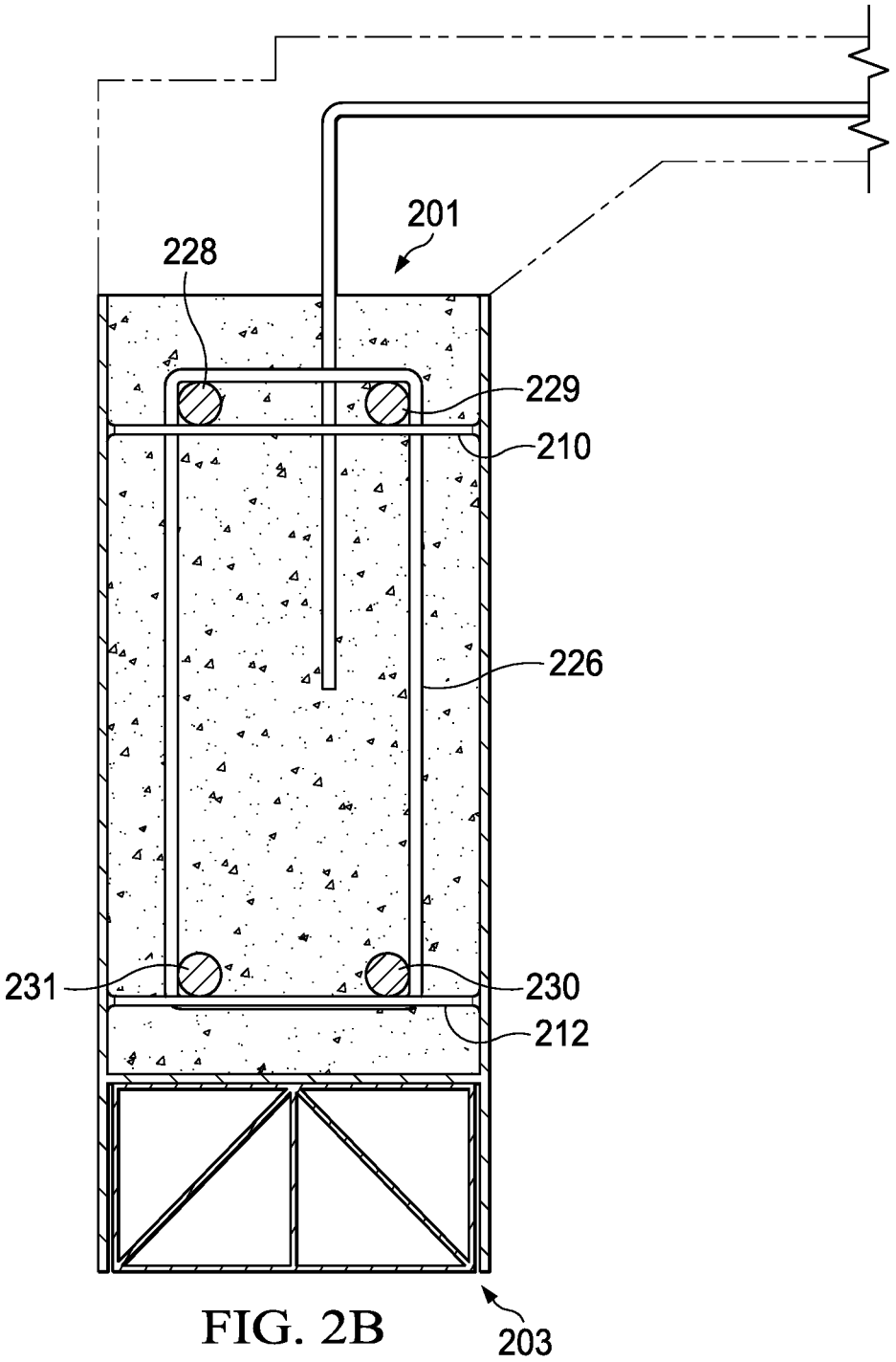
FIG. 2B is cross-sectional view of a preferred embodiment of a formwork segment.

Referring to FIGS. 2A and 2B, an alternate embodiment of the formwork system is described.

Formwork segment 200 is comprised of sidewall 204, base panel 208 and sidewall 202. Sidewall 204, base panel 208 and sidewall 202 form a generally rectangular box comprised of upper cavity 201 and lower cavity 203 and are either cast or formed of a fiberglass material, as previously described.

The sidewalls and base panel incorporate connection flanges 220, 215 and 214 and function as previously described.

Stanchions 210 are bonded to the interior of sidewall 202 and sidewall 204, as previously described. Stanchions 212 are also bonded to the inside of sidewall 202 and sidewall 204, as previously described.

Stanchions 210 support longitudinal rebar 228 and longitudinal rebar 229. Likewise, stanchions 212 support longitudinal rebar 231 and longitudinal rebar 230. The longitudinal rebars are held in place on the stanchions by a suitable industrial heat adhesive, preferably an epoxy or resin.

Longitudinal rebars 228, 229, 230, and 231 are held in place on the stanchions via stirrup 226, which function as previously described.

Figure 3A:
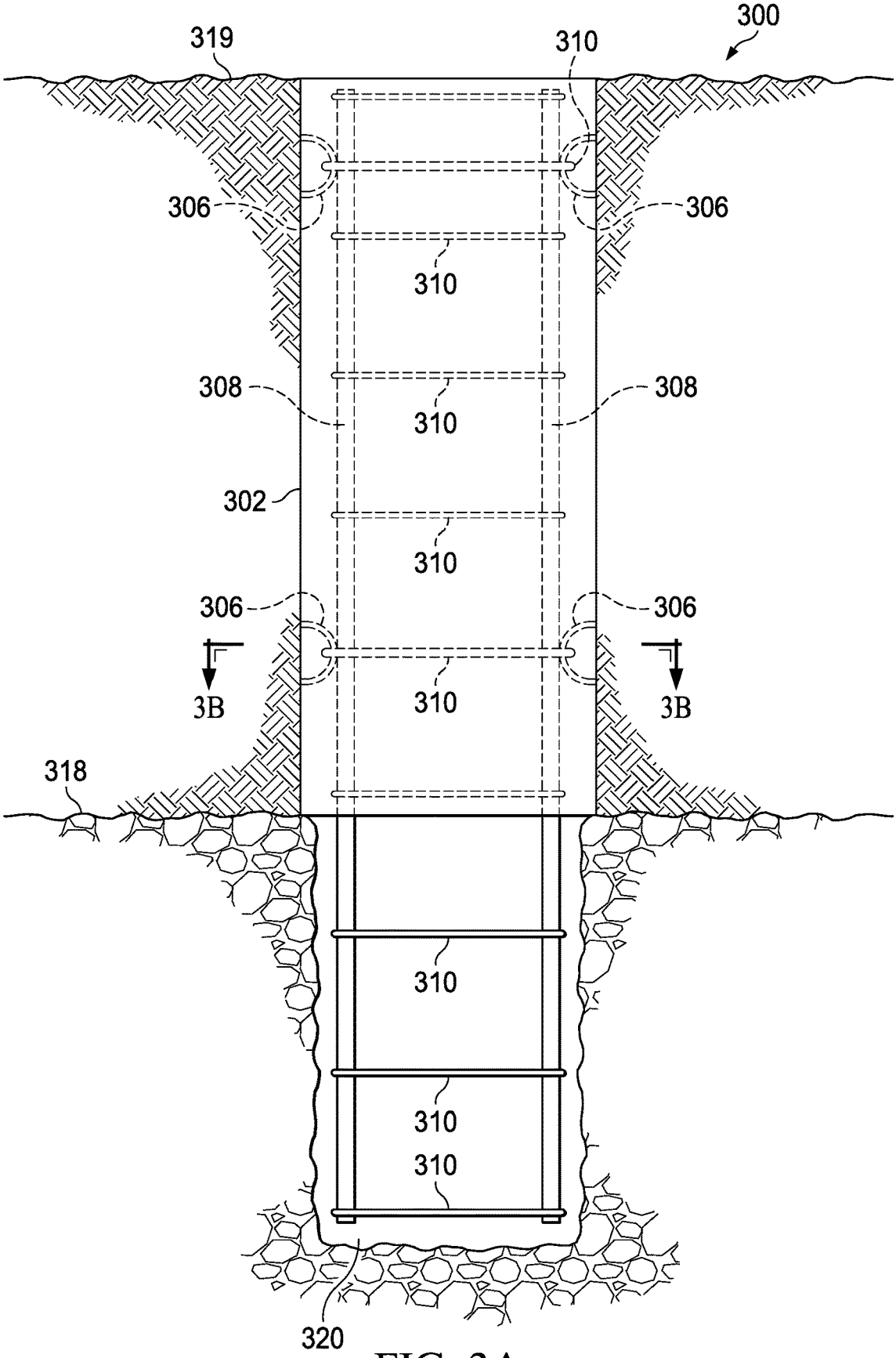
FIG. 3A is side view of a preferred embodiment of a formwork structure.
Figure 3B:
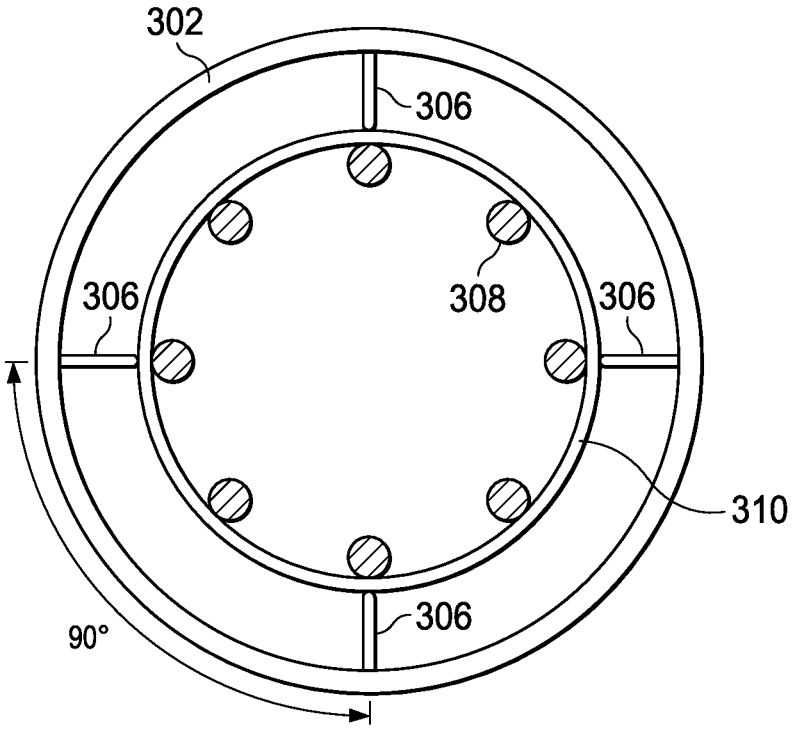
FIG. 3B is cross-sectional view of a preferred embodiment of a formwork structure.

Referring to FIGS. 3A and 3B, an alternate embodiment of a drilled pier formwork 300 will be described.

Drilled pier formwork 300 comprises cylindrical casing 302. Cylindrical casing 302 is integrally formed of an FRP material, as previously described. Chairs 306 are bonded to the interior surface of cylindrical casing 302. In a preferred embodiment, four (4) chairs are positioned on the interior of the cylindrical casing spaced at about 90° angels relative to a central axis of casing 302. However, other angles may be used, depending on the size of the circle tie required and the number of chairs required to adequately secure it. The chairs are positioned vertically at regular intervals within the cylindrical casing, as dictated by design constraints for the drilled pier.

FRP rebar 308 is positioned longitudinally within the cylindrical casing and held in position by circle ties 310. Circle ties 310 are bonded to FRP rebar 308 with epoxy or suitable industrial adhesive. In a preferred embodiment, one or more circle ties pass through one or more chairs 306 and are bonded in place by epoxy or a suitable industrial adhesive.

In a preferred use, the drill pier formwork assembly is placed in excavation 320 and filled with concrete. In a preferred embodiment, excavation 320 extends through soil layer 319, and into rock formation 318. In another embodiment, cylindrical casing 302 is positioned in soil layer 319 but does not extend into rock formation 318. In this case, FRP rebar 308 and circle ties 310 extend into rock layer. Cylindrical casing 302 is left in place after the concrete cures support and protect the drilled pier.

Figure 3C:
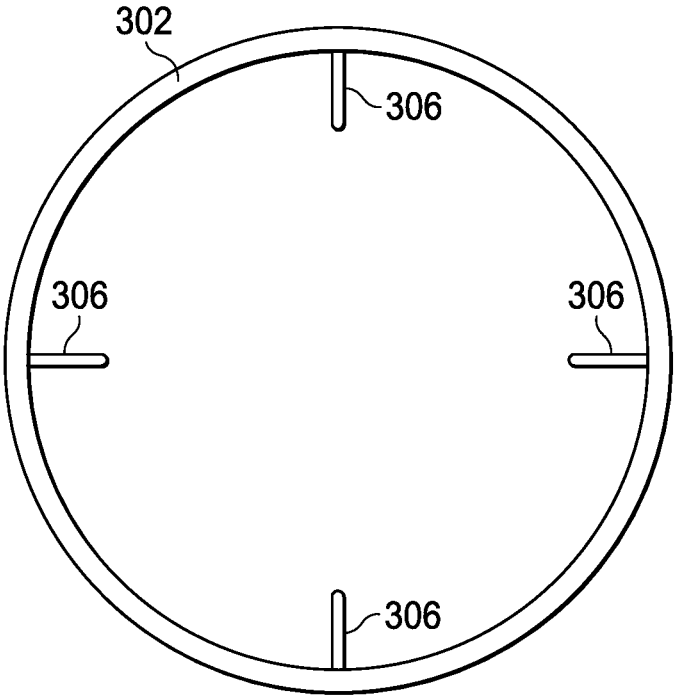
FIG. 3C is cross-sectional view of a preferred embodiment of a formwork structure.

Referring then to FIG. 3C, an alternate embodiment of drilled pier formwork 300 will be described.

In this embodiment, cylindrical casing 302 includes chairs 306, positioned on the interior surface of the cylindrical casing, as previously described.

In use, steel rebar is positioned in the cylindrical casing at the time of construction and bonded to the chairs. Concrete concrete is then placed. The cylindrical casing is left in place to protect and reinforce the drilled pier.

Figure 4A:
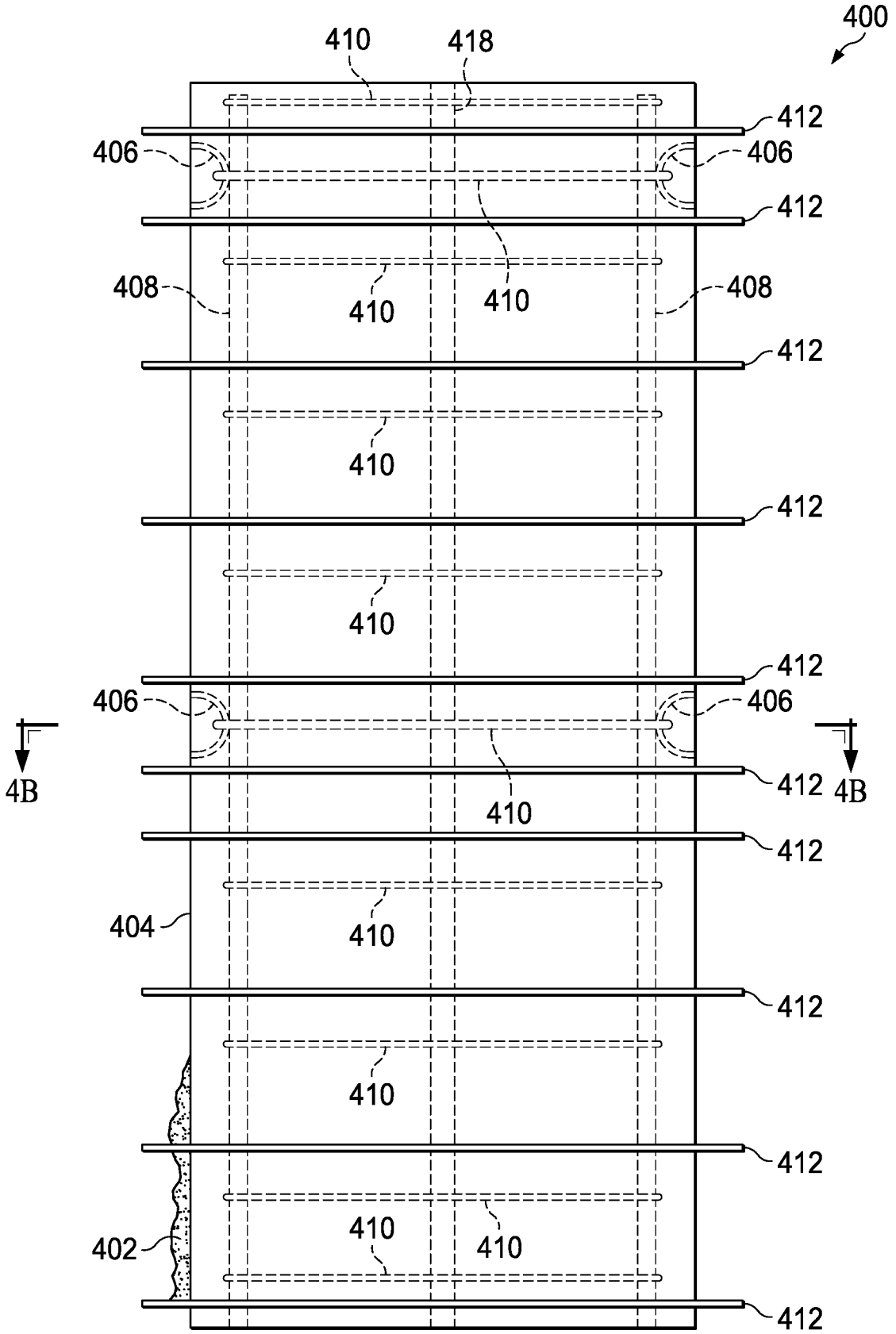
FIG. 4A is side view of a preferred embodiment of a formwork structure.
Figure 4B:
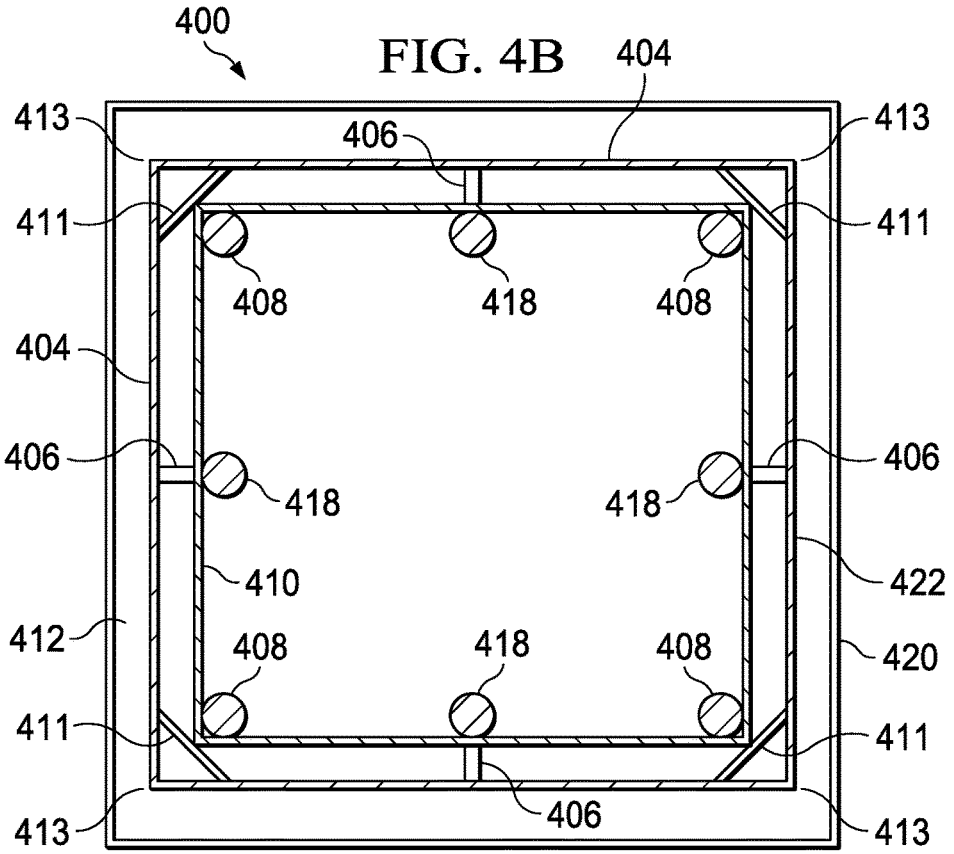
FIG. 4B is cross-sectional view of a preferred embodiment of a formwork structure.

Referring to FIGS. 4A and 4B, an alternate embodiment of square column formwork 400 will be described.

Cast-in-place square column formwork 400 is preferably formed from four side panels 404 positioned in a rectangular, and preferably a square cross section. The side panels are comprised of an FRP material, as previously described. Of course, the cross section of the column need not to be square and could take on other shapes such as rectangular or circular. Further, the dimensions may vary depending on design criteria.

Longitudinal corner braces 411 are positioned on the interior of the square panels adjacent corners 413. The corner braces are generally rectangular panels bonded to the side panels and extend the length of the column. In a preferred embodiment, the corner braces are an FRP material.

Corner rebar 408 is positioned adjacent each of the corner braces. Interstitial rebar 418 is centrally positioned between the corner rebar on the interior of each of the side panels. The interstitial rebar and the corner rebar extends longitudinally for the length of the column.

The corner braces are bonded to the interior of the side panels by epoxy or suitable industrial adhesive.

Chairs 406 are positioned on the interior faces of the side panels at interstitial positions. In a preferred embodiment, the chairs are placed at diametrically opposed positions at a number of longitudinal positions along the longitudinal axis of the column.

Interstitial rebar 418 and corner rebar 408 are held in position by a plurality of square ties 410. Square ties 410 are generally positioned parallel with each other on 2' centers along the longitudinal axis of the formwork. Square ties 410 are further comprised of four linear sections of FRP bar stock, bonded to interstitial rebar 418 and corner rebar 408 with epoxy or a suitable industrial adhesive.

Further, in a preferred embodiment, each of the chairs support at least one square tie. The chairs are bonded to the square tie and the rebar by epoxy or suitable industrial adhesive.

Adjacent the side panels are a plurality of square, planer, buttress ribs 412 having a square inside hole. Each buttress rib includes an outside perimeter 420 and an inside perimeter 422. In each case, the inside perimeter is bonded to the exterior of the side panels with a suitable epoxy. The buttress ribs are external to and circumferential with respect to the side panels and are positioned generally perpendicular to the longitudinal axis of the formwork on preferably 2' centers.

Buttress ribs 412 are evenly spaced along the exterior sides of side panels 404. The buttress ribs are preferably integrally formed with the side panels, although they may be separate pieces bonded to the side panels, as previously described. The buttress ribs are provided to resist deflection resulting from outward generated by placement of wet concrete in the form.

Chairs 406 are preferably cylindrical FRP bar stock having a diameter between about ¼" and about ½", as structurally required. Both ends of chairs 406 are bonded to the interior of the side panels using a suitable adhesive, as previously described. In one embodiment, the chairs are generally semi-circular.

Square ties 410 are evenly spaced along the longitudinal axis of the column. Corner rebars 408 and square ties 410 have a diameter between about ¼" and about 1", as required by design considerations.

Optionally, square column formwork 400 is further comprised of fireproof layer 402. The fireproof layer is comprised of a gypsum or cement spray-on material, such as Monokote by Atlas Sprayfoam Systems of Winnipeg, Manitoba, and may be applied to the entire exterior of the formwork and buttress ribs.

Figure 4C:
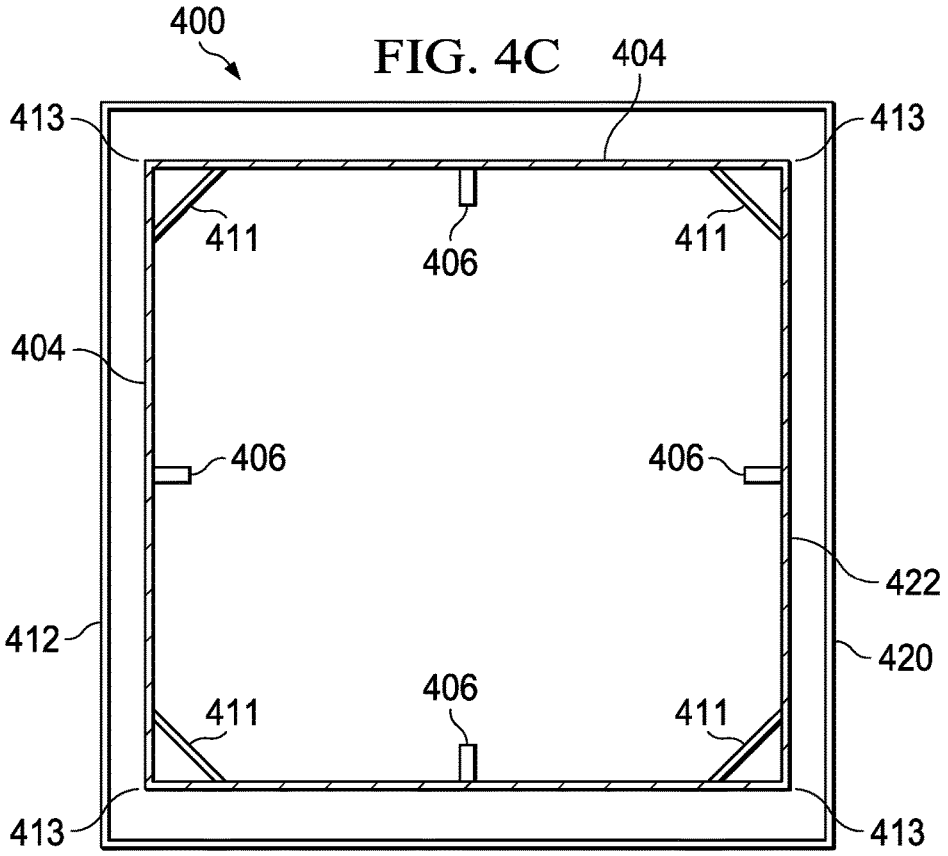
FIG. 4C is cross-sectional view of a preferred embodiment of a formwork structure.

As shown in FIG. 4C, in an alternate embodiment, square column formwork 400 is provided without rebar. In use, a rebar cage may be secured to chairs 406 using a suitable adhesive or ties, in the field prior to concrete placement.

Figure 5A:
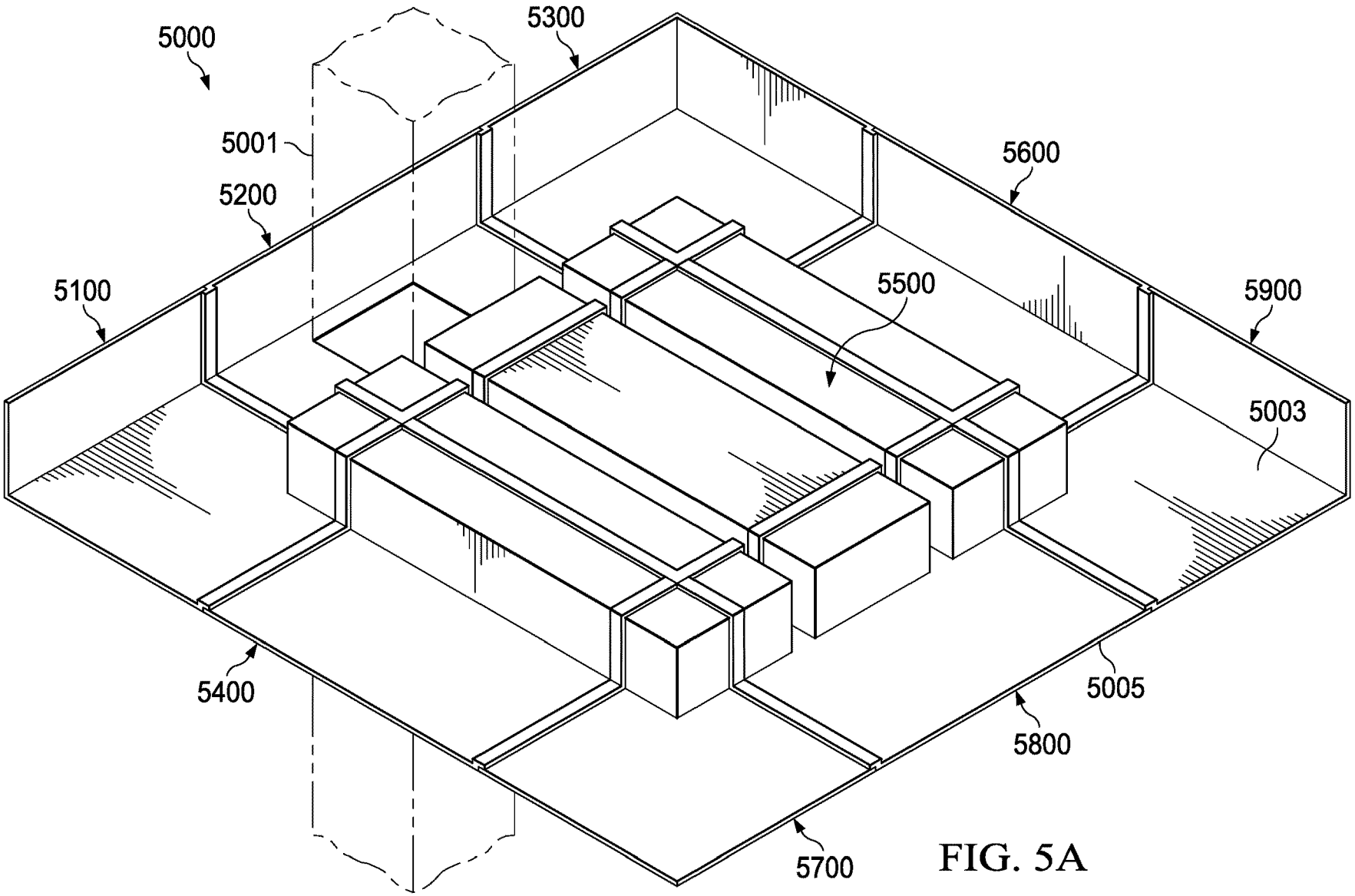
FIG. 5A is cross-sectional side view of a structure utilizing an assembled formwork structure for concrete reinforcement.
Figure 5B:
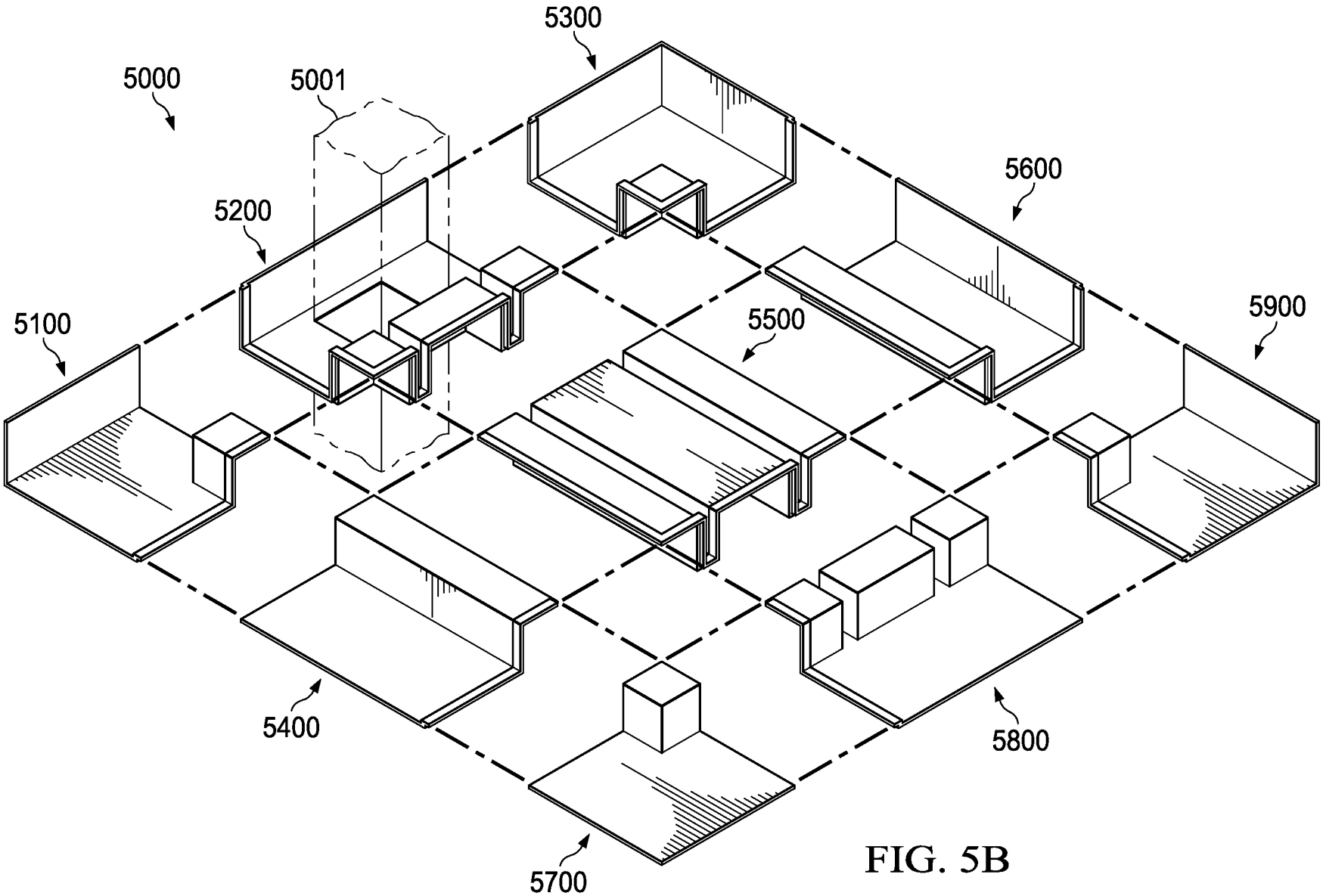
FIG. 5B is cross-sectional side view of a structure utilizing an assembled formwork structure for concrete reinforcement.

Referring to FIGS. 5A and 5B, in general, floor formwork 5000 is comprised of interlocking profiles. The floor formwork allows for both latitudinal and longitudinal expansion, by addition of profiles to accommodate floors of different designs, as will be further described. One of skill in the art will recognize that the profiles can be rearranged to accommodate different outside perimeter shapes with different channel beam requirements. Likewise, the profiles can be rearranged to accommodate different cross beam designs and different support column placements. Hence, the profile groups described are examples only, and can be modified to meet different design requirements. Further, it should be understood that the beam channels and cross beam channels may include rebar, and rebar support chairs as known in the art, or FRP rebar and chairs as disclosed with other embodiments of the invention.

In one preferred example of the invention, floor formwork 5000 forms three (3) projections with two (2) cross beam channels surrounded by side beam channels and corner beam channels, as will be further described. However, it should be appreciated that any number of projections, side beam channels, corner beam channels, and cross beam channels may be used depending on design considerations. The connection flanges are either integrally formed with the panels or are bonded in place. Likewise, the various profiles are constructed in a modular form and are bonded to each other when the formwork is assembled for use.

In this example, corner profile 5100 interfaces with side profiles 5200 and 5400. Side profile 5200 interfaces with corner profiles 5100 and 5300, center profile 5500, and column 5001. Alternatively, column 5001 may intersect with a corner profile, center profile, or another side profile. Corner profile 5300 interfaces with side profiles 5200 and 5600. Side profile 5400 interfaces with corner profiles 5100 and 5700 and center profile 5500. Center profile 5500 interfaces with side profiles 5200, 5400, 5600 and 5800. Side profile 5600 interfaces with corner profiles 5300 and 5900 and center profile 5500. Corner profile 5700 interfaces with side profiles 5400 and 5800. Side profile 5800 interfaces with corner profiles 5700 and 5900 and center profile 5500. Corner profile 5900 interfaces with side profiles 5600 and 5800.

Corner profiles 5100, 5700 and 5900, and side profiles 5400 and 5800 include extendable edges to expand the floor formwork. Corner profiles 5100, 5300, 5900, and 5700 form corner beam channels, as will be further described. Side profiles 5200, 5600, 5800, and 5400 form side beam channels, as will be further described. Side profile 5200, center profile 5500, and side profile 5800 form cross beam channels, as will be further described.

Floor formwork 5000 is further comprised of interior surface 5003 and exterior surface 5005. In a preferred embodiment, exterior surface 5005 has a pattern, texture and/or colorant, to increase aesthetic appeal.

The connection flanges, as will be further described, generally align the profiles with adjacent profiles to extend the longitudinal and latitudinal dimensions of the formwork system. These connection flanges may be rearranged to accommodate different profile placements for different design requirements, so long as they function to mechanically join the profiles and seal junctions between them to avoid loss of uncured concrete during concrete placement. In one example, the connection flanges are comprised of FRP sheets having a thickness of between about ¼" and about ½", and a width of about 4", as structurally required. The connection flanges are generally parallel to their associated panels. In one embodiment, the connection flanges are integrally formed with the panels using standard extrusions or casting methods such as vacuum molding. In another embodiment, the connection flanges are bonded to the panels using an epoxy or other suitable adhesive resin. Alternatively, the connection flanges may be bonded to the panels using mechanical fasteners, such as screws or rivets. It should be appreciated that the flanges and receiving edges can be in different or reversed in positions.

The various profiles are shown and described with specific numbers of side beam channels, cross beam channels, and projections. The invention is not limited to these numbers of profiles or these numbers of channels and projections but can be adapted to include smaller or larger numbers of modular profiles with varying channels and projections as any floor design requires.

Similarly, the invention is shown and described with a single center profile. However, the invention is not limited to a single center profile, rather any number of center profiles may be bonded together and connected to side profiles as needed to meet design requirements.

Different dimensions can be used depending on design considerations.

Figure 5C:
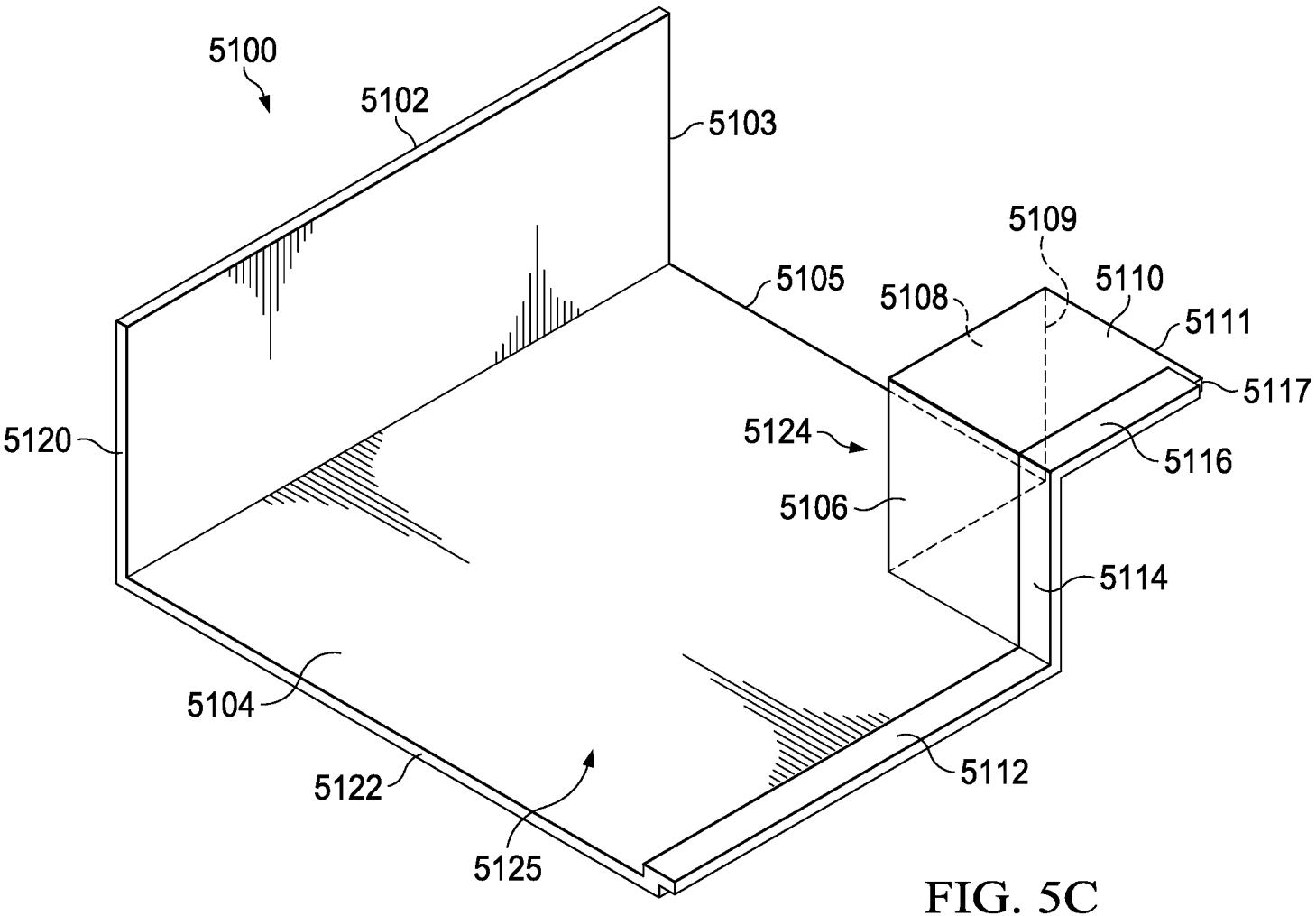
FIG. 5C is cross-sectional detail view of an assembled formwork structure.

Referring to FIG. 5C, corner profile 5100 will be further described.

Corner profile 5100 is comprised of side panel 5102, horizontal lower panel 5104 and corner projection 5124. Side panel 5102 and horizontal lower panel 5104 include extendable edge 5120 and extendable edge 5122, respectively. Corner projection 5124 is comprised of horizontal upper panel 5110, vertical panel 5106, and vertical interior panel 5108.

Side panel 5102 is connected to horizontal lower panel 5104. Horizontal lower panel 5104 is further connected to vertical panel 5106 and vertical interior panel 5108. Vertical interior panel 5108 is further connected to horizontal upper panel 5110 and vertical panel 5106. Vertical panel 5106 is further connected to horizontal upper panel 5110. Vertical interior panel 5108 is parallel to side panel 5102 and perpendicular to vertical panel 5106.

Corner projection 5124, horizontal lower panel 5104, and side panel 5102 form corner beam channel 5125. Corner beam channel 5125 is adjacent side beam channel 5269 and side beam channel 5422.

Horizontal connection flange 5112 is connected to horizontal lower panel 5104 and vertical connection flange 5114. Vertical connection flange 5114 is connected to vertical panel 5106 and horizontal connection flange 5116. Horizontal connection flange 5116 is connected to horizontal upper panel 5110. The connection flanges are generally parallel with the panels to which they attached.

Horizontal connection flange 5116 accommodates notch 5117. Notch 5117 is adapted to accommodate horizontal connection flange 5238, as will be further described. Notch 5117 and receiving edges 5103, 5105, 5109, and 5111 are similarly adapted to interface with connection flanges 5314, 5316, 5318, and 5320 of corner profile 5300, thereby decreasing the latitudinal dimensions of the system.

Horizontal connection flange 5112, vertical connection flange 5114, and horizontal connection flange 5116 are adapted to interface with receiving edge 5403 of horizontal lower panel 5402, receiving edge 5405 of vertical panel 5404, and receiving edge 5407 of horizontal upper panel 5406, as will be further described.

Figure 5D:
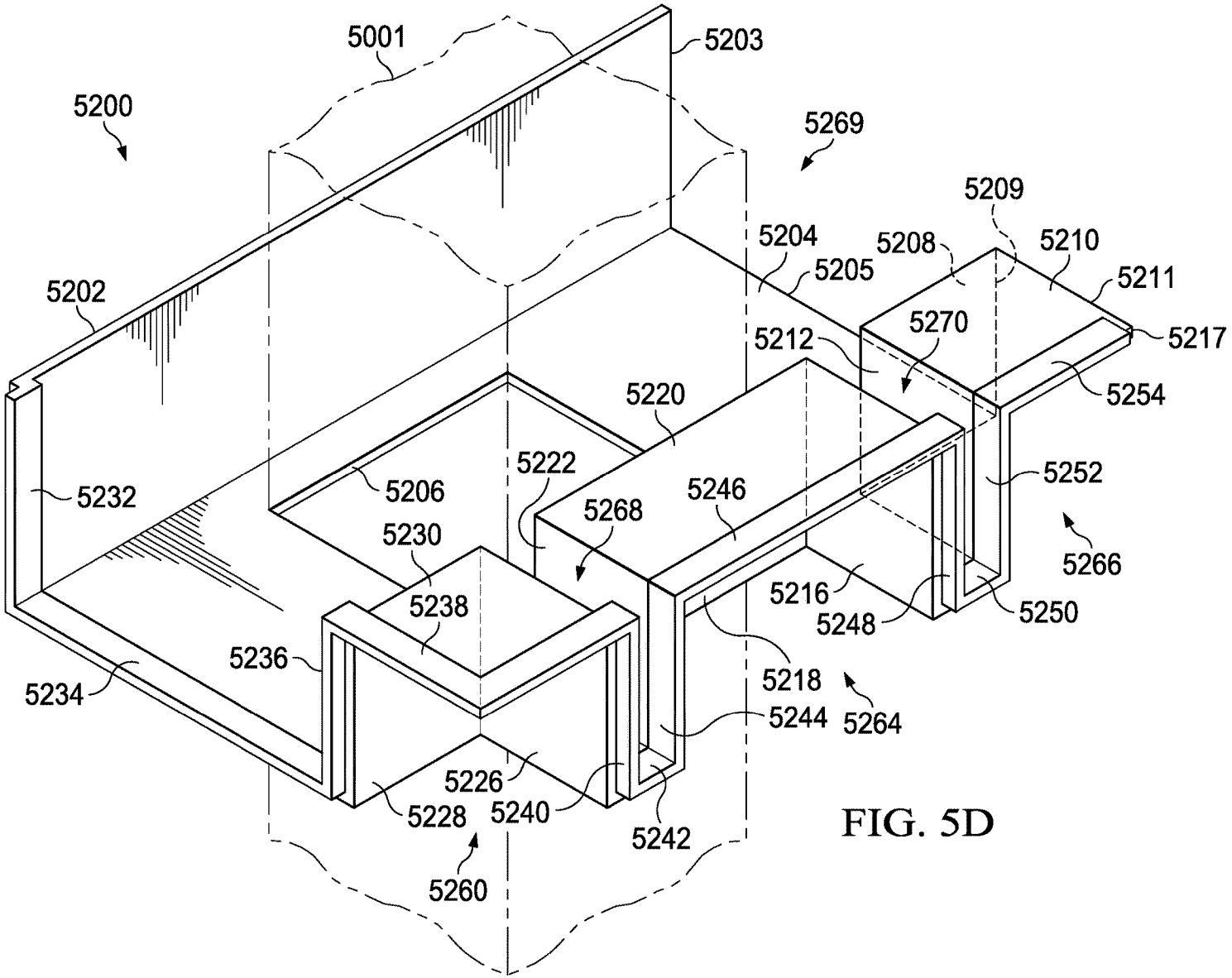
FIG. 5D is an isometric view of a formwork segment.

Referring then to FIG. 5D, side profile 5200 is comprised of side panel 5202, horizontal lower panel 5204, corner projection 5260, center projection 5264, and corner projection 5266. Side panel 5202 is connected to horizontal lower panel 5204. Horizontal lower panel 5204 includes hole 5206 to interface with column 5001. Hole 5206 may also be included in a corner profile, center profile, or another side profile, as needed based on design requirements. Horizontal lower panel 5204 is further connected to corner projection 5260, center projection 5264, and corner projection 5266. Corner projection 5260, center projection 5264, and corner projection 5266 form cross beam channels 5268 and 5270, as will be further described.

Corner projection 5260 is comprised of vertical interior panel 5228, vertical panel 5226, and horizontal upper panel 5230. Vertical interior panel 5228 is connected to horizontal lower panel 5204, vertical panel 5226, and horizontal upper panel 5230. Vertical panel 5226 is further connected to horizontal lower panel 5204 and horizontal upper panel 5230. Vertical interior panel 5228 is parallel to side panel 5202 and perpendicular to vertical panel 5226 and the horizontal panels.

Center projection 5264 is comprised of vertical panel 5222 and vertical panel 5216, vertical interior panel 5218, and horizontal upper panel 5220. Vertical panel 5222 is connected to horizontal lower panel 5204, vertical interior panel 5218, and horizontal upper panel 5220. Vertical interior panel 5218 is further connected to horizontal lower panel 5204, vertical panel 5216, and horizontal upper panel 5220. Vertical panel 5216 is further connected to horizontal lower panel 5204 and horizontal upper panel 5220. Vertical interior panel 5218 is parallel to side panel 5202 and perpendicular to vertical panels 5216 and 5222 and the horizontal panels.

Corner projection 5266 is comprised of vertical interior panel 5208, vertical panel 5212, and horizontal upper panel 5210. Vertical interior panel 5208 is connected to horizontal lower panel 5204, vertical panel 5212, and horizontal upper panel 5210. Vertical panel 5212 is further connected to horizontal lower panel 5204 and horizontal upper panel 5210. Vertical interior panel 5208 is parallel to side panel 5202 and perpendicular to vertical panel 5212 and the horizontal panels.

The horizontal upper panels are generally coplanar. The vertical panels are generally parallel and connected to the horizontal panels at perpendicular angles. The vertical interior panels are generally coplanar. Side panel 5202 is generally perpendicular to horizontal lower panel 5204.

Cross beam channel 5268 is formed between vertical panel 5226 of corner projection 5260 and vertical panel 5222 of center projection 5264. Cross beam channel 5270 is formed between vertical panel 5212 of corner projection 5266 and vertical panel 5216 of center projection 5264.

Side panel 5202, vertical interior panel 5228, vertical interior panel 5218, and vertical interior panel 5208 form side beam channel 5269. Side beam channel 5269 intersects corner beam channels 5125 and 5328. Side beam channel 5269 is generally perpendicular with cross beam channels 5268 and 5270. Side beam channel 5269 is generally parallel with side beam channel 5861.

Vertical connection flange 5232 is connected to side panel 5202. Vertical connection flange 5232 is further connected to horizontal connection flange 5234. Horizontal connection flange 5234 is connected to horizontal lower panel 5204. Horizontal connection flange 5234 is further connected to vertical connection flange 5236. Vertical connection flange 5236 is further connected to vertical interior panel 5228 and horizontal connection flange 5238. Horizontal connection flange 5238 is connected to horizontal upper panel 5230 and vertical connection flange 5240. Vertical connection flange 5240 is connected to vertical panel 5226 and horizontal connection flange 5242. Horizontal connection flange 5242 is connected to horizontal lower panel 5204 and vertical connection flange 5244. Vertical connection flange 5244 is connected to vertical panel 5222 and horizontal connection flange 5246. Horizontal connection flange 5246 is connected to horizontal upper panel 5220 and vertical connection flange 5248. Vertical connection flange 5248 is connected to vertical panel 5216 and horizontal connection flange 5250. Horizontal connection flange 5250 is connected to horizontal lower panel 5204 and vertical connection flange 5252. Vertical connection flange 5252 is connected to vertical panel 5212 and horizontal connection flange 5254. Horizontal connection flange 5254 is connected to horizontal upper panel 5210. Horizontal connection flange 5254 accommodates notch 5217.

Notch 5217 is adapted to accommodate horizontal connection flange 5320, as will be further described. Vertical connection flange 5232, horizontal connection flange 5234, vertical connection flange 5236, and horizontal connection flange 5238 are adapted to interface with receiving edge 5103 of side panel 5102, receiving edge 5105 of horizontal lower panel 5104, receiving edge 5109 of vertical interior panel 5108, and receiving edge 5111 of horizontal upper panel 5110, respectively.

Connection flanges 5238, 5240, 5242, 5244, 5246, 5248, 5250, 5252 and 5254 are adapted to interface with receiving edges 5550, 5552, 5554, 5556, 5558, 5560, 5562, 5564, and 5566 of panels 5502, 5504, 5506, 5508, 5510, 5512, 5514, 5516 and 5518. Horizontal connection flange 5238 is adapted to interface with notch 5522, as will be further described.

Connection flanges 5232, 5234, 5236, and 5238 are further adapted to interface with receiving edges 5203, 5205, 5209, and 5211, respectively, thereby permitting engagement of additional side profiles with each other to increase the latitudinal dimensions of the system.

Figure 5E:
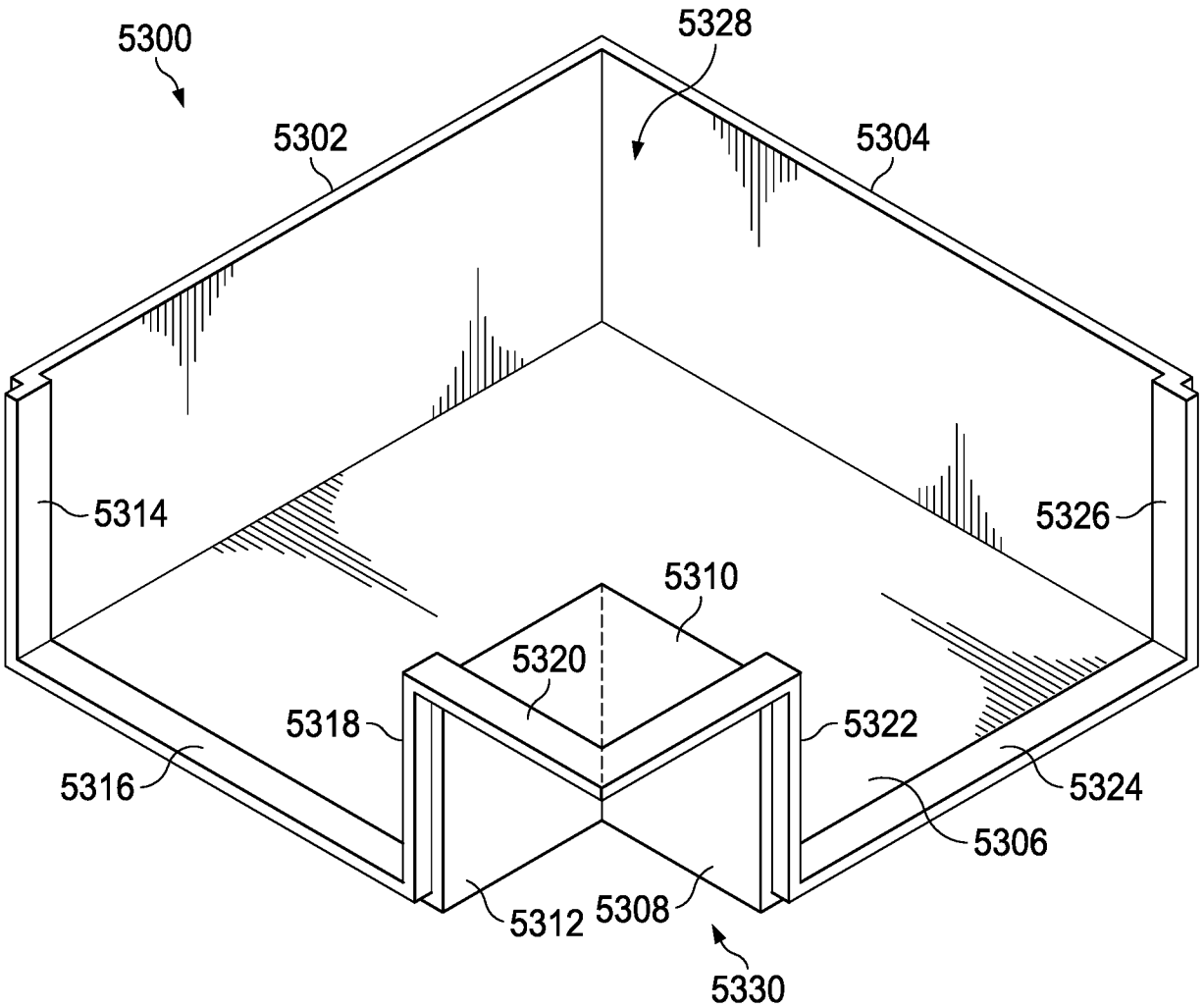
FIG. 5E is an isometric view of a formwork segment.

Referring to FIG. 5E, corner profile 5300 is comprised of side panel 5302, side panel 5304, horizontal lower panel 5306, and corner projection 5330. Side panel 5302 is connected to side panel 5304, and horizontal lower panel 5306. Side panel 5304 is further connected to horizontal lower panel 5306. Horizontal lower panel 5306 is further connected to corner projection 5330.

Corner projection 5330 is comprised of vertical panel 5312, vertical panel 5308, and horizontal upper panel 5310. Vertical panel 5312 is connected to horizontal lower panel 5306, vertical panel 5308, and horizontal upper panel 5310. Vertical panel 5308 is further connected to horizontal lower panel 5306, and horizontal upper panel 5310.

Side panel 5302 is perpendicular to side panel 5304. The side panels are generally perpendicular to horizontal lower panel 5306. Vertical panel 5308 is parallel to side panel 5304 and vertical panel 5312 is parallel to side panel 5302. The horizontal upper panel is generally parallel to the horizontal lower panel.

Corner projection 5330, side panel 5302, and side panel 5304 form corner beam channel 5328. Corner beam channel 5328 is adjacent side beam channel 5269 and side beam channel 5622. Corner beam channel 5328 is diametrically opposed to corner beam channel 5728.

Vertical connection flange 5314 is connected to side panel 5302 and horizontal connection flange 5316. Horizontal connection flange 5316 is connected to horizontal lower panel 5306 and vertical connection flange 5318. Vertical connection flange 5318 is connected to vertical panel 5312 and horizontal connection flange 5320. Horizontal connection flange 5320 is connected to horizontal upper panel 5310 and vertical connection flange 5322. Vertical connection flange 5322 is connected to vertical panel 5308 and horizontal connection flange 5324. Horizontal connection flange 5324 is connected to horizontal lower panel 5306 and vertical connection flange 5326. Vertical connection flange 5326 is connected to side panel 5304.

Vertical connection flange 5314, horizontal connection flange 5316, vertical connection flange 5318, and horizontal connection flange 5320 are adapted to interface with receiving edge 5203, receiving edge 5205, receiving edge 5209, receiving edge 5211 and notch 5217 of side profile 5200, respectively, as shown in FIG. 5D.

Vertical connection flange 5326, horizontal connection flange 5324, vertical connection flange 5322, and horizontal connection flange 5320 are adapted to interface with receiving edge 5609, receiving edge 5607, receiving edge 5605, receiving edge 5603, and notch 5610 of side profile 5600, respectively, as previously described.

Figure 5F:
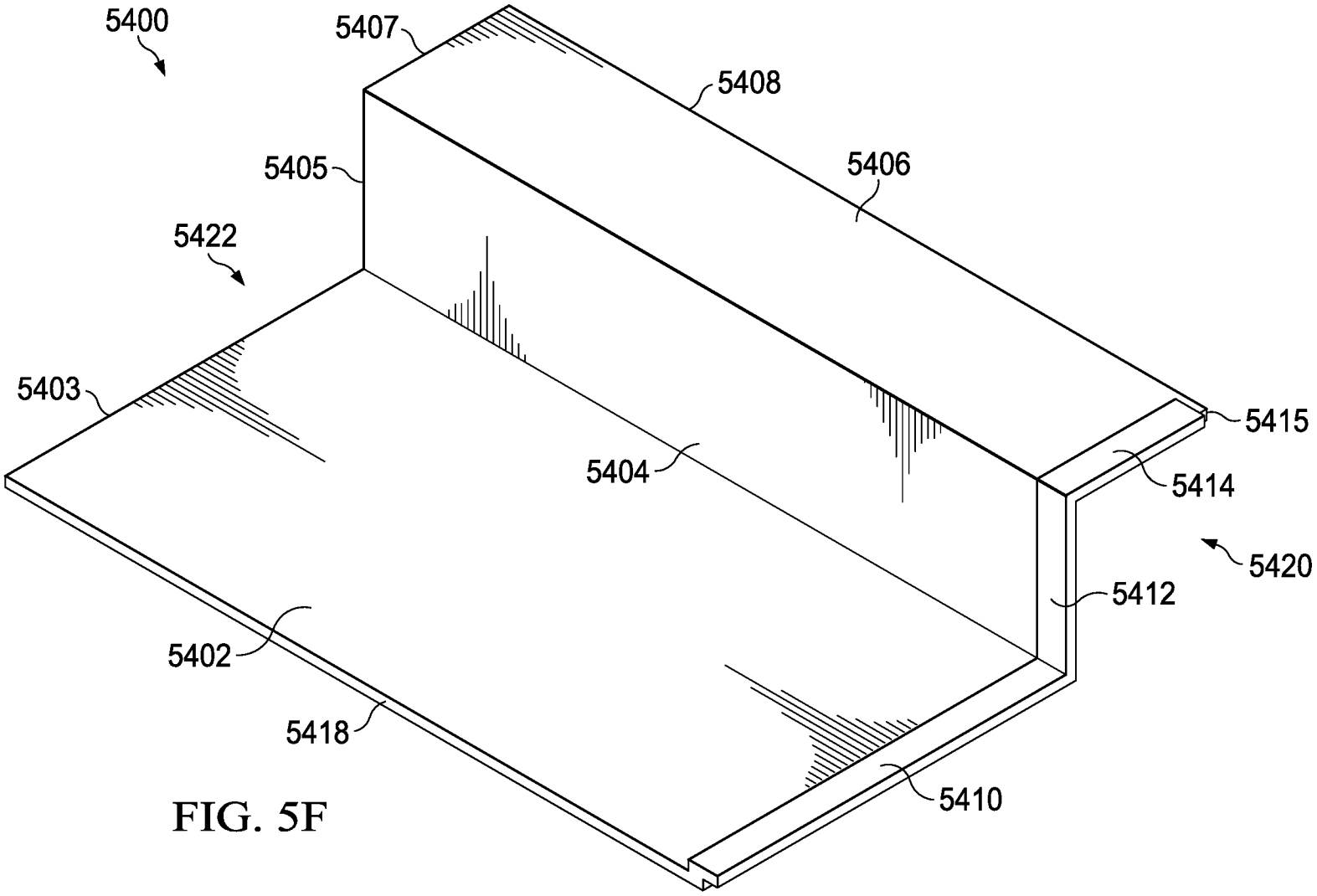
FIG. 5F is an isometric view of a formwork segment.

Referring to FIG. 5F, side profile 5400 is comprised of side projection 5420 and horizontal lower panel 5402. Horizontal lower panel 5402 includes extendable edge 5418 and is connected to side projection 5420. Side projection 5420 is comprised of vertical panel 5404 and horizontal upper panel 5406. Vertical panel 5404 connects to the horizontal lower panel 5402 and the horizontal upper panel 5406. The horizontal upper panel and horizontal lower panel are generally parallel. The vertical panel is generally perpendicular to the horizontal panels.

Side projection 5420 and horizontal lower panel 5402 form side beam channel 5422. Side beam channel 5422 is adjacent corner beam channel 5328 and corner beam channel 5928. Side beam channel 5422 is generally parallel with cross beam channels 5576 and 5578, and side beam channel 5622.

Horizontal connection flange 5410 is connected to horizontal lower panel 5402 and vertical connection flange 5412. Vertical connection flange 5412 is connected to vertical panel 5404 and horizontal connection flange 5414. Horizontal connection flange 5414 is connected to horizontal upper panel 5406. Horizontal connection flange 5414 accommodates notch 5415.

Notch 5415 and receiving edge 5408 are adapted to interface with horizontal connection flange 5524, as will be further described. Notch 5415 is similarly adapted to interface with horizontal connection flange 5612 of side profile 5600, thereby decreasing the latitudinal dimensions of the system. Horizontal connection flange 5410, vertical connection flange 5412, and horizontal connection flange 5414 are adapted to interface with receiving edge 5704, receiving edge 5708, and receiving edge 5710 of corner profile 5700, respectively.

Connection flanges 5112, 5114, and 5116 are adapted to interface with receiving edges 5403, 5405, and 5407.

Connection flanges 5410, 5412, and 5414 are further adapted to interface with receiving edges 5403, 5405 and 5407, thereby permitting engagement of identical side profiles 5400 with each other to increase the longitudinal dimension of the formwork system.

Figure 5G:
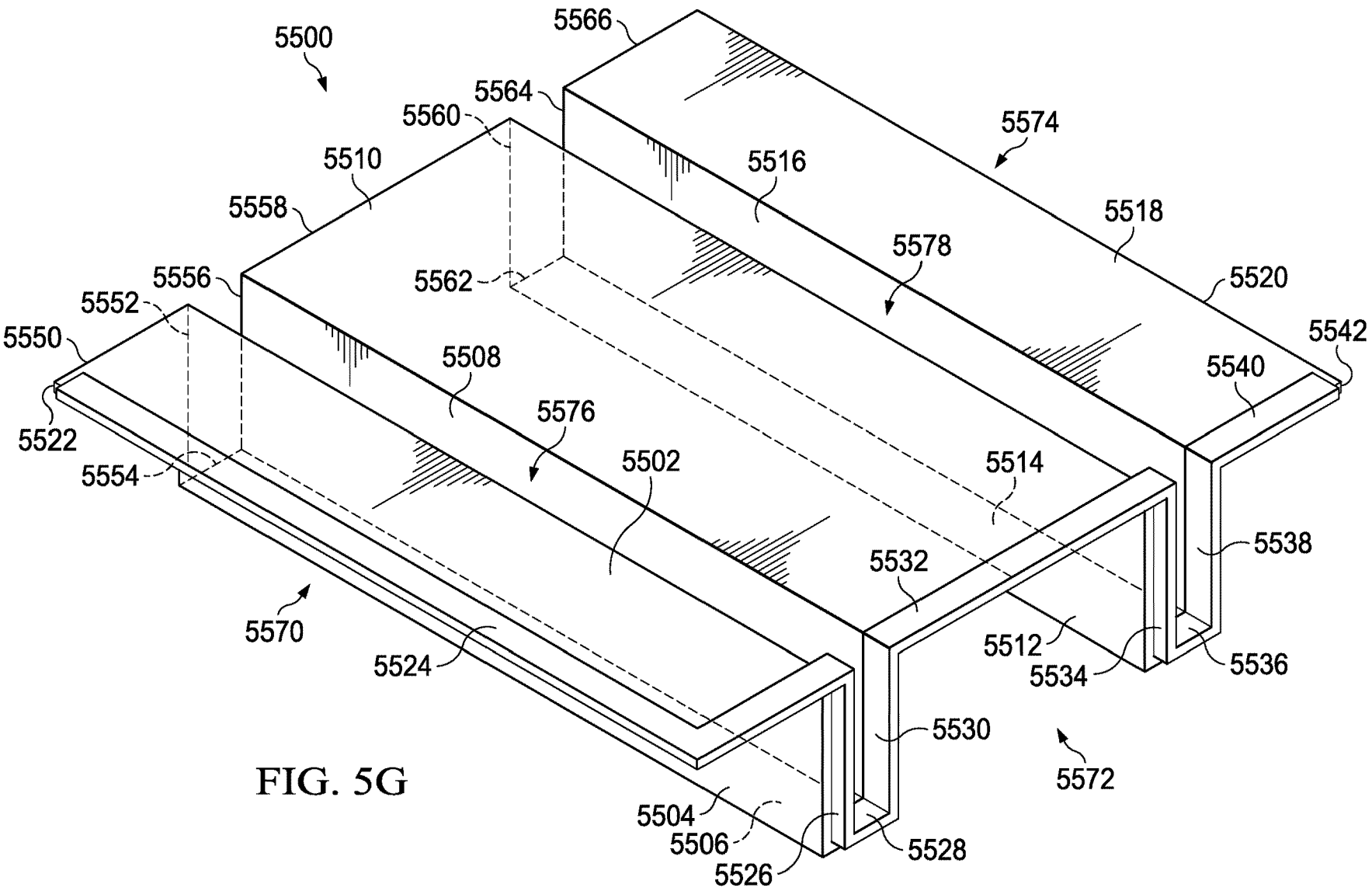
FIG. 5G is an isometric view of a formwork segment.

Referring to FIG. 5G, center profile 5500 is comprised of side projection 5570, channel projection 5572 and side projection 5574. Side projection 5570, channel projection 5572, and side projection 5574 form cross beam channel 5576 and cross beam channel 5578, as will be further described.

Side projection 5570 is comprised of horizontal upper panel 5502 and vertical panel 5504. Channel projection 5572 is comprised of vertical panel 5508, horizontal upper panel 5510, and vertical panel 5512. Side projection 5574 is comprised of horizontal upper panel 5518 and vertical panel 5516.

Horizontal upper panel 5502 is connected to vertical panel 5504. Vertical panel 5504 is further connected to horizontal lower panel 5506. Horizontal lower panel 5506 is further connected to vertical panel 5508. Vertical panel 5508 is connected to horizontal upper panel 5510. Horizontal upper panel 5510 is connected to vertical panel 5512. Vertical panel 5512 is connected to horizontal lower panel 5514. Horizontal lower panel 5514 is connected to vertical panel 5516. Vertical panel 5516 is connected to horizontal upper panel 5518. The horizontal upper panels are generally coplanar. The horizontal lower panels are generally coplanar. The horizontal upper panels are generally parallel to the horizontal lower panels. The vertical panels are generally parallel. The vertical panels are generally perpendicular to the horizontal upper panels and the horizontal lower panels.

Cross beam channel 5576 is formed between vertical panel 5504 of side projection 5570 and vertical panel 5508 of channel projection 5572. Cross beam channel 5578 is formed between vertical panel 5512 of channel projection 5572 and vertical panel 5516 of side projection 5574.

Horizontal connection flange 5524 is connected to horizontal upper panel 5502 and vertical connection flange 5526. Vertical connection flange 5526 is connected to vertical panel 5504 and horizontal connection flange 5528. Horizontal connection flange 5528 is connected to horizontal lower panel 5506 and vertical connection flange 5530. Vertical connection flange 5530 is connected to vertical panel 5508 and horizontal connection flange 5532. Horizontal connection flange 5532 is connected to horizontal upper panel 5510 and vertical connection flange 5534. Vertical connection flange 5534 is connected to vertical panel 5512 and horizontal connection flange 5536. Horizontal connection flange 5536 is connected to horizontal lower panel 5514 and vertical connection flange 5538. Vertical connection flange 5538 is connected to vertical panel 5516 and horizontal connection flange 5540.

Horizontal connection flange 5540 is adapted to accommodate notch 5542. Connection flanges 5524, 5526, 5528, 5530, 5532, 5534, 5536, 5538, and 5540 and notch 5542 are adapted to interface with receiving edges 5832, 5834, 5836, 5838, 5840, 5842, 5844, 5846, and 5848, and notch 5824, as will be further described.

Horizontal connection flange 5524 is adapted to accommodate notch 5522. Receiving edges 5550, 5552, 5554, 5556, 5558, 5560, 5562, 5564, and 5566, and notch 5522 are adapted to interface with horizontal connection flanges 5238, 5240, 5242, 5244, 5246, 5248, 5250, 5252, and 5254, and notch 5217. Receiving edges 5550, 5552, 5554, 5556, 5558, 5560, 5562, 5564, and 5566, and notch 5522 are further adapted to interface with connection flanges 5524, 5526, 5528, 5530, 5532, 5534, 5536, 5538, and 5540 and notch 5542, thereby permitting engagement of identical center profiles 5500 with each other to extend the longitudinal reach of the formwork system.

Horizontal connection flange 5524 is adapted to interface with receiving edge 5408 and notch 5415 of side profile 5400. Horizontal connection flange 5524 and notch 5522 are further adapted to interface with receiving edge 5520 and notch 5542, thereby permitting engagement of identical center profiles 5500 with each other to extend the latitudinal reach of the formwork system.

Figure 5H:
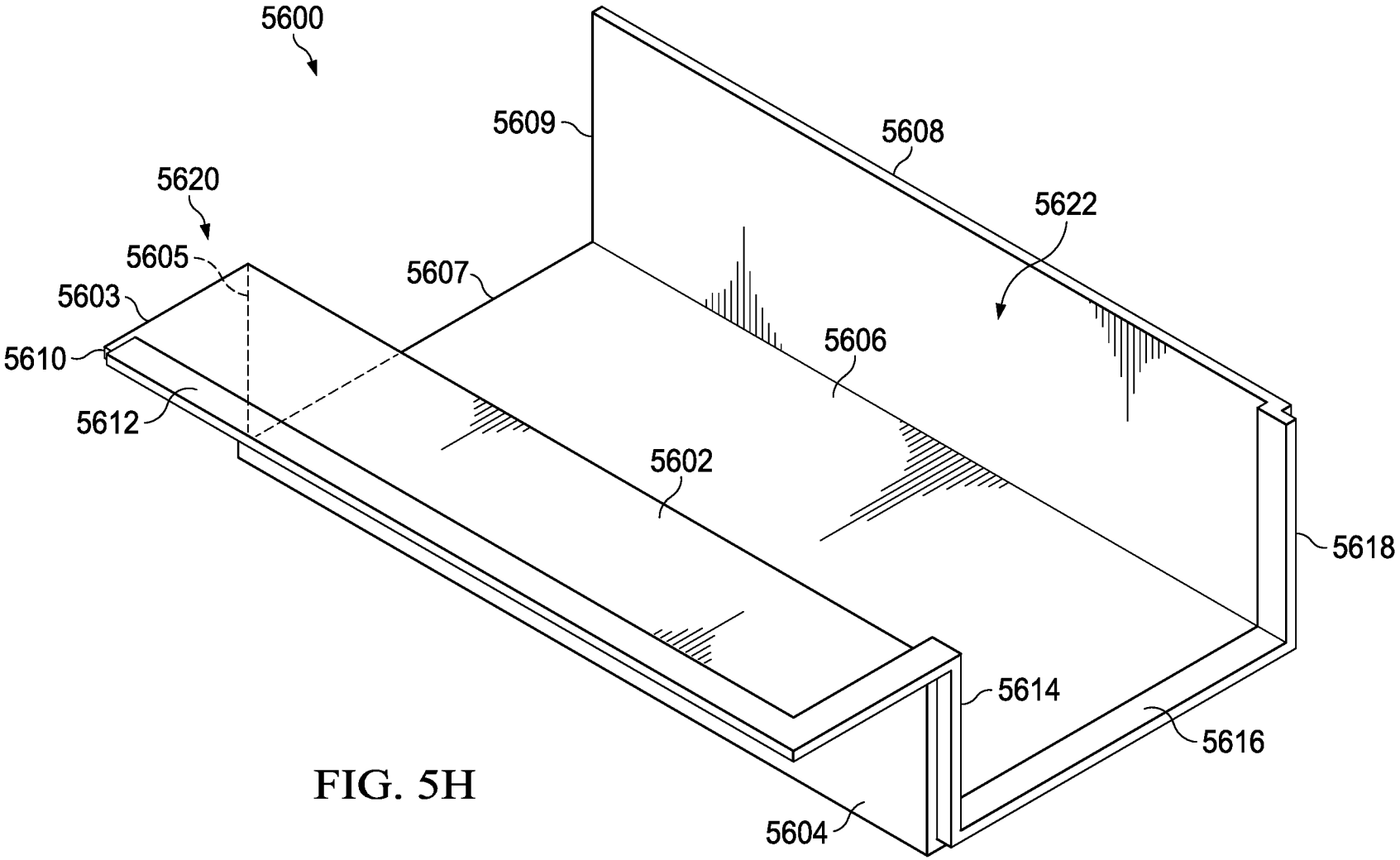
FIG. 5H is an isometric view of a formwork segment.

Referring to FIG. 5H, side profile 5600 includes side projection 5620. Side projection 5620 is comprised of horizontal upper panel 5602 and vertical panel 5604. Horizontal upper panel 5602 is connected to vertical panel 5604. Vertical panel 5604 is further connected to horizontal lower panel 5606. Horizontal lower panel 5606 is further connected to side panel 5608. Side panel 5608 is generally perpendicular to horizontal lower panel 5606. The horizontal upper panel is generally parallel to the horizontal lower panel. The vertical panel is generally parallel to the side panel. The vertical panel and side panel are generally perpendicular to the horizontal panels.

Side panel 5608, horizontal lower panel 5606, and side projection 5620 form side beam channel 5622. Side beam channel 5622 is adjacent corner beam channel 5328 and corner beam channel 5728. Side beam channel 5622 is generally parallel with cross beam channels 5576 and 5578, and side beam channel 5422.

Vertical connection flange 5618 is connected to side panel 5608 and horizontal connection flange 5616. Horizontal connection flange 5616 is connected to horizontal lower panel 5606 and vertical connection flange 5614. Vertical connection flange 5614 is connected to vertical panel 5604 and horizontal connection flange 5612. Horizontal connection flange 5612 is connected to horizontal upper panel 5602 and is adapted to accommodate notch 5610.

Connection flanges 5612, 5614, 5616, and 5618 are adapted to interface with receiving edges 5920, 5922, 5924, and 5926, and notch 5912, as will be further described. Connection flanges 5612, 5614, 5616, and 5618 are further adapted to interface with receiving edges 5603, 5605, 5607, and 5609, and notch 5610, thereby permitting engagement of identical side profiles 5600 to extend the longitudinal reach of the formwork system.

Horizontal connection flange 5612 is adapted to interface with receiving edge 5520 and notch 5542 of center profile 5500. Receiving edges 5603, 5605, 5607, and 5609, and notch 5610 are further adapted to interface with connection flanges 5320, 5322, 5324, and 5326, as previously described.

Figure 5I:
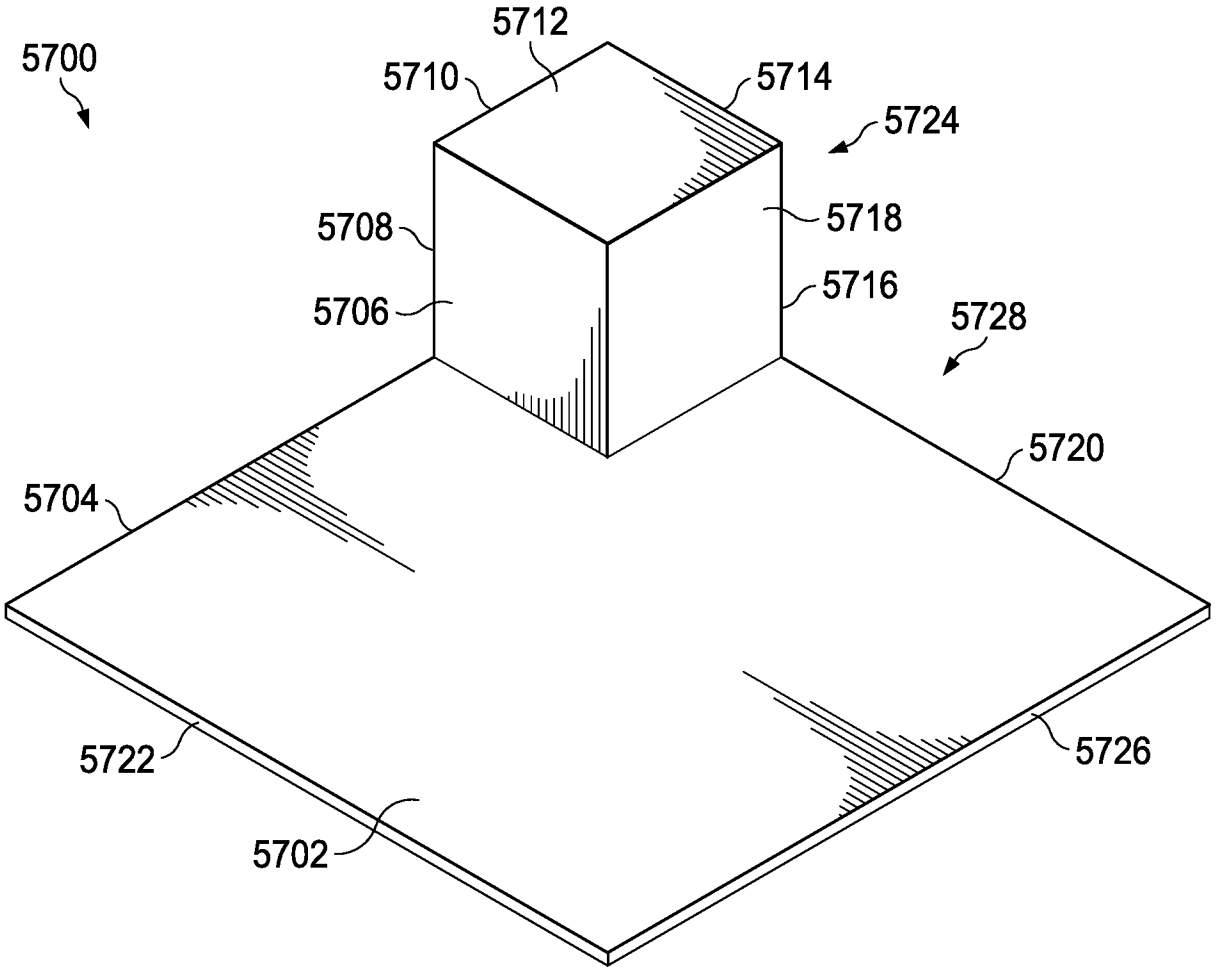
FIG. 5I is an isometric view of a formwork segment.

Referring to FIG. 5I, corner profile 5700 comprises corner projection 5724 connected to horizontal lower panel 5702. Horizontal lower panel 5702 includes extendable edge 5722 and extendable edge 5726. Corner projection 5724 is comprised of vertical panel 5706, horizontal upper panel 5712 and vertical panel 5718. Vertical panel 5706 is connected to horizontal lower panel 5702, vertical panel 5718 and horizontal upper panel 5712. Vertical panel 5718 is further connected to horizontal lower panel 5702 and horizontal upper panel 5712. The horizontal upper panel is generally parallel to the lower horizontal panel. Vertical panel 5706 is generally perpendicular with vertical panel 5718. The vertical panels are generally perpendicular to the horizontal upper panels and the horizontal lower panel.

Corner projection 5724 and horizontal lower panel 5702 form corner beam channel 5728. Corner beam channel 5728 is adjacent side beam channel 5422 and side beam channel 5861. Corner beam channel 5728 is diametrically opposed to corner beam channel 5328.

Receiving edges 5704, 5708, and 5710 are adapted to interface with connection flanges 5410, 5412, and 5414, and notch 5415 of side profile 5400, as previously described. Receiving edges 5704, 5708, and 5710 are similarly adapted to interface with connection flanges 5112, 5114, and 5116, and notch 5117 of side profile 5100, thereby decreasing the longitudinal dimensions of the system.

Receiving edges 5714, 5716, and 5720 are adapted to interface with connection flanges 5826, 5828, and 5830, and notch 5824, as will be further described. Receiving edges 5714, 5716, and 5720 are similarly adapted to interface with connection flanges 5914, 5916, and 5918, and notch 5912, thereby decreasing the latitudinal dimensions of the system.

Figure 5J:
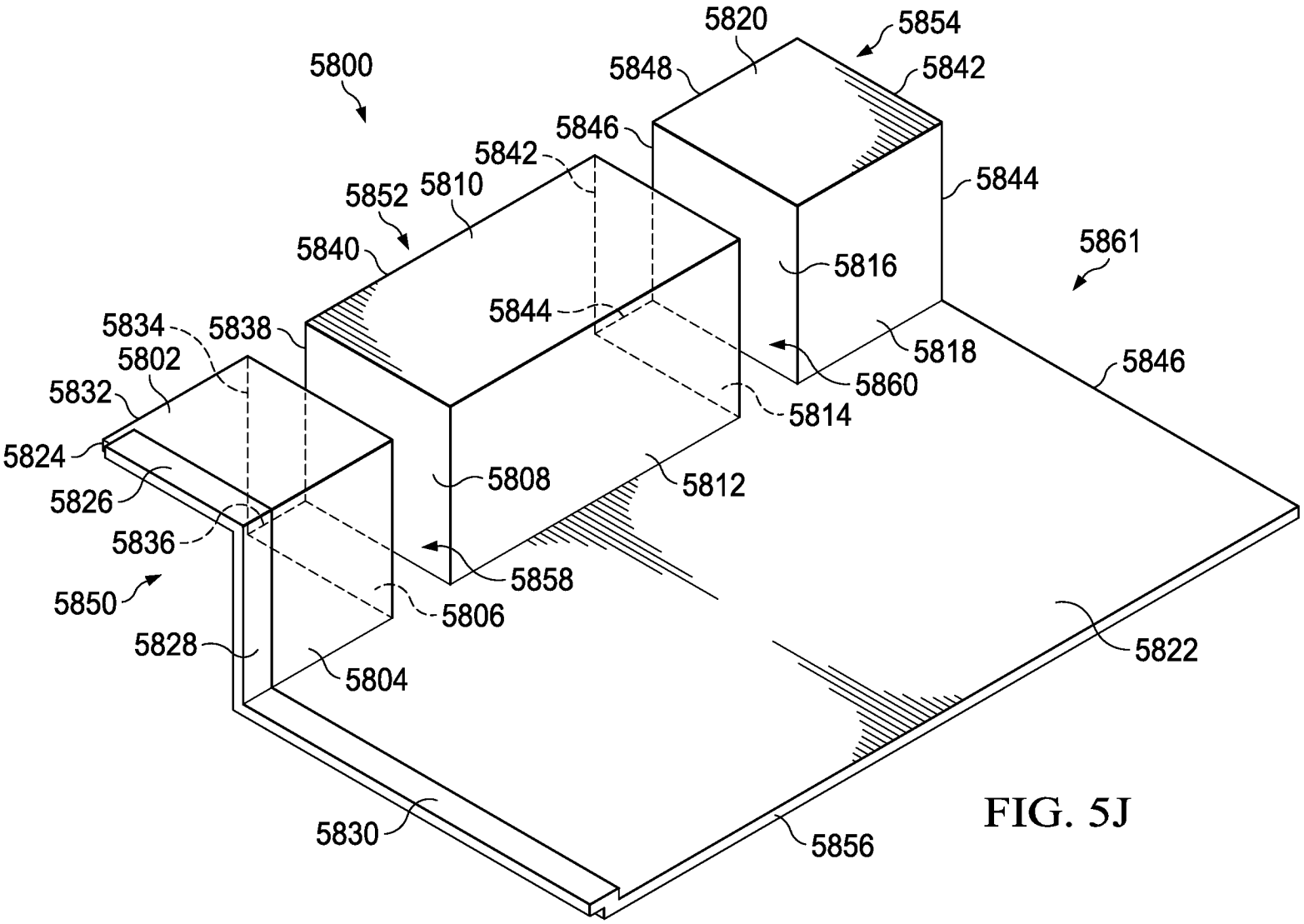
FIG. 5J is an isometric view of a formwork segment.

Referring to FIG. 5J, side profile 5800 is comprised of horizontal lower panel 5822, corner projection 5850, center projection 5852, and corner projection 5854. Horizontal lower panel 5822 includes expandable edge 5856 to interface with additional modular profiles. Horizontal lower panel 5822 is connected to corner projection 5850, center projection 5852, and corner projection 5854. Corner projection 5850, center projection 5852, and corner projection 5854 form cross beam channel 5858 and cross beam channel 5860, as will be further described.

Corner projection 5850 is comprised of vertical interior panel 5804, vertical panel 5806, and horizontal upper panel 5802. Vertical interior panel 5804 is connected to horizontal lower panel 5822, vertical panel 5806, and horizontal upper panel 5802. Vertical panel 5806 is further connected to horizontal lower panel 5822 and horizontal upper panel 5802. Vertical interior panel 5804 is perpendicular to vertical panel 5806.

Center projection 5852 is comprised of vertical panel 5808 and vertical panel 5814, vertical interior panel 5812, and horizontal upper panel 5810. Vertical panel 5808 is connected to horizontal lower panel 5822, vertical interior panel 5812, and horizontal upper panel 5810. Vertical interior panel 5812 is further connected to horizontal lower panel 5822, vertical panel 5814, and horizontal upper panel 5810. Vertical panel 5814 is further connected to horizontal lower panel 5822 and horizontal upper panel 5810. Vertical interior panel 5812 is perpendicular to vertical panels 5808 and 5814.

Corner projection 5854 is comprised of vertical interior panel 5818, vertical panel 5816, and horizontal upper panel 5820. Vertical interior panel 5818 is connected to horizontal lower panel 5822, vertical panel 5816, and horizontal upper panel 5820. Vertical panel 5816 is further connected to horizontal lower panel 5822 and horizontal upper panel 5820. Vertical interior panel 5818 is perpendicular to vertical panel 5816.

Cross beam channel 5858 is formed between vertical panel 5806 of corner projection 5850 and vertical panel 5808 of center projection 5852. Cross beam channel 5860 is formed between vertical panel 5816 of corner projection 5854 and vertical panel 5814 of center projection 5852.

The horizontal upper panels are generally coplanar and parallel to the horizontal lower panel. The vertical panels are connected to the horizontal panels at generally perpendicular angles.

Vertical interior panel 5804, vertical interior panel 5812, vertical interior panel 5818, and horizontal lower panel 5822 form side beam channel 5861. Side beam channel 5861 is adjacent corner beam channels 5728 and 5928. Side beam channel 5861 is generally perpendicular with cross beam channels 5858 and 5860. Side beam channel 5861 is generally parallel with side beam channel 5269.

Horizontal connection flange 5830 is connected to horizontal lower panel 5822. Horizontal connection flange 5830 is further connected to vertical connection flange 5828. Vertical connection flange 5828 is further connected to vertical interior panel 5804 and horizontal connection flange 5826. Horizontal connection flange 5826 is further connected to horizontal upper panel 5820. Horizontal connection flange 5826 accommodates notch 5824.

Notch 5824 is adapted to accommodate horizontal connection flange 5524 of center profile 5500. Receiving edges 5832, 5834, 5836, 5838, 5840, 5842, 5844, 5846, and 5848 are adapted to interface with connection flanges 5524, 5526, 5528, 5530, 5532, 5534, 5536, 5538, and 5540, as previously described. Notch 5824 and receiving edges 5832, 5834, 5836, 5838, 5840, 5842, 5844, 5846, and 5848 are similarly adapted to interface with notch 5217 and connection flanges 5238, 5240, 5242, 5244, 5246, 5248, 5250, 5252, and 5254 of side profile 5200, thereby decreasing the longitudinal dimensions of the system.

Connection flanges 5914, 5916, and 5918, and notch 5912 are adapted to interface with receiving edges 5842, 5844, and 5846, as will be further described.

Connection flanges 5826, 5828, and 5830 are adapted to interface with receiving edges 5714, 5716, and 5720, respectively. Connection flanges 5826, 5828, and 5830 are further adapted to interface with receiving edges 5842, 5844, and 5846, respectively, thereby permitting engagement of identical side profile 5800 with each other to increase the latitudinal dimensions of the system.

Figure 5K:
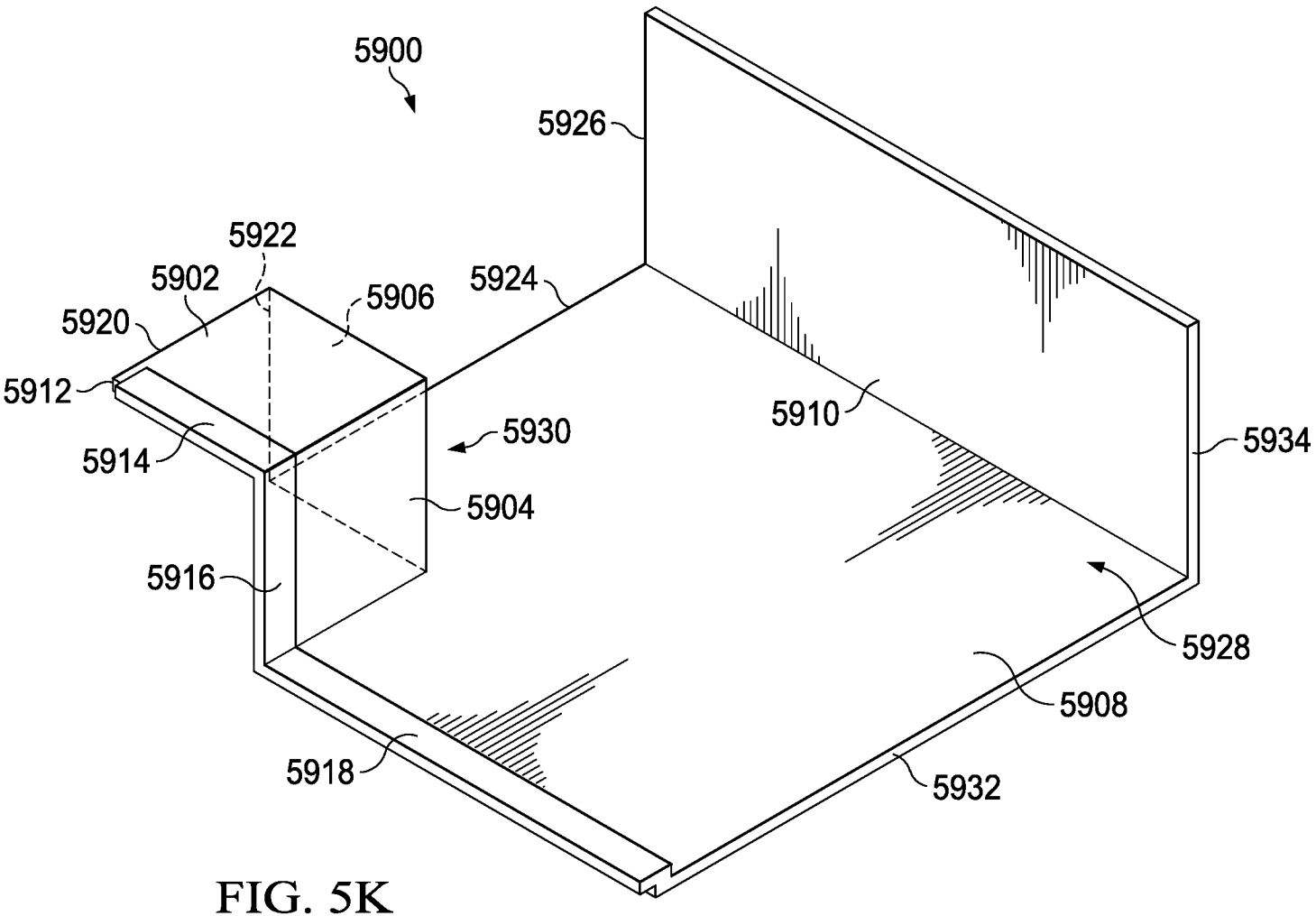
FIG. 5K is an isometric view of a formwork segment.

Referring to FIG. 5K, corner profile 5900 is comprised of side panel 5910, horizontal lower panel 5908 and corner projection 5930. Side panel 5910 and horizontal lower panel 5908 include extendable edge 5934 and extendable edge 5932, respectively. Corner projection 5930 is comprised of horizontal upper panel 5902, vertical panel 5904, and vertical interior panel 5906.

Side panel 5910 is connected to horizontal lower panel 5908. Horizontal lower panel 5908 is further connected to vertical panel 5904 and vertical interior panel 5906. Vertical interior panel 5906 is connected to horizontal upper panel 5902 and vertical panel 5904. Vertical panel 5904 is further connected to horizontal lower panel 5908. Vertical interior panel 5906 is parallel to side panel 5910 and perpendicular to vertical panel 5904. The horizontal panels are parallel. The vertical panels are generally perpendicular to the horizontal panels.

Corner projection 5930, horizontal lower panel 5908, and side panel 5910 form corner beam channel 5928. Corner beam channel 5928 is adjacent side beam channel 5861 and side beam channel 5622. Corner beam channel 5928 is diametrically opposed to corner beam channel 5125.

Horizontal connection flange 5918 is connected to horizontal lower panel 5908 and vertical connection flange 5916. Vertical connection flange 5916 is connected to vertical panel 5904 and horizontal connection flange 5914. Horizontal connection flange 5914 is connected to horizontal upper panel 5902. Horizontal connection flange 5914 accommodates notch 5912.

Notch 5912 and receiving edge 5920 are adapted to accommodate horizontal connection flange 5612 of side profile 5600. Receiving edges 5920, 5922, 5924, and 5926 are adapted to interface with connection flanges 5614, 5616, and 5618, respectively. Notch 5912 and receiving edges 5920, 5922, 5924, and 5926, are similarly adapted to interface with connection flanges 5320, 5322, 5324, and 5326 of corner profile 5300, thereby decreasing the longitudinal dimensions of the system.

Notch 5912, horizontal connection flange 5914, vertical connection flange 5916, and horizontal connection flange 5918 are adapted to interface with receiving edge 5842, receiving edge 5844, and receiving edge 5846 of side profile 5800, respectively.

Figure 5L:
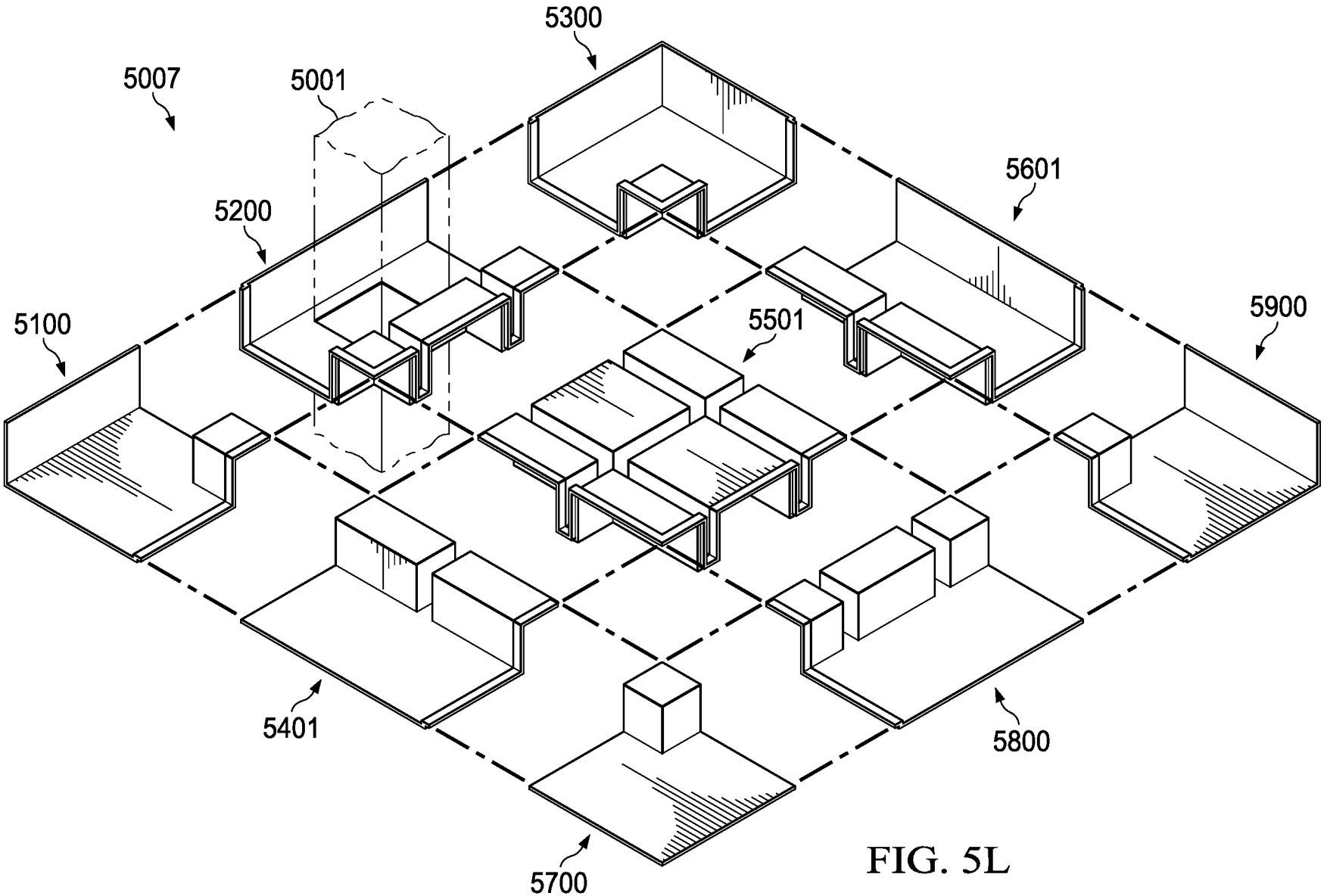
FIG. 5L is cross-sectional side view of a structure utilizing an assembled formwork structure for concrete reinforcement.

Referring then to FIG. 5L, an alternate embodiment of floor formwork 5000 will be described.

Floor formwork 5007 is comprised of interfacing profiles 5100, 5200, 5300, 5401, 5501, 5601, 5700, 5800 and 5900. Floor formwork 5007 forms six (6) projections with three (3) cross beam channels surrounded by side beam channels and corner beam channels, as will be further described.

Corner profile 5100 interfaces with side profiles 5200, as previously described and side profile 5401. Side profile 5200 interfaces with corner profiles 5100 and 5300, and column 5001, as previously described, and center profile 5501. Corner profile 5300 interfaces with side profile 5200, as previously described, and side profile 5601. Side profile 5401 interfaces with corner profiles 5100 and 5700 and center profile 5501, as will be further described. Center profile 5501 interfaces with side profiles 5200, 5401, 5601 and 5800, as will be further described. Side profile 5601 interfaces with corner profiles 5300 and 5900, as previously described, and center profile 5501. Corner profile 5700 interfaces with side profile 5800, as previously described, and side profile 5401. Side profile 5800 interfaces with corner profile 5700 and corner profile 5900, as previously described, and center profile 5501. Corner profile 5900 interfaces with side profile 5800, as previously described, and side profile 5601.

Corner profiles 5100, 5700 and 5900, and side profiles 5401 and 5800 include extendable edges to expand the floor formwork, as previously described. Corner profiles 5100, 5300, 5900, and 5700 form corner beam channels, as previously described. Side profiles 5200, 5401, 5601, and 5800 form side beam channels, as previously described. Side profiles 5200, 5401, 5601, and 5800, and center profile 5501 form the cross beam channels, as will be further described.

Figure 5M:
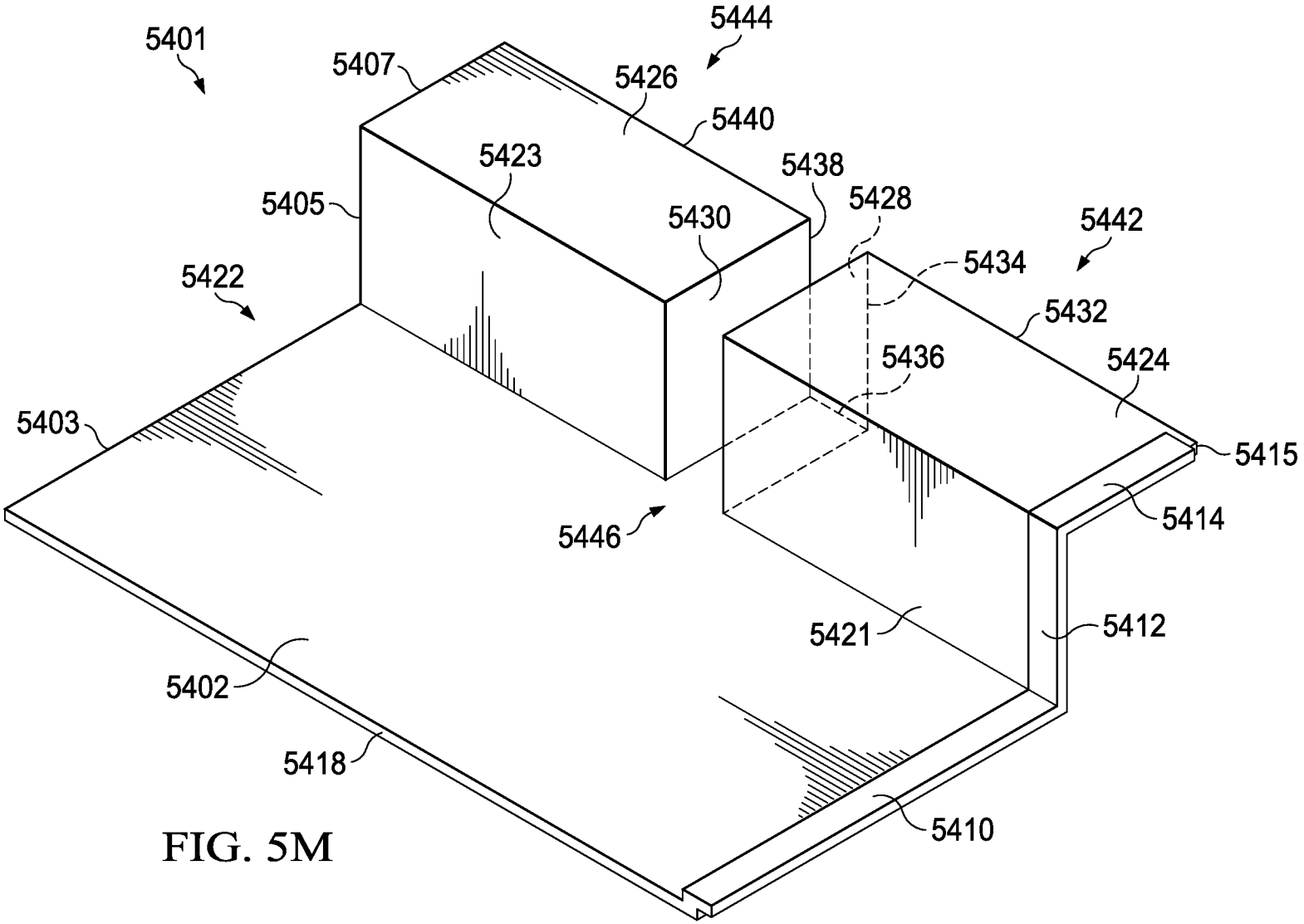
FIG. 5M is an isometric view of a formwork segment.

Referring to FIG. 5M, side profile 5401 is comprised of corner projection 5442, corner projection 5444, and horizontal lower panel 5402. Horizontal lower panel includes extendable edge 5418 and is connected to corner projections 5442, and 5444.

Corner projection 5442 is comprised of vertical interior panel 5421, vertical panel 5428 and horizontal upper panel 5424. Vertical interior panel 5421 connects with vertical panel 5428, horizontal lower panel 5402 and horizontal upper panel 5424. Vertical panel 5428 is further connected to horizontal lower panel 5402 and horizontal upper panel 5424.

Corner projection 5444 is comprised of vertical interior panel 5423, vertical panel 5430 and horizontal upper panel 5426. Vertical interior panel 5423 connects with vertical panel 5430, horizontal lower panel 5402 and horizontal upper panel 5426. Vertical panel 5430 is further connected to horizontal lower panel 5402 and horizontal upper panel 5426.

The horizontal upper panel are coplanar and generally parallel with the horizontal lower panel. The vertical panels are generally parallel and perpendicular to the horizontal panels. The vertical interior panels are generally perpendicular to the vertical panels and the horizontal panels.

Cross beam channel 5446 is formed between vertical panel 5428 of corner projection 5442, and vertical panel 5430 of corner projection 5444. Vertical interior panels 5421 and 5423, and horizontal lower panel 5402 form side beam channel 5422, as previously described.

Horizontal connection flange 5410 is connected to horizontal lower panel 5402 and vertical connection flange 5412. Vertical connection flange 5412 is connected to vertical interior panel 5421 and horizontal connection flange 5414. Horizontal connection flange 5414 is connected to horizontal upper panel 5424. Horizontal connection flange 5414 accommodates notch 5415.

Notch 5415 is adapted to accommodate horizontal connection flange 5529 of center profile 5501. Connection flanges 5521, 5523, 5525, 5527, and 5529 are adapted to interface with receiving edges 5440, 5438, 5436, 5434, and 5432, respectively. Notch 5415 and receiving edges 5440, 5438, 5436, 5434, and 5432 are similarly adapted to interface with connection flanges 5642, 5640, 5638, 5636, and 5634 of side profile 5601, thereby increasing the latitudinal dimensions of the system.

Connection flanges 5112, 5114, and 5116, and notch 5117 are adapted to interface with receiving edges 5403, 5405 and 5407, as previously described.

Connection flanges 5410, 5412, and 5414 are adapted to interface with receiving edges 5704, 5708, and 5710 of corner profile 5700, as previously described. Connection flanges 5410, 5412, and 5414 are further adapted to interface with receiving edges 5403, 5405 and 5407, thereby permitting engagement of identical side profiles 5401 with each other to increase the longitudinal dimension of the formwork system, as previously described.

Figure 5N:
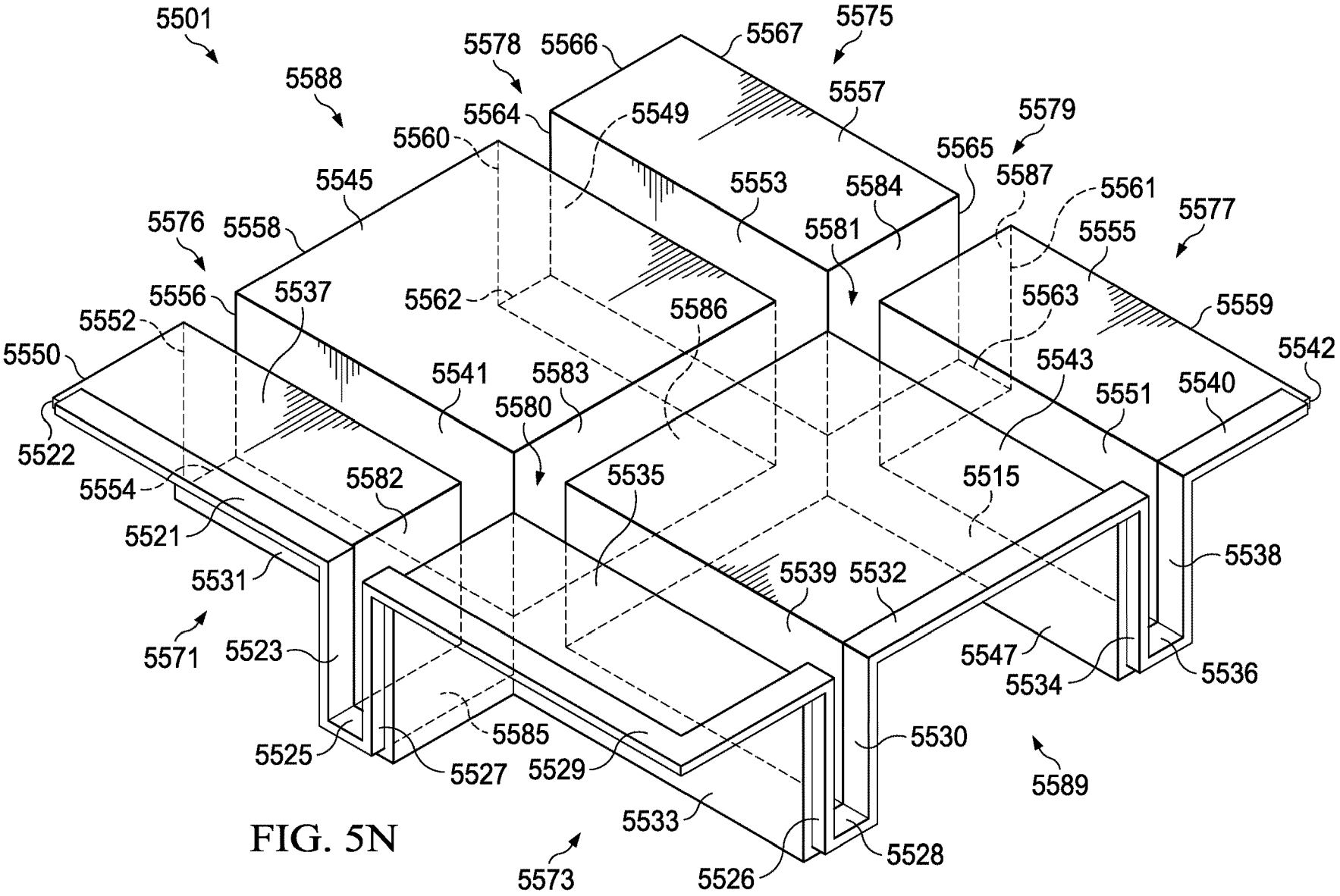
FIG. 5N is an isometric view of a formwork segment.

Referring then to FIG. 5N, center profile 5501 is comprised of corner projection 5571, corner projection 5573, center projection 5588, center projection 5589, corner projection 5575, corner projection 5577 and horizontal lower panel 5515. Horizontal lower panel 5515 is connected to corner projection 5571, corner projection 5573, center projection 5588, center projection 5589, corner projection 5575, and corner projection 5577. Corner projection 5571, corner projection 5573, center projection 5588, center projection 5589, corner projection 5575, corner projection 5577 and horizontal lower panel 5515 form longitudinal cross beam channel 5576 and longitudinal cross beam channel 5578, and latitudinal cross beam channel 5579, as will be further described.

Corner projection 5571 is comprised of horizontal upper panel 5537, vertical interior panel 5531 and vertical panel 5582. Vertical panel 5582 is connected to horizontal upper panel 5537, horizontal lower panel 5515, and vertical interior panel 5531. Vertical interior panel 5531 is further connected to horizontal upper panel 5537 and horizontal lower panel 5515.

Corner projection 5573 is comprised of horizontal upper panel 5535, vertical interior panel 5533 and vertical panel 5585. Vertical panel 5585 is connected to horizontal upper panel 5535, horizontal lower panel 5515, and vertical interior panel 5533. Vertical interior panel 5533 is further connected to horizontal upper panel 5535 and horizontal lower panel 5515. Vertical interior panel 5533 is coplanar with vertical interior panel 5531.

Center projection 5588 is comprised of horizontal upper panel 5545, vertical interior panel 5541, vertical panel 5583, and vertical interior panel 5549. Vertical interior panel 5541 is connected to horizontal upper panel 5545, horizontal lower panel 5515, and vertical panel 5583. Vertical panel 5583 is further connected to horizontal upper panel 5545, horizontal lower panel 5515, and vertical interior panel 5549. Vertical interior panel 5549 is further connected to horizontal upper panel 5545, and horizontal lower panel 5515.

Center projection 5589 is comprised of horizontal upper panel 5543, vertical interior panel 5539, vertical panel 5586, and vertical interior panel 5547. Vertical interior panel 5539 is connected to horizontal upper panel 5543, horizontal lower panel 5515, and vertical panel 5586. Vertical panel 5586 is further connected to horizontal upper panel 5543, horizontal lower panel 5515, and vertical interior panel 5547. Vertical interior panel 5547 is further connected to horizontal upper panel 5543, and horizontal lower panel 5515. Vertical interior panels 5539 and 5541 are coplanar. Vertical interior panels 5547 and 5549 are coplanar.

Corner projection 5575 is comprised of horizontal upper panel 5557, vertical interior panel 5553 and vertical panel 5584. Vertical panel 5584 is connected to horizontal upper panel 5557, horizontal lower panel 5515, and vertical interior panel 5553. Vertical interior panel 5553 is further connected to horizontal upper panel 5557 and horizontal lower panel 5515.

Corner projection 5577 is comprised of horizontal upper panel 5555, vertical interior panel 5551 and vertical panel 5587. Vertical panel 5587 is connected to horizontal upper panel 5555, horizontal lower panel 5515, and vertical interior panel 5551. Vertical interior panel 5551 is further connected to horizontal upper panel 5555 and horizontal lower panel 5515. Vertical interior panel 5551 is coplanar with vertical interior panel 5553.

Vertical panels 5582, 5583, and 5584 are coplanar. Vertical panels 5585, 5586, and 5587 are coplanar. The horizontal upper panels are generally coplanar. The horizontal upper panels are generally parallel to the horizontal lower panel. The vertical interior panels are generally parallel. The vertical panels are generally parallel. The vertical interior panels are generally perpendicular to the vertical panels. The vertical interior panels and vertical panels are generally perpendicular to the horizontal upper panels and the horizontal lower panels.

Longitudinal cross beam channel 5576 is formed by vertical interior panels 5531 and 5533 of corner projections 5571 and 5573 and vertical interior panels 5541 and 5539 of center projections 5588 and 5589. Longitudinal cross beam channel 5578 is formed by vertical interior panels 5553 and 5551 of corner projections 5575 and 5577 and vertical interior panels 5549 and 5547 of center projections 5588 and 5589. Latitudinal cross beam channel 5579 is formed between vertical panels 5582,5583, and 5584, and vertical panels 5585, 5586, and 5587. Latitudinal cross beam channel 5579 intersects longitudinal cross beam channel 5576 at intersection 5580. Latitudinal cross beam channel 5579 intersects longitudinal cross beam channel 5578 at intersection 5581. The latitudinal cross beam channel is generally perpendicular with the longitudinal cross beam channels. The longitudinal cross beam channels are generally parallel.

Horizontal connection flange 5521 is connected to horizontal upper panel 5537 and vertical connection flange 5523. Vertical connection flange 5523 is connected to vertical panel 5582 and horizontal connection flange 5525. Horizontal connection flange 5525 is connected to horizontal lower panel 5515 and vertical connection flange 5527. Vertical connection flange 5527 is connected to vertical panel 5585 and horizontal connection flange 5529. Horizontal connection flange 5529 is connected to horizontal upper panel 5535 and vertical connection flange 5526. Vertical connection flange 5526 is connected to vertical interior panel 5533 and horizontal connection flange 5528. Horizontal connection flange 5528 is connected to horizontal lower panel 5515 and vertical connection flange 5530. Vertical connection flange 5530 is connected to vertical interior panel 5539 and horizontal connection flange 5532. Horizontal connection flange 5532 is connected to horizontal upper panel 5543 and vertical connection flange 5534. Vertical connection flange 5534 is connected to vertical interior panel 5547 and horizontal connection flange 5536. Horizontal connection flange 5536 is connected to horizontal lower panel 5515 and vertical connection flange 5538. Vertical connection flange 5538 is connected to vertical interior panel 5551 and horizontal connection flange 5540.

Horizontal connection flange 5540 is adapted to accommodate notch 5542. Connection flanges 5529, 5526, 5528, 5530, 5532, 5534, 5536, 5538, and 5540 and notch 5542 are adapted to interface with receiving edges 5832, 5834, 5836, 5838, 5840, 5842, 5844, 5846, and 5848, and notch 5824, as previously described. Notch 5542 and receiving edges 5567, 5565, 5563, 5561, and 5559 are adapted to interface with connection flanges 5642, 5640, 5638, 5636, and 5634 of side profile 5601.

Horizontal connection flange 5521 is adapted to accommodate notch 5522. Receiving edges 5550, 5552, 5554, 5556, 5558, 5560, 5562, 5564, and 5566, and notch 5522 are adapted to interface with horizontal connection flanges 5238, 5240, 5242, 5244, 5246, 5248, 5250, 5252, and 5254, and notch 5217. Receiving edges 5550, 5552, 5554, 5556, 5558, 5560, 5562, 5564, and 5566, and notch 5522 are further adapted to interface with connection flanges 5529, 5526, 5528, 5530, 5532, 5534, 5536, 5538, and 5540 and notch 5542, thereby permitting engagement of identical center profiles 5501 with each other to extend the longitudinal reach of the formwork system.

Connection flanges 5521, 5523, 5525, 5527, and 5529, and notch 5522 are adapted to interface with receiving edges 5440, 5438, 5436, 5434, and 5432, and notch 5415 of side profile 5401. Connection flanges 5521, 5523, 5525, 5527, and 5529 are further adapted to interface with receiving edges 5567, 5565, 5563, 5561, and 5559, and notch 5542, thereby permitting engagement of identical center profiles 5501 with each other to extend the latitudinal reach of the formwork system.

Figure 5O:
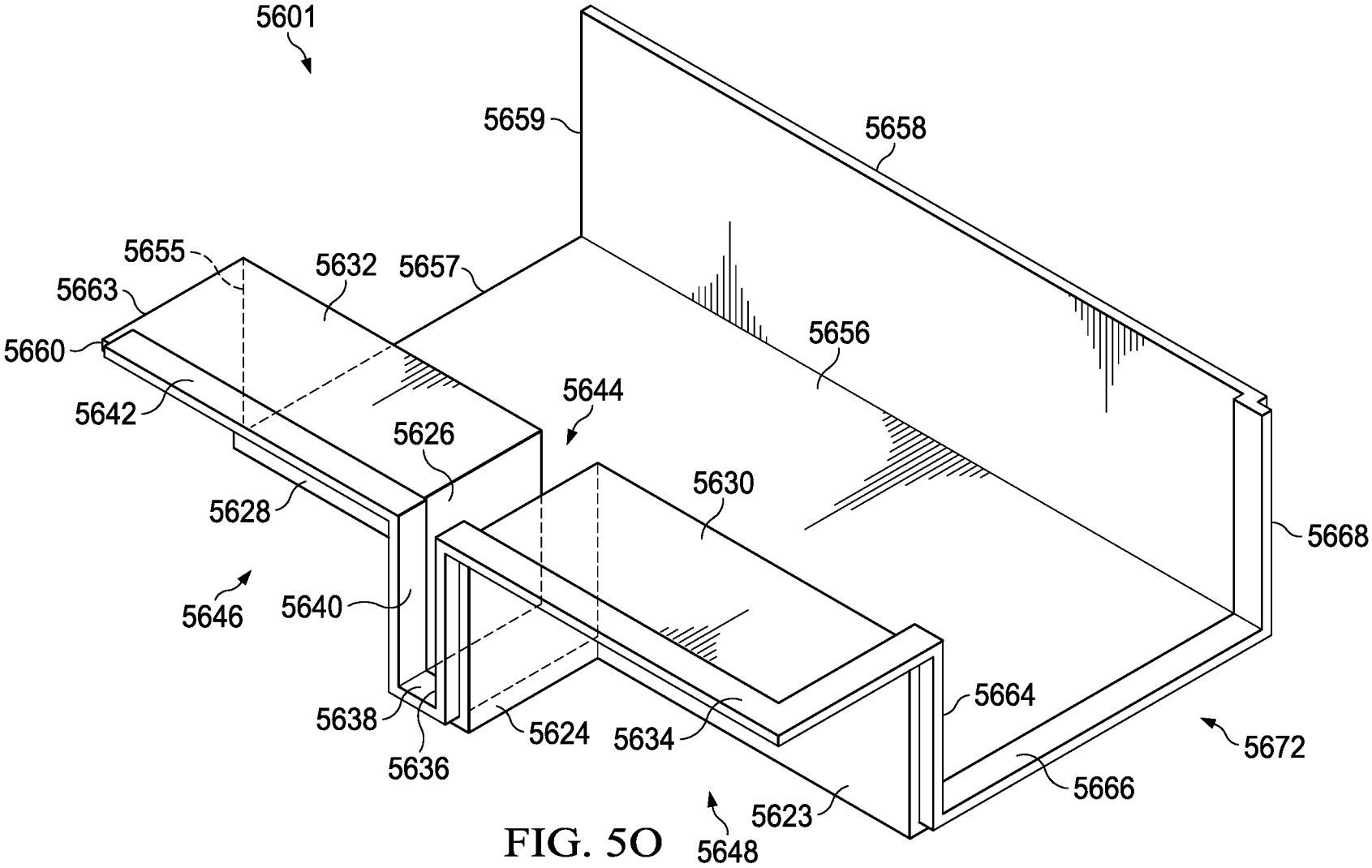
FIG. 5O is an isometric view of a formwork segment.

Referring then to FIG. 5O, side profile 5601 is comprised of side panel 5658 and horizontal lower panel 5656. Horizontal lower panel 5656 is connected to side panel 5658 at a perpendicular angle. Horizontal lower panel 5656 is further connected to corner projection 5646 and corner projection 5648.

Corner projection 5646 is comprised of horizontal upper panel 5632, vertical interior panel 5628, and vertical panel 5626. Horizontal upper panel 5632 is connected to vertical interior panel 5628 and vertical panel 5626. Vertical panel 5626 is further connected to horizontal lower panel 5656 and vertical interior panel 5628. Vertical interior panel 5628 is further connected to horizontal lower panel 5656.

Corner projection 5648 is comprised of horizontal upper panel 5630, vertical interior panel 5623, and vertical panel 5624. Horizontal upper panel 5630 is connected to vertical interior panel 5623 and vertical panel 5624. Vertical panel 5624 is further connected to horizontal lower panel 5656 and vertical interior panel 5623. Vertical interior panel 5623 is further connected to horizontal lower panel 5656.

The horizontal upper panels are coplanar and generally parallel to the horizontal lower panel. The vertical panels are generally parallel. The vertical interior panels are coplanar and generally parallel with the side panel. The vertical panels, vertical interior panels, and side panel are generally perpendicular to the horizontal panels.

Side panel 5658, horizontal lower panel 5656, vertical interior panel 5623 of corner projection 5648, and vertical interior panel 5628 of corner projection 5646 form side beam channel 5672. Vertical panel 5626 of corner projection 5646 and vertical panel 5624 of corner projection 5648 form cross beam channel 5644. Cross beam channel 5644 is generally perpendicular with side beam channel 5672.

Vertical connection flange 5668 is connected to side panel 5658 and horizontal connection flange 5666. Horizontal connection flange 5666 is connected to horizontal lower panel 5656 and vertical connection flange 5664. Vertical connection flange 5664 is connected to vertical interior panel 5623 and horizontal connection flange 5634. Horizontal connection flange 5634 is connected to horizontal upper panel 5630 and vertical connection flange 5636. Vertical connection flange 5636 is connected to vertical panel 5624 and horizontal connection flange 5638. Horizontal connection flange 5638 is connected to horizontal lower panel 5656 and vertical connection flange 5640. Vertical connection flange 5640 is connected to vertical panel 5626 and horizontal connection flange 5642. Horizontal connection flange 5642 is connected to horizontal upper panel 5632 and is adapted to accommodate notch 5660.

Connection flanges 5634, 5664, 5666, and 5668 are adapted to interface with receiving edges 5920, 5922, 5924, and 5926, and notch 5912, as previously described. Connection flanges 5634, 5664, 5666, and 5668 are further adapted to interface with receiving edges 5603, 5605, 5607, and 5609, and notch 5610, thereby permitting engagement of identical side profiles 5601 to extend the longitudinal reach of the formwork system.

Connection flanges 5642, 5640, 5638, 5636, and 5634 are adapted to interface with receiving edges 5567, 5565, 5563, 5561, and 5559, and notch 5542 of center profile 5501. Connection flanges 5642, 5640, 5638, 5636, and 5634 are adapted to interface with receiving edges 5440, 5438, 5436, 5434, and 5432, and notch 5415 of side profile 5401, thereby decreasing the latitudinal dimensions of the system.

Receiving edges 5653, 5655, 5657, and 5659, and notch 5660 are further adapted to interface with connection flanges 5320, 5322, 5324, and 5326, as previously described.

Figure 5P:
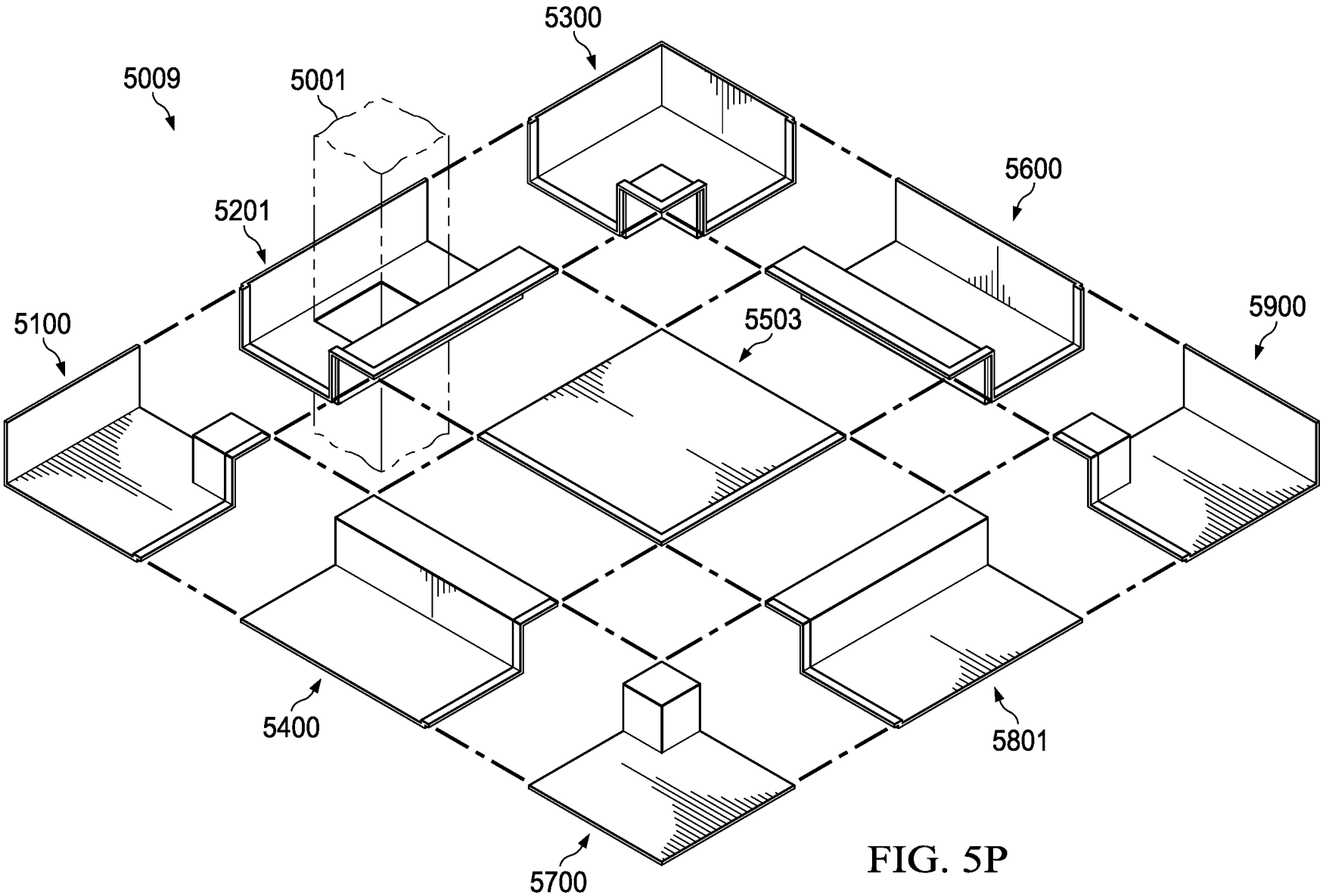
FIG. 5P is cross-sectional side view of a structure utilizing an assembled formwork structure for concrete reinforcement.

Referring then to FIG. 5P, an alternate embodiment of floor formwork 5000 will be described.

Floor formwork 5009 is comprised of interfacing profiles 5100, 5201, 5300, 5400, 5503, 5600, 5700, 5801 and 5900. Floor formwork 5007 forms one (1) projection surrounded by side beam channels and corner beam channels, as will be further described.

Corner profile 5100 interfaces with side profile 5400, as previously described and side profile 5201. Side profile 5201 interfaces with corner profiles 5100 and 5300, column 5001, and center profile 5503. Corner profile 5300 interfaces with side profile 5600, as previously described, and side profile 5201. Side profile 5400 interfaces with corner profiles 5100 and 5700, as previously described, and center profile 5503. Center profile 5503 interfaces with side profiles 5201, 5400, 5600 and 5801, as will be further described. Side profile 5600 interfaces with corner profiles 5300 and 5900, as previously described, and center profile 5503. Corner profile 5700 interfaces with side profile 5400, as previously described, and side profile 5801. Side profile 5801 interfaces with corner profiles 5700 and 5900, and center profile 5503. Corner profile 5900 interfaces with side profile 5600, as previously described, and side profile 5801.

Corner profiles 5100, 5700 and 5900, and side profiles 5400 and 5801 include extendable edges to expand the floor formwork, as previously described. Corner profiles 5100, 5300, 5900, and 5700 form corner beam channels, as previously described. Side profiles 5201, 5600, 5801, and 5400 form side beam channels, as previously described.

Figure 5Q:
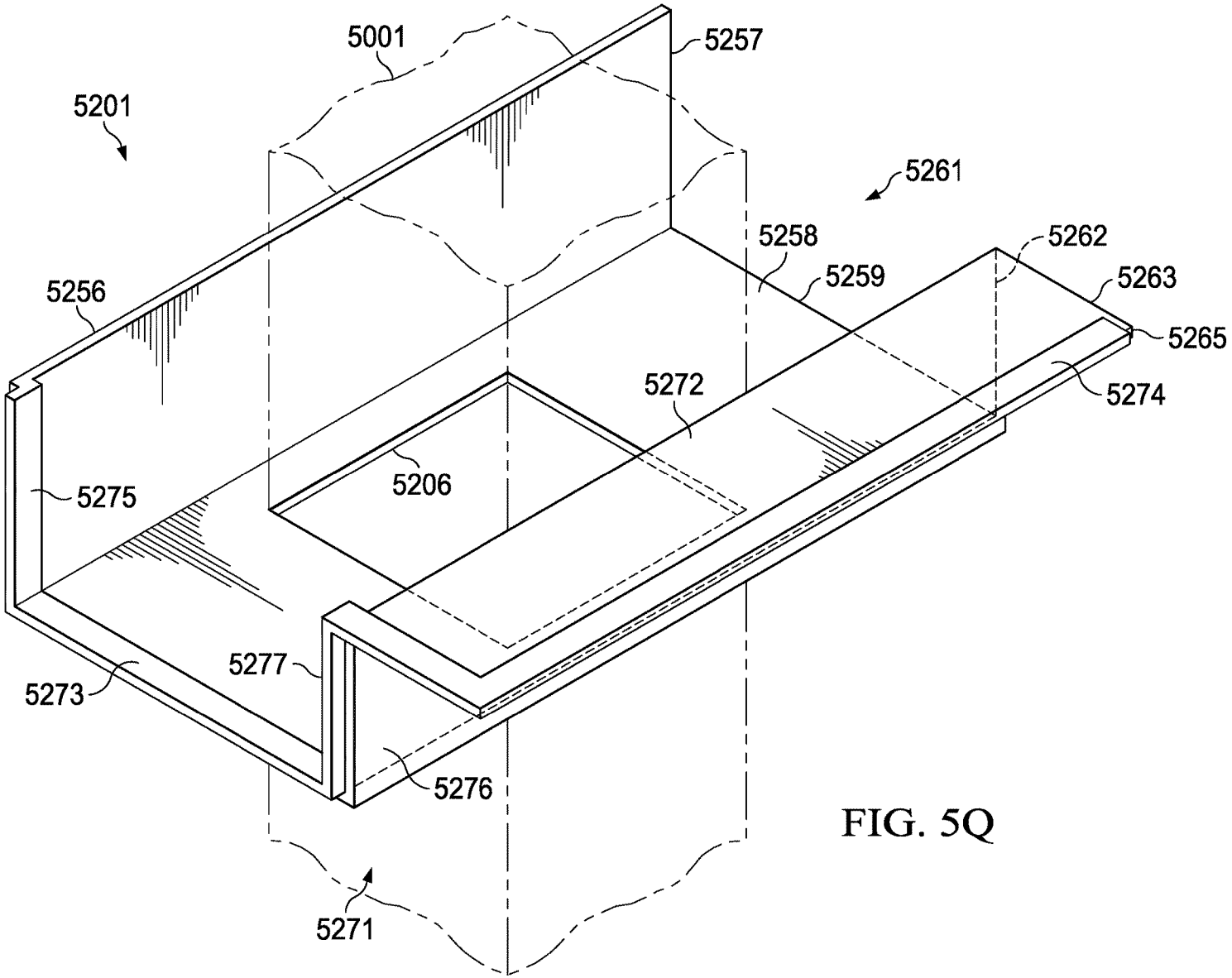
FIG. 5Q is an isometric view of a formwork segment.

Referring to FIG. 5Q, side profile 5201 is comprised of side panel 5256, horizontal lower panel 5258, and side projection 5271. Side panel 5276 is connected to horizontal lower panel 5258. Horizontal lower panel 5258 includes hole 5206 to interface with column 5001, as previously described. Horizontal lower panel 5258 is further connected to side projection 5271.

Side projection 5271 is comprised of vertical panel 5276 and horizontal upper panel 5272. Vertical panel 5276 is connected to horizontal lower panel 5258 and horizontal upper panel 5272. Vertical panel 5276 is parallel to side panel 5256. Horizontal upper panel 5272 is parallel to horizontal lower panel 5258. Side panel 5256 and vertical panel 5276 are perpendicular to the horizontal panels.

Side panel 5256 and vertical panel 5276 form side beam channel 5261.

Vertical connection flange 5275 is connected to side panel 5256. Vertical connection flange 5275 is further connected to horizontal connection flange 5273. Horizontal connection flange 5273 is connected to horizontal lower panel 5258. Horizontal connection flange 5273 is further connected to vertical connection flange 5277. Vertical connection flange 5277 is further connected to vertical panel 5276 and horizontal connection flange 5274. Horizontal connection flange 5274 is connected to horizontal upper panel 5272. Horizontal connection flange 5274 accommodates notch 5265.

Notch 5265 is adapted to accommodate horizontal connection flange 5320, as previously described. Vertical connection flange 5275, horizontal connection flange 5273, vertical connection flange 5277, and horizontal connection flange 5274 are adapted to interface with receiving edge 5103 of side panel 5102, receiving edge 5105 of horizontal lower panel 5104, receiving edge 5109 of vertical panel 5108, and receiving edge 5111 of horizontal upper panel 5110, respectively.

Connection flange 5274 is adapted to interface with receiving edges 5591 of center profile 5503, as will be further described. Horizontal connection flange 5274 is adapted to interface with notch 5598.

Connection flanges 5275, 5273, 5277, and 5274 are further adapted to interface with receiving edges 5257, 5259, 5262, and 5263, and notch 5265, thereby permitting engagement of identical side profiles 5201 with each other to increase the latitudinal dimensions of the system.

Figure 5R:
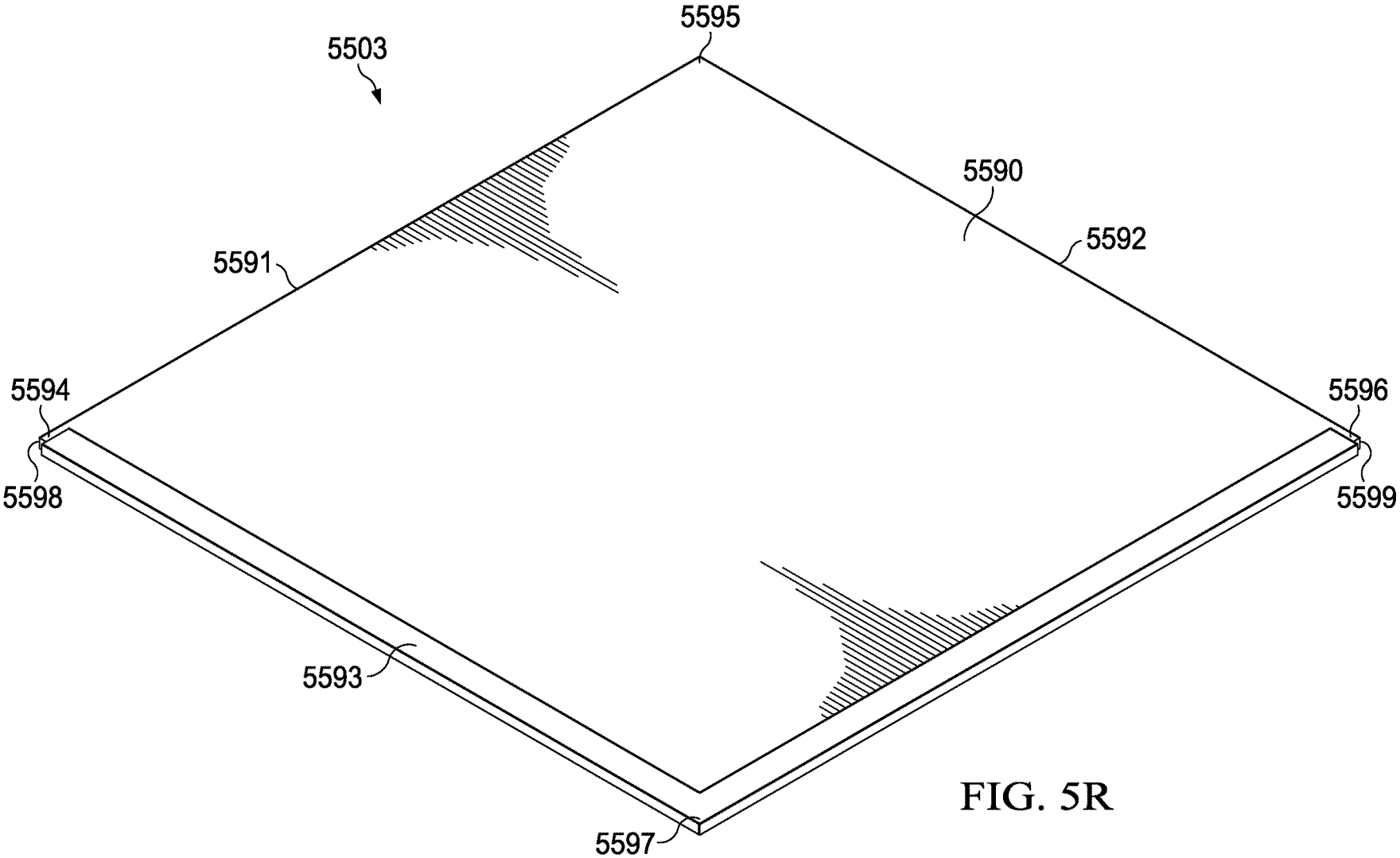
FIG. 5R is an isometric view of a formwork segment.

Referring then to FIG. 5R, center profile 5503 is comprised of roof panel 5590. Roof panel 5590 is generally square in shape having four corners 5594, 5595, 5596, and 5597. Corner 5595 is diametrically opposed to corner 5597. Corner 5594 is diametrically opposed to corner 5596. Roof panel 5590 is coplanar with the horizontal upper panels of the system. Horizontal connection flange 5593 is connected to roof panel 5590.

Horizontal connection flange 5593 is adapted to accommodate notch 5598. Notch 5598 is adjacent corner 5594 and receiving edge 5591. Horizontal connection flange 5593 is further adapted to accommodate notch 5599. Notch 5599 is adjacent corner 5596 and receiving edge 5592.

Connection flange 5593 and notch 5599 are adapted to interface with receiving edge 5868, and notch 5824, as will be further described. Notch 5599 and receiving edge 5592 are adapted to interface with connection flange 5612 of side profile 5600. Connection flange 5593 and notch 5598 are adapted to interface with receiving edge 5408, and notch 5415 of side profile 5400. Notch 5598 and receiving edge 5591 are adapted to interface with connection flange 5274, as previously described.

Receiving edge 5591, and notch 5598 are further adapted to interface with connection flange 5593, and notch 5599, thereby permitting engagement of corner 5597 of identical center profiles 5503 with notch 5598 to extend the longitudinal reach of the formwork system.

Receiving edge 5592, and notch 5599 are further adapted to interface with connection flange 5593, and notch 5598, thereby permitting engagement of corner 5597 of identical center profiles 5503 with notch 5599 to extend the latitudinal reach of the formwork system.

Figure 5S:
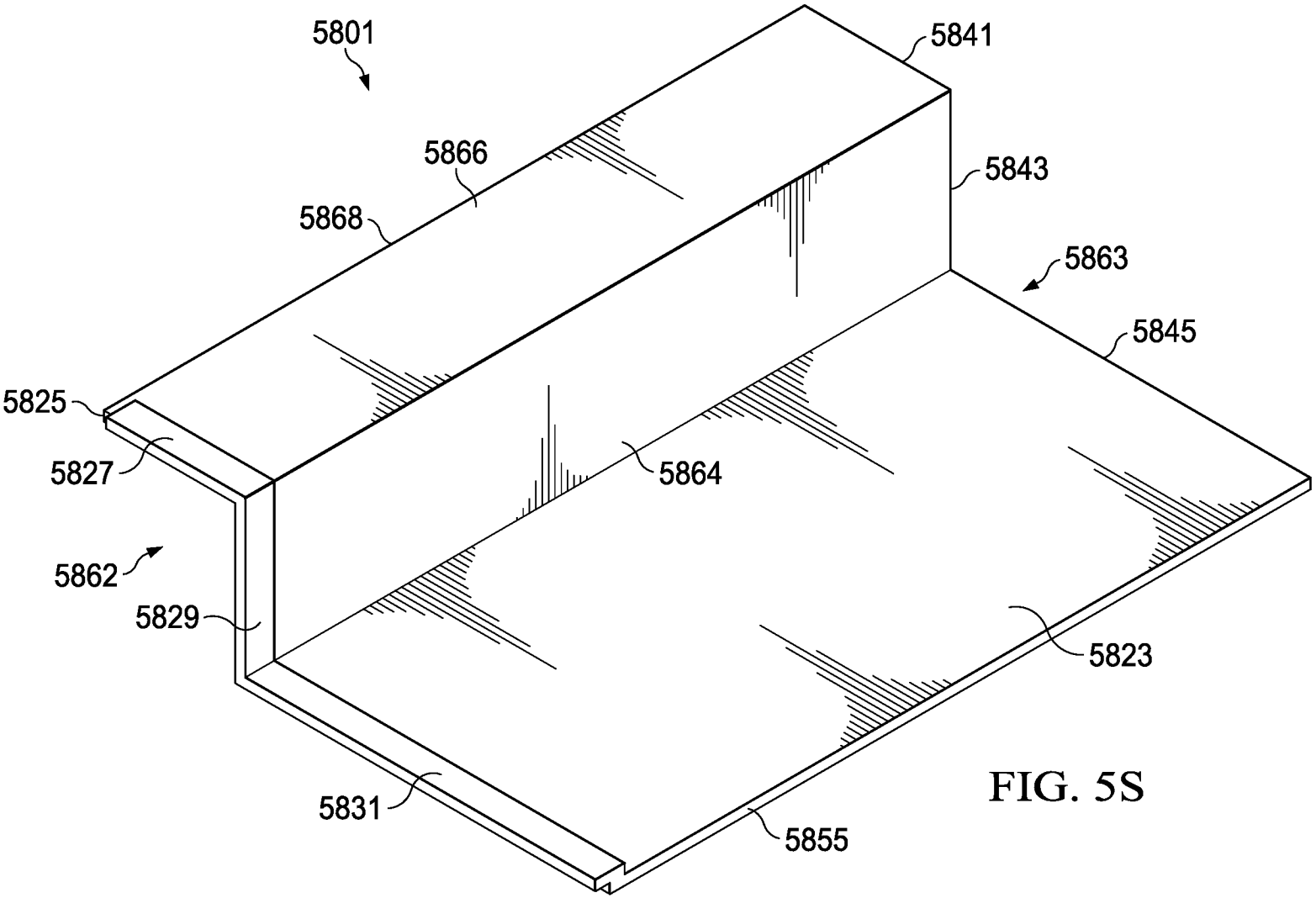
FIG. 5S is an isometric view of a formwork segment.

Referring then to FIG. 5S, side profile 5801 is comprised of horizontal lower panel 5823, and side projection 5862. Horizontal lower panel 5823 includes expandable edge 5855 to interface with additional modular profiles. Horizontal lower panel 5823 is connected to side projection 5862.

Side projection 5862 is comprised of vertical panel 5864 and horizontal upper panel 5866. Vertical panel 5864 is connected to horizontal lower panel 5823 and horizontal upper panel 5866. Vertical panel 5864 is perpendicular to the horizontal panels. The horizontal panels are generally parallel.

Vertical panel 5864 and horizontal lower panel 5823 form side beam channel 5863.

Horizontal connection flange 5831 is connected to horizontal lower panel 5823. Horizontal connection flange 5831 is further connected to vertical connection flange 5829. Vertical connection flange 5829 is further connected to vertical panel 5864 and horizontal connection flange 5827. Horizontal connection flange 5827 is further connected to horizontal upper panel 5866 and accommodates notch 5825.

Notch 5825 is adapted to accommodate horizontal connection flange 5593 of center profile 5503. Receiving edge 5868 is adapted to interface with connection flange 5593, as previously described. Notch 5825 and receiving edge 5868 are similarly adapted to interface with notch 5265 and connection flange 5274 of side profile 5201, thereby decreasing the longitudinal dimensions of the system.

Connection flanges 5914, 5916, and 5918, and notch 5912 are adapted to interface with receiving edges 5842, 5844, and 5846, as previously described.

Connection flanges 5827, 5829, and 5831 are adapted to interface with receiving edges 5714, 5716, and 5720, as previously described. Connection flanges 5827, 5829, and 5831 are further adapted to interface with receiving edges 5841, 5843, and 5845, respectively, thereby permitting engagement of identical side profiles 5801 with each other to increase the latitudinal dimensions of the system.

Figure 5T:
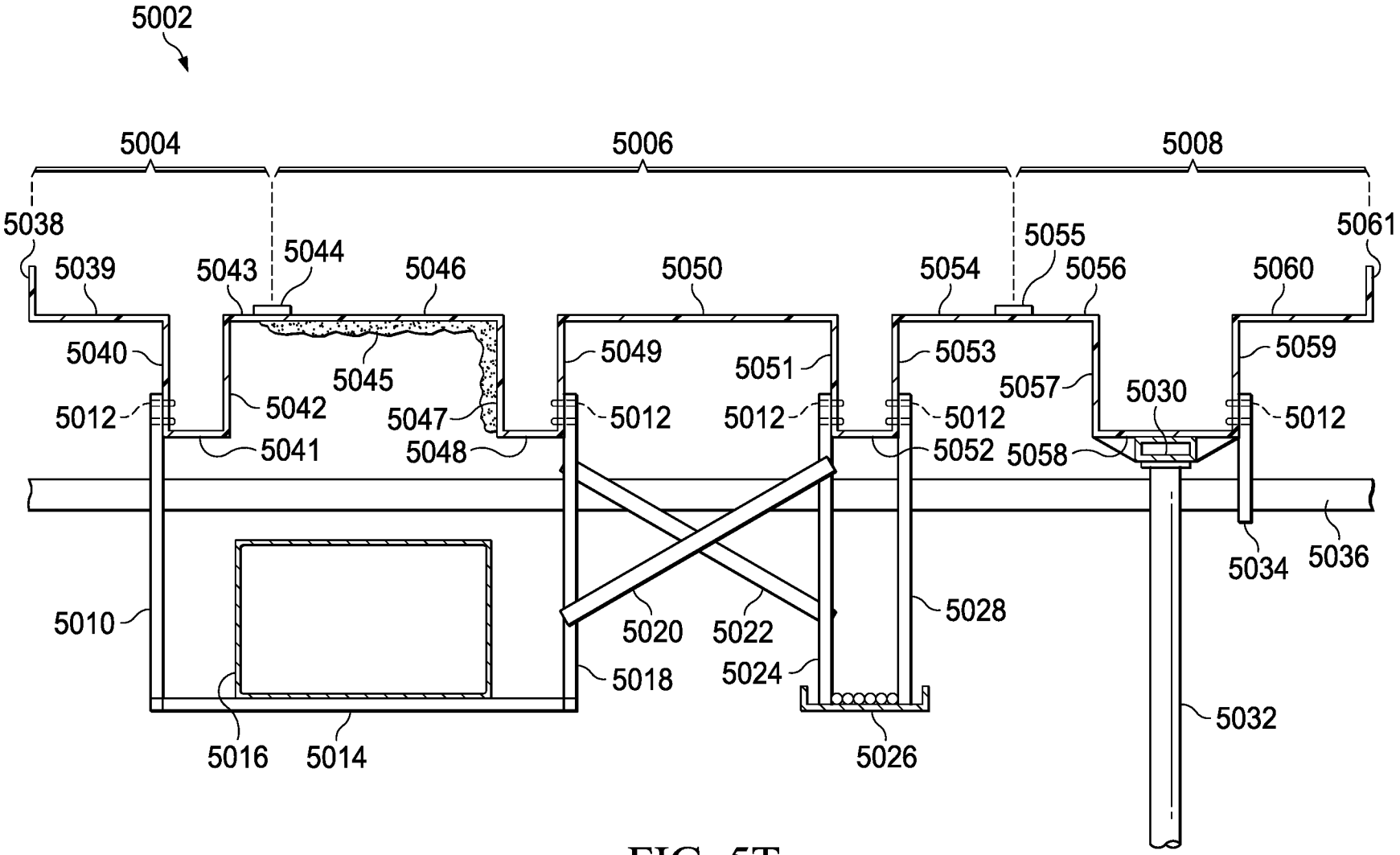
FIG. 5T is a cross sectional view of an assembled formwork structure.

Referring then to FIG. 5T, an alternate embodiment of floor formwork 5000 will be described.

Formwork 5002 includes side profile 5004, center profile 5006, and side profile 5008, interfaced by connection flanges 5044 and 5055, respectively. Formwork 5002 is further comprised of shoring attachment 5030. Shoring attachment 5030 is connected to the exterior of horizontal lower panel 5058. Shore post 5032 is removably attached to shoring attachment 5030. Prior to concrete placement, the formwork is held in position by shore post 5032. Any number of shoring attachments and shore posts may be positioned beneath any horizontal panel of the formwork to provide temporary support for the formwork during concrete placement.

Duct hanger 5010 is attached to vertical panel 5040 with bolts 5012. Duct hanger 5018 is attached to vertical panel 5049 using bolts 5012. Preferably duct hangers 5010 and 5018 are rectangular steel channel stock. In a preferred embodiment, the duct hangers are provided with one or more columns of pre-drilled holes which allow for adjustable mounting.

Duct hangers 5010 and 5018 are connected to duct support member 5014 via bolts 5012. Duct support member 5014 suspends ductwork 5016. Any number of duct hangers and duct support members may be attached to the formwork depending on design considerations.

Cable tray hanger 5024 is attached to vertical panel 5051 via bolts 5012. Cable tray hanger 5028 is attached to vertical panel 5053 with bolts 5012. Cable tray hangers 5024 and 5028 are connected to cable tray 5026. Duct hanger 5018 is further connected to cable tray hanger 5024 via diagonal supports 5020 and 5022. The diagonal supports are preferably right angle channel stock. Any number of cable tray hangers, cable trays, and diagonal supports may be attached to the formwork depending on design considerations.

Pipe hangar 5034 is connected to vertical panel 5059 via bolts 5012. The pipe hangar supports piping 5036. Of course, multiple pipe hangers may be employed.

Optionally, fireproofing layer 5045 is applied to the exterior surfaces of horizontal upper panels 5039, 5043, 5046, 5050, 5054, 5056 and 5060, horizontal lower panels 5041, 5048, 5052, and 5058, and vertical panels 5038, 5040, 5042, 5047, 5049, 5051, 5053, 5057, 5059 and 5061.

Figure 5U:
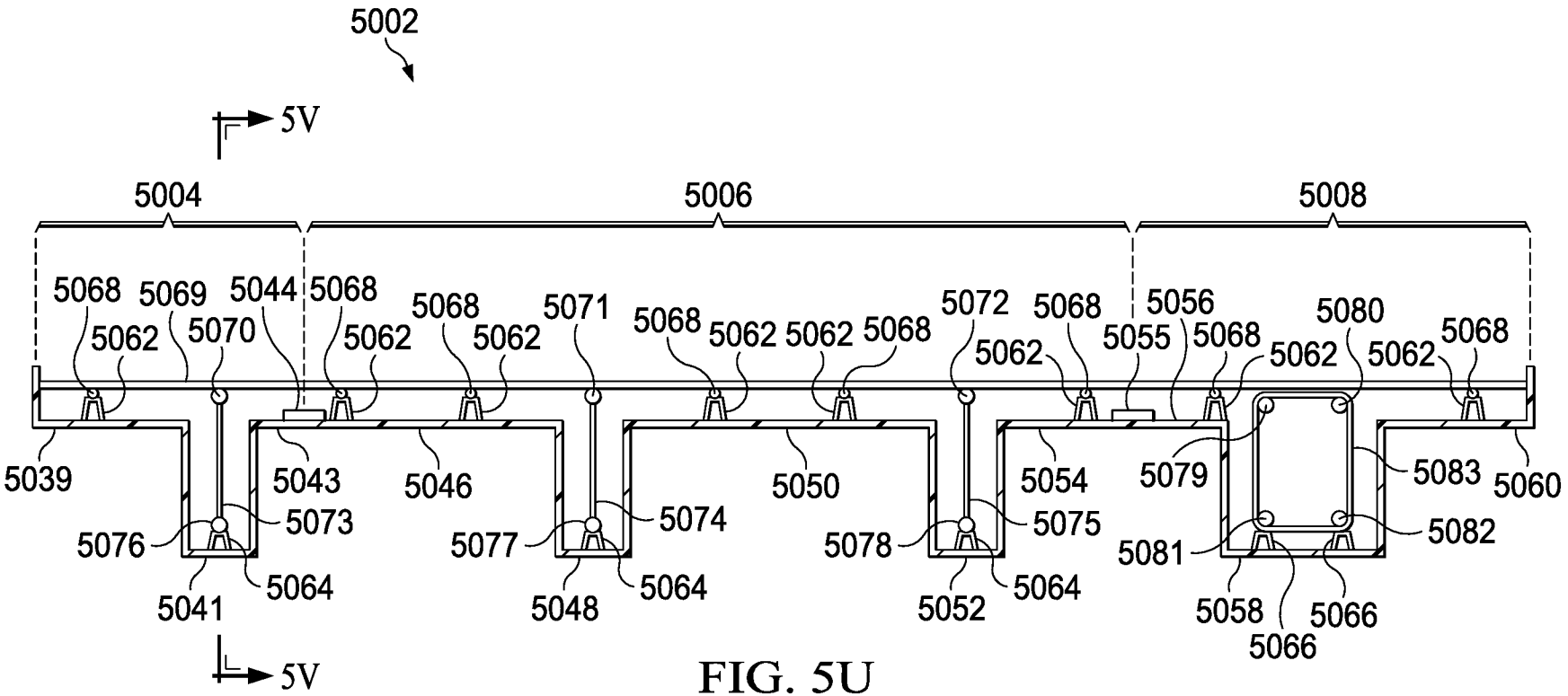
FIG. 5U is a cross sectional view of an assembled formwork structure.
Figure 5V:
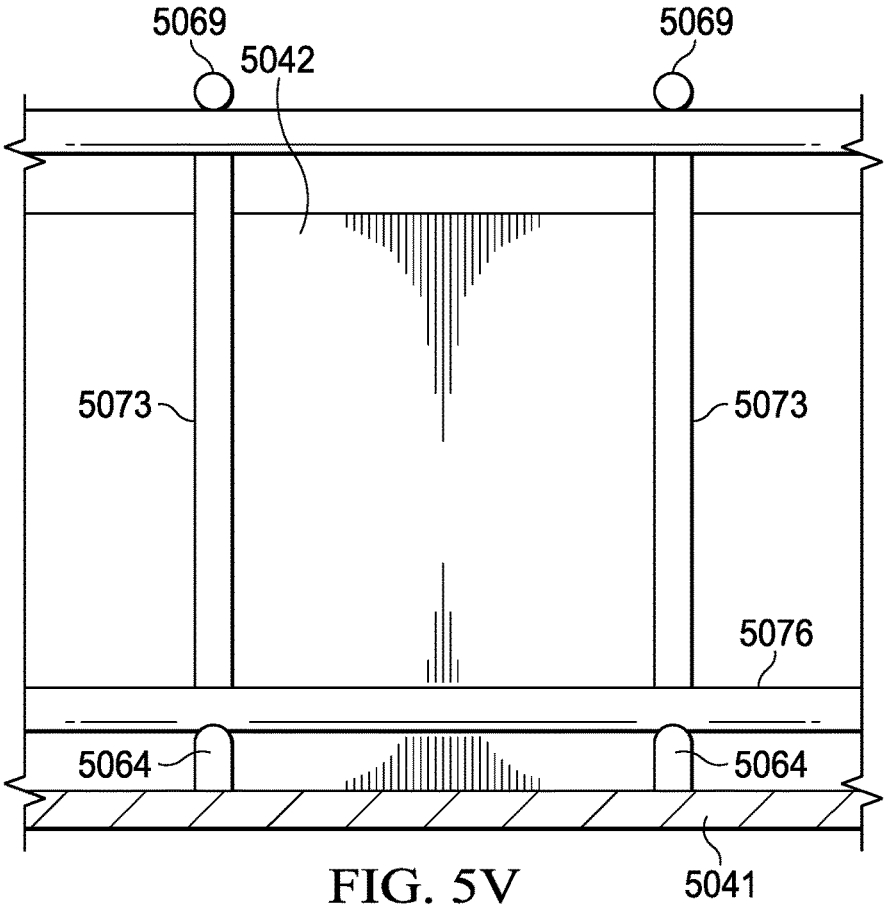
FIG. 5V is a cross sectional detail view of a formwork section.

Referring to FIGS. 5U and 5V, formwork 5002 may further include rebar positioning chairs 5062, 5064, and 5066. The rebar chairs are comprised of FRP bar stock having a diameter between about ¼" and about ½", as previously described.

Chairs 5062 are bonded at even intervals to the interior surface of horizontal upper panels 5039, 5043, 5046, 5050, 5054, 5056 and 5060 using a suitable adhesive, such as epoxy. Chairs 5064 are bonded at even intervals to the interior surfaces of horizontal lower panels 5041, 5048, and 5052. Chairs 5066 are bonded at even intervals to the interior surface of horizontal lower panel 5058. The chairs are employed to position and support longitudinal rebar, as will be further described. Any number of chairs may be employed. Any spacing may be employed depending on design considerations.

Formwork 5002 may include longitudinal rebar 5068 positioned in chairs 5062. The longitudinal rebar is comprised of FRP bar stock preferably having a diameter between about ¼" and about ⅝", as required.

Longitudinal rebar 5070, 5071 and 5072 are supported by a plurality of rebar posts 5073, 5074, and 5075, respectively. The rebar posts are comprised of FRP bar stock preferably having a diameter between about ¼" and about ⅝", as required. The rebar posts are bonded to latitudinal rebars 5076, 5077 and 5078. Latitudinal rebars 5076, 5077 and 5078 are bonded to positioning chairs 5064 using epoxy, or another suitable adhesive.

Longitudinal rebars 5079, 5080, 5081 and 5082 are further bonded to a plurality of stirrups 5083. Stirrups 5083 are aligned, generally rectangular cages comprised of FRP bar stock. Stirrups 5083 are bonded to latitudinal rebar 5069. The stirrups are supported by chairs 5066 and evenly spaced along horizontal panel 5058.

Latitudinal rebar 5069 is preferably comprised of FRP bar stock having a diameter of between ½" and 1", as required. Latitudinal rebar 5069 is bonded to longitudinal rebar 5068, 5070, 5071 and 5072 using epoxy, resin or another suitable adhesive.

It should be appreciated that the quantity placement and shape of rebar, rebar chairs, posts and stirrups may vary, depending on design compensations.

Figure 5W:
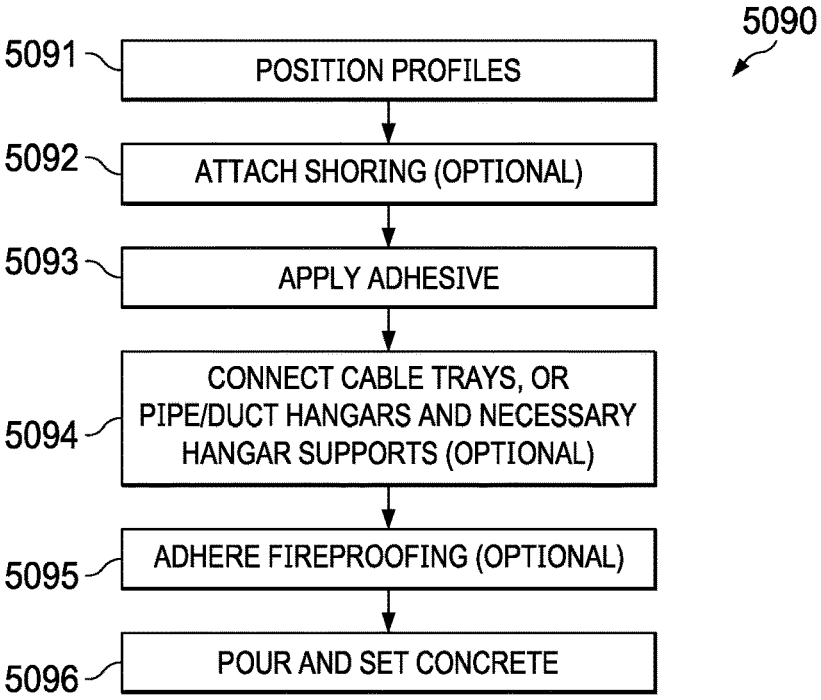
FIG. 5W is a preferred method of assembly for a formwork structure.

Referring then to FIG. 5W, preferred method 5090 of assembling floor formwork 5000 will be further described.

At step 5091, the profiles are positioned in the field.

At step 5092, optionally, shoring is attached to the profiles to hold the profiles in position.

At step 5093, the profiles are bonded together by applying a suitable adhesive, such as epoxy, to the connection flanges. Alternatively, the profiles may be secured together using mechanical fasteners, such as screws or rivets.

At step 5094, optionally, all required cable trays, pipe hangars, duct hangars, and any additional supports are connected to the profiles, as previously described.

At step 5095, a fireproofing layer is optionally applied to the exterior surface of the profiles, as previously described.

At step 5096, concrete is poured and set. Once cured, the formwork is left in place to strengthen and protect the concrete.

Figure 6A:
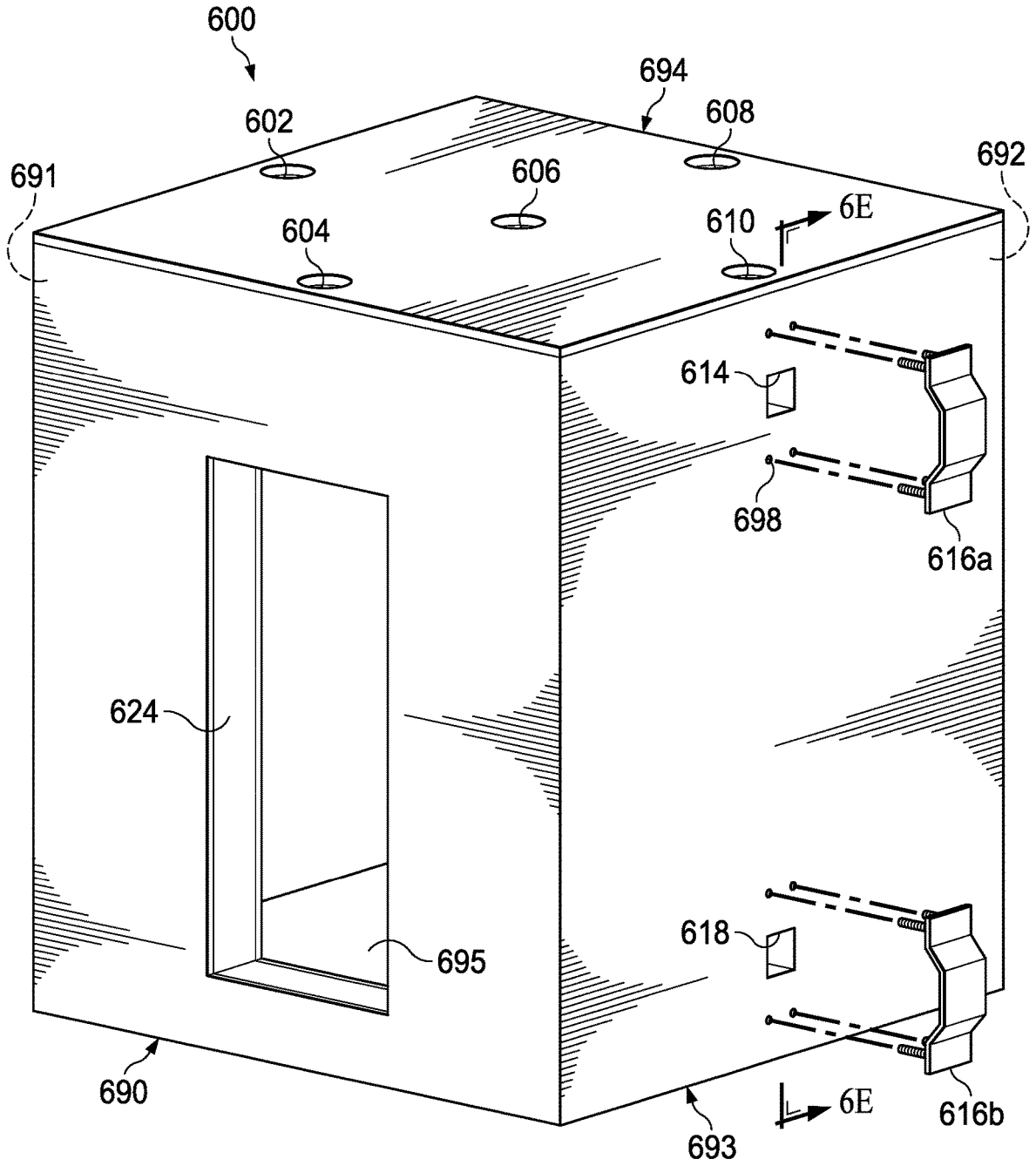
FIG. 6A is an isometric view of a form structure.
Figure 6B:
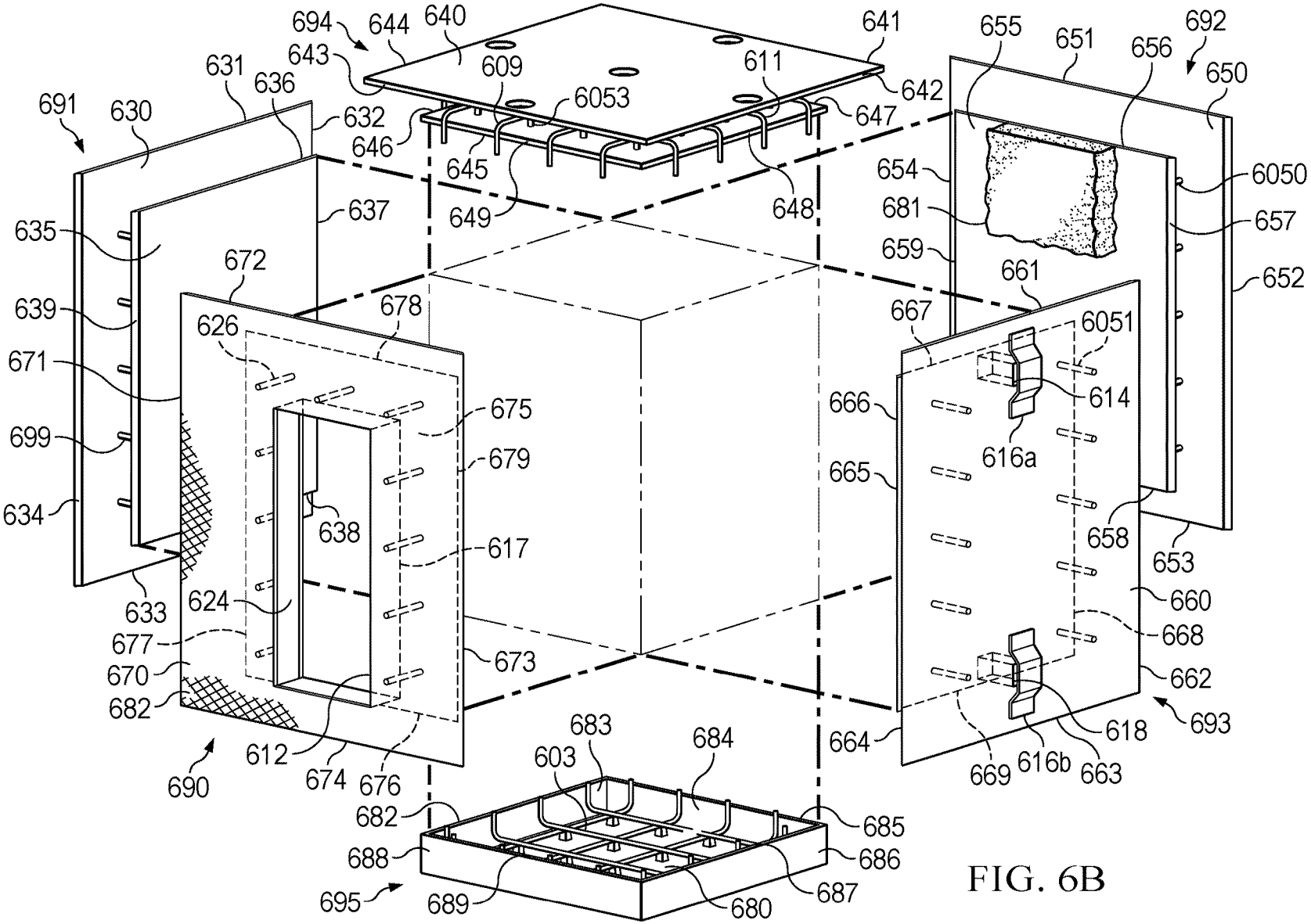
FIG. 6B is an exploded isometric view of a form structure for concrete reinforcement.

Referring then to FIGS. 6A and 6B, storm shelter formwork 600 is described.

Storm shelter formwork 600 is comprised of integrated walls 690, 691, 692, and 693, integrated ceiling 694, and floor pan 695, as will be further described. In one embodiment, the interior surfaces of integrated walls 690, 691, 692, and 693, and integrated ceiling 694 may include an insulated surface 681 applied to the interior or external surfaces of the integrated walls and ceiling during manufacturing, such as a spray foam insulation. In another preferred embodiment, the exterior of the integrated walls and ceiling can include a textured or patterned surface 682 such as the appearance of brick, stucco, wood or stone, or may be polished. In another preferred embodiment, the fiberglass resin composite of the exterior of the integrated walls and ceiling can include a pigment, such as $TiO_2$ for reflective qualities or carbon black for resistance to ultraviolet damage to the resin and fiberglass materials.

The exterior surface of integrated ceiling 694 includes access holes 602, 604, 606, 608, and 610. The holes allow concrete to be poured into the void created by the formwork and evenly distributed to avoid inclusions. Any number of access holes may be provided so long as they are evenly distributed on the exterior surface.

At least one of integrated walls 691, 692, and 693 includes upper ventilation hole 614, and lower ventilation hole 618 ductedly connected to the interior of the structure, as will be further described. The ventilation holes are provided to allow fresh air to circulate through the structure once completed. Covers 616*a* and 616*b* are affixed to the integrated walls over the ventilation holes, as will be further described. The covers are provided to protect the ventilation holes from tampering and wind-borne debris, while still providing adequate airflow.

Integrated wall 690 includes doorframe 624, as will be further described.

Referring then to FIG. 6B, storm shelter formwork 600 will be further described.

In general, the interior panels and exterior panels of the integrated walls and ceiling are formed and connected in such a way as to form mitered corners which are both spatially efficient and accessible to bond together during construction and which are very strong once bonding is complete. The strength of the mitered corners is important because the wet concrete is very heavy and the corners and panels must support this weight while the concrete cures. In general, the interior panels are smaller than the exterior panels in both width and height so as to accommodate the 45° mitered corners at each edge. The interior panels are generally coplanar to the exterior panels, and are held in a centered position with respect to the exterior panels by rigid stanchions and rigid ductwork. Bonding of the panels, in a preferred embodiment, is carried out by first applying resin to the interior and exterior mitered corners, then pressing resin coated fiberglass mesh into the corners. Additional liquid resin then may be added to the mesh to adequately seal the junction.

Integrated wall 690 is comprised of exterior front panel 670 and interior front panel 675. Exterior front panel 670 is rectangular in shape and includes door hole 612. Door hole 612 is rectangular in shape and generally centrally located on the panel. A standard 80" door size is preferred. Interior front panel 675 is rectangular in shape includes door hole 617. Door hole 612 and door hole 617 are preferably the same size. The door holes are ductedly connected with doorframe 624. Interior front panel 675 is held in position parallel to exterior front panel 670 by a plurality of stanchions 626. In a preferred embodiment, the stanchions are permanently bonded perpendicularly to the interior of each panel. The stanchions hold the interior panel in position adjacent the exterior panel during shipment, assembly, and concrete placement and prevent the panels from moving with respect to each other. In a preferred embodiment, the stanchions are comprised of FRP rebar, between about ⅛" and about ½" diameter.

Integrated wall 690 connects to integrated wall 691, integrated wall 693, integrated ceiling 694, and floor pan 695. Edge 671 of exterior front panel 670 connects with edge 634 of exterior side panel 630 of integrated wall 691. Edge 672 of exterior front panel 670 connects with edge 643 of exterior ceiling panel 640. Edge 673 of exterior front panel 670 connects with edge 664 of exterior side panel 660 of integrated wall 693. Edge 674 of exterior front panel 670 connects with panel 688 of floor pan 695. Front panel 688 of floor pan 695 fits flush against the interior surface of exterior front panel 670. Edge 677 of interior front panel 675 connects with edge 639 of interior side panel 635 of integrated wall 691. Edge 678 of interior front panel 675 connects with edge 649 of interior ceiling panel 645. Edge 679 of interior front panel 675 connects with edge 666 of interior side panel 665 of integrated wall 693. Edge 676 of interior front panel 675 is positioned adjacent cured concrete in the floor pan, as will be further described. Preferably the panels are connected at generally 90° angles, with 45° mitered corners. But, other angles for shelters of different configurations, such as shelters with a hexagonal or octagonal shape, or a geodesic dome configuration, are also envisioned.

Integrated wall 691 is comprised of exterior side panel 630 and interior side panel 635, both are rectangular in shape. Interior side panel 630 and interior side panel 635 are held in position generally parallel to each other by a plurality of stanchions 699. The stanchions are permanently bonded to the interior of each panel, as previously described.

Integrated wall 691 connects to integrated wall 690, integrated wall 692, integrated ceiling 694, and floor pan 695. Edge 631 of exterior side panel 630 connects with edge 644 of exterior ceiling panel 640. Edge 632 of exterior side panel 630 connects with edge 654 of exterior rear panel 650 of integrated wall 692. Edge 633 of exterior side panel 630 connects with panel 683 floor pan 695. Front panel 688 of floor pan 695 fits flush against the interior surface of exterior side panel 630. Edge 636 of interior side panel 635 connects with edge 646 of interior ceiling panel 645. Edge 637 of interior side panel 635 connects with edge 659 of interior rear panel 655 of integrated wall 692. The panels are connected at generally 90° angles, with 45° mitered corners, as previously described.

Integrated wall 692 is comprised of exterior rear panel 650 and interior rear panel 655. Exterior rear panel 650 is generally rectangular in shape. Interior rear panel 655 is generally rectangular in shape. Interior rear panel 655 is held in position parallel to exterior rear panel 650 by stanchions 6050 which are constructed and positioned, as previously described.

Integrated wall 692 connects to integrated wall 691, integrated wall 693, integrated ceiling 694, and floor pan 695. Edge 651 of exterior rear panel 650 connects with edge 641 of exterior ceiling panel 640. Edge 652 of exterior rear panel 650 connects with edge 662 of exterior side panel 660 of integrated wall 693. Edge 653 of external rear panel 650 connects with panel 684 floor pan 695. Rear panel 684 of floor pan 695 fits flush against the interior surface of exterior rear panel 650. Edge 656 of interior rear panel 655 connects with edge 647 of interior ceiling panel 645. Edge 657 of interior rear panel 655 connects with edge 668 of interior side panel 665. The panels are connected at generally 90° angles, with 45° mitered corners, as previously described.

Integrated wall 693 connects to integrated wall 690, integrated wall 692, integrated ceiling 694, and floor pan 695. Edge 661 of exterior side panel 660 connects with edge 642 of exterior ceiling panel 640. Edge 667 of interior side panel 665 connects with edge 648 of interior ceiling panel 645. The panels are connected at generally 90° angles, with 45° mitered corners, as previously described. Side panel 686 of floor pan 695 fits flush against the interior surface of exterior side panel 660.

Figure 6C:
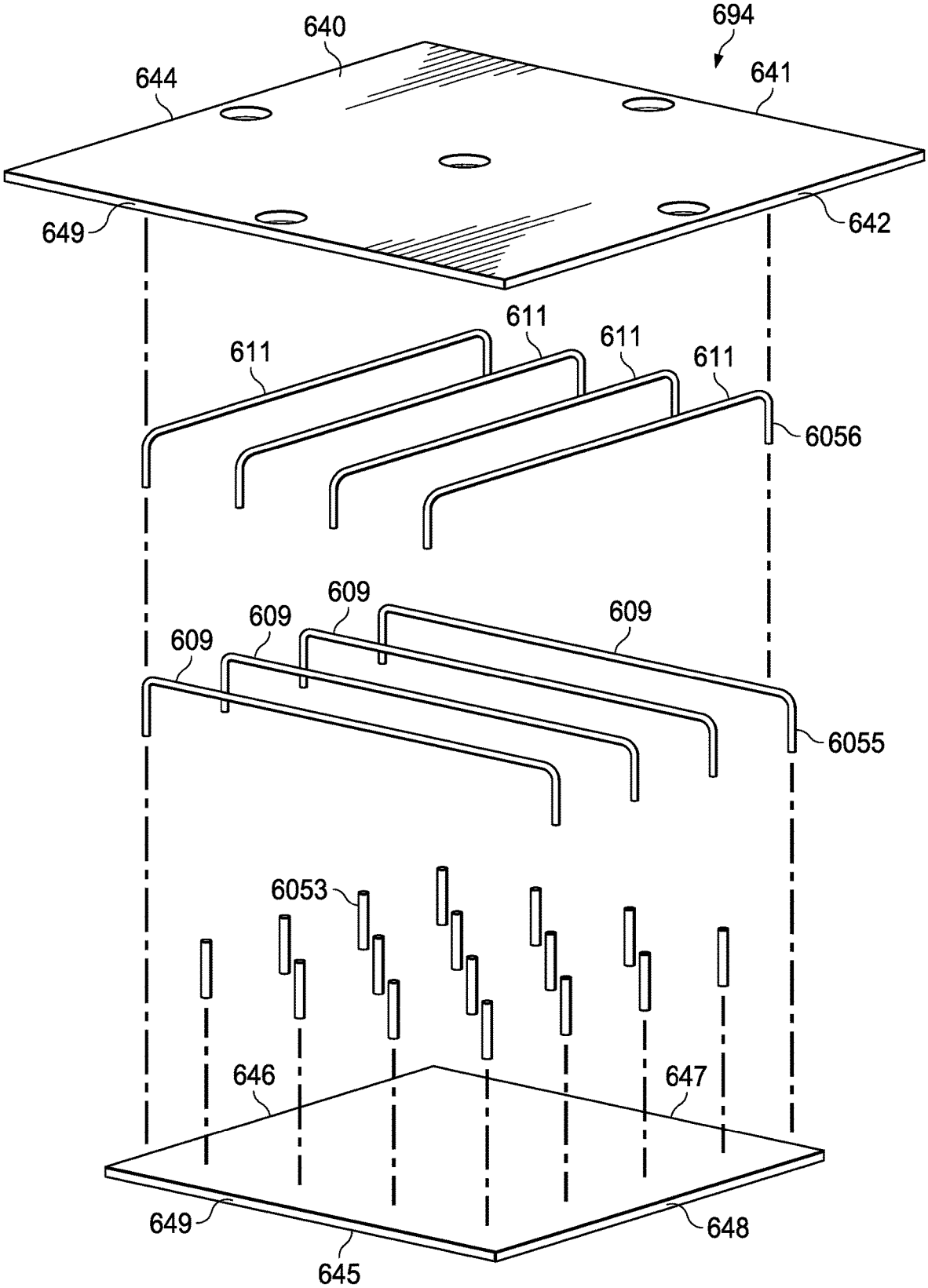
FIG. 6C is an exploded isometric view of a formwork section.
Figure 6D:
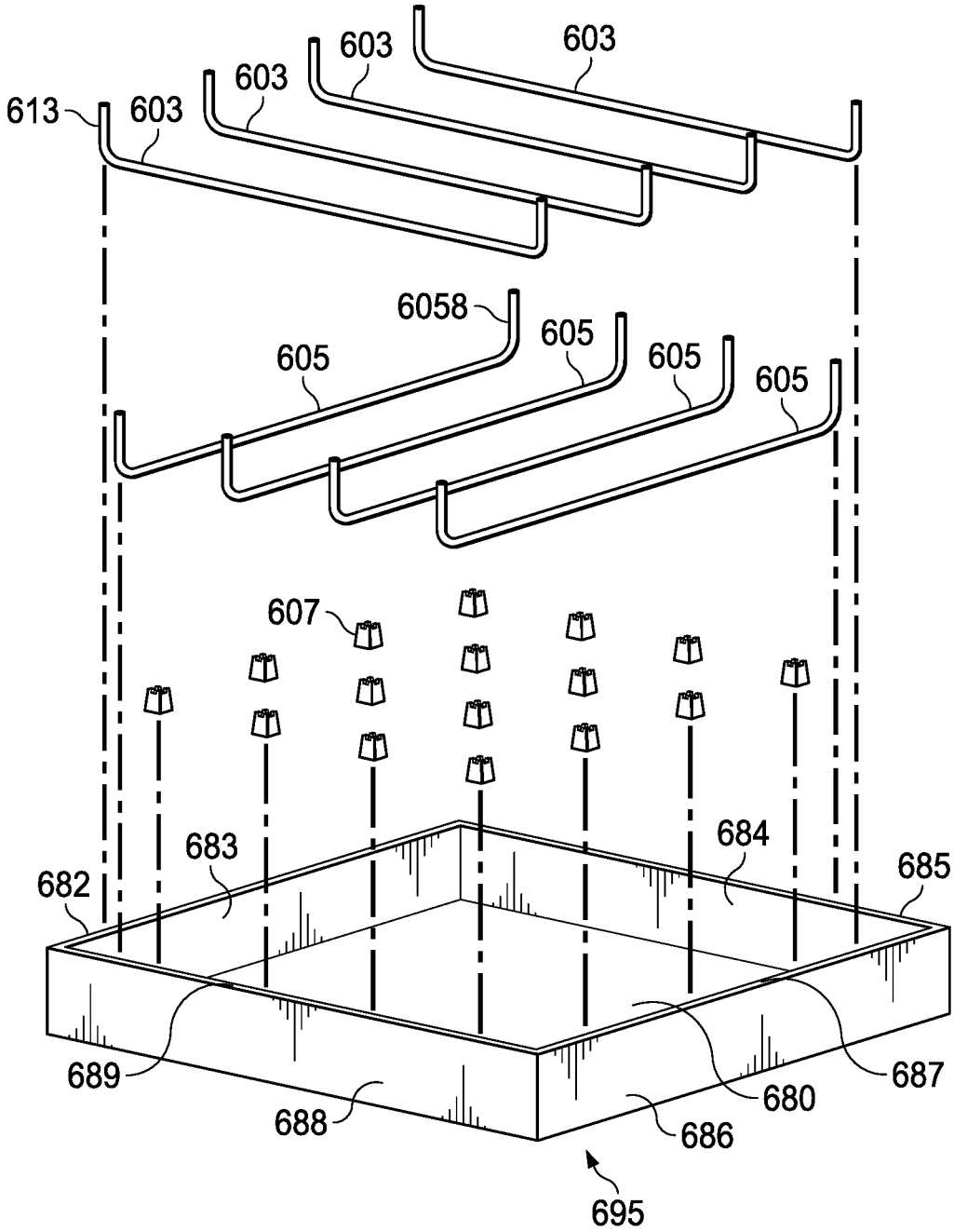
FIG. 6D is an exploded isometric view of a formwork section.
Figure 6E:
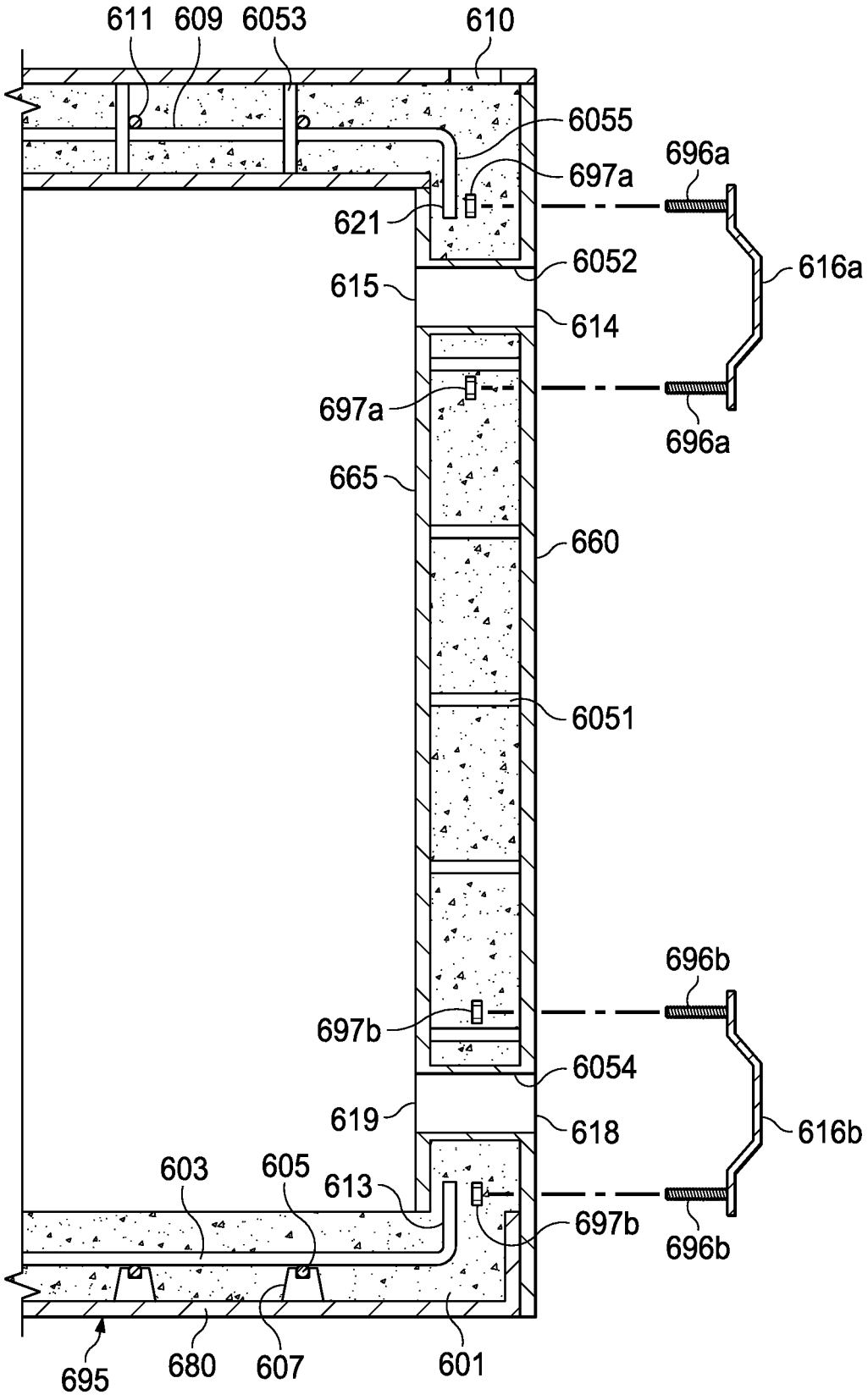
FIG. 6E is cross-sectional view of a preferred embodiment of formwork structure.

Referring to FIGS. 6B and 6E, integrated wall 693 is comprised of exterior side panel 660 and interior side panel 665. Both are generally rectangular. Exterior side panel 660 and interior side panel 665 are held in position generally parallel and centered with respect to each other by a plurality of stanchions, 6051 which are constructed and positioned as previously described. Exterior side panel 660 includes upper ventilation hole 614 and lower ventilation hole 618, as will be further described. Interior side panel 665 includes upper ventilation hole 615 and lower ventilation hole 619, as will be further described. The upper ventilation holes are connected by duct box 6052. The lower ventilation holes are connected by duct box 6054.

Integrated ceiling 694 is comprised of exterior ceiling panel 640, and interior ceiling panel 645. Both are generally square. Interior ceiling panel 645 is held in position parallel and centered with respect to exterior ceiling panel 640 by stanchions 6053, as previously described.

Floor pan 695 is comprised of base panel 680, front panel 688, side panel 683, rear panel 684, and side panel 686. The base panel is generally square. Front panel 688 is connected to side panels 683 and 686, and base panel 680. Side panel 683 is further connected to rear panel 684 and base panel 680. Rear panel 684 is further connected to side panel 686 and base panel 680. Side panel 686 is further connected to base panel 680. Panels 683, 684, 686, and 688 are generally perpendicular to the base panel and each other. The side panels are generally parallel. The front and rear panels are generally parallel.

Referring then to FIG. 6C, integrated ceiling 694 will be further described.

Integrated ceiling 694 is comprised of longitudinal rebar 611 and latitudinal rebar 609. Longitudinal rebar 611 is held generally perpendicular to latitudinal rebar 609. Latitudinal rebar 609 and longitudinal rebar 611 are parallel to exterior ceiling panel 640 and interior ceiling panel 645. Latitudinal rebar 609 and longitudinal rebar 611 are comprised of FRP bar stock and bonded perpendicularly to stanchions 6053 using a suitable adhesive. In a preferred embodiment, latitudinal rebar 609 and longitudinal 611 each have downward facing sections 6055 and 6056, respectively. In this embodiment, each downward facing section is positioned to extend into the void created by the integrated walls.

Referring to FIG. 6D, floor pan 695 is further comprised of longitudinal rebar 605, and latitudinal rebar 603, and chairs 607. The chairs are comprised of FRP material and bonded to base panel 680, as previously described. Latitudinal rebar 603 is generally perpendicular to longitudinal rebar 605. Longitudinal rebar 605 is bonded to the chairs using suitable adhesive. Latitudinal rebar 603 is bonded to longitudinal rebar 605 at the chair positions. In a preferred embodiment, latitudinal rebar 603 and longitudinal 605 each have upward facing bars 613 and 6058, respectively. In this embodiment, each upward facing bar is positioned to extend upwards into the void formed by the integrated walls.

Referring then to FIG. 6E, storm shelter formwork 600 will be further described.

Covers 616*a* and 616*b* are attached to exterior panel 660, via bolts 696*a* and 696*b*, and nuts 6057*a* and 6057*b*, respectively. Preferably the bolts are bonded to the interior of the cover plates during manufacture, but before the concrete pour, rendering the plates tamper proof.

Figure 6F:
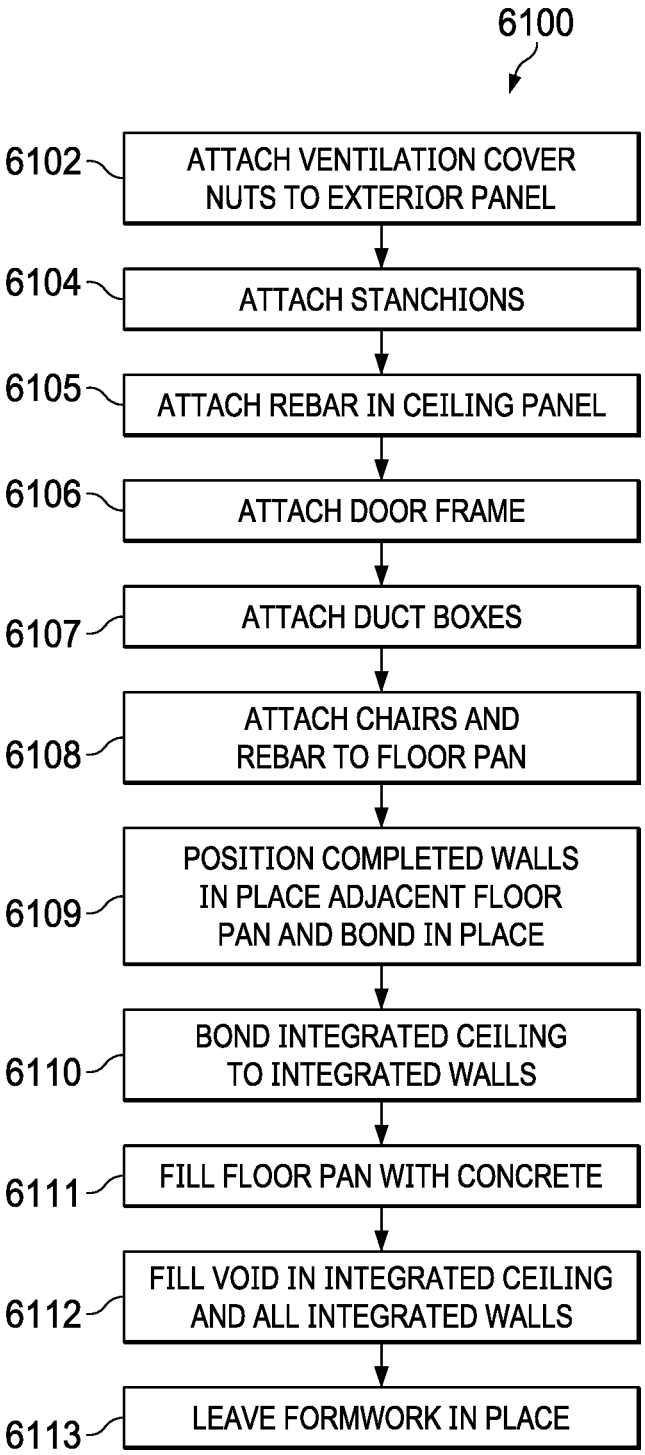
FIG. 6F is a preferred method of assembly for a formwork structure.

Referring then to FIG. 6F, preferred method 6100 of assembling storm shelter formwork 600 will be further described.

At step 6102, covers 616*a* and 616*b* are attached to the surface of panel 660, using the nuts and bolts as previously described.

At step 6104, all stanchions are attached to the internal surfaces of the panels connecting exterior panels 630, 640, 650, 660, and 670 to interior panels 635, 645, 655, 665, and 675, respectively. At step 6105, latitudinal rebar 609 and longitudinal rebar 611 is bonded to stanchions 6053 in the integrated ceiling panel. At step 6106, doorframe 624 is connected to interior panel 675 and exterior front panel 670. At step 6107, duct boxes 6052 and 6054 are connected to holes 614 and 615, and holes 618 and 619, respectively.

At step 6108, chairs 607 and rebar 603 and 605 are bonded in place in floor pan 695.

At step 6109, the integrated walls are bonded together adjacent the floor pan using a suitable adhesive, as previously described. Alternatively, the integrated walls may be secured using mechanical fasteners, such as screws or rivets, using appropriate angel brackets. Inductive welding may also be used. Alternatively, the integrated walls may be attached to the completed floor pan with lag screws or dowels.

At step 6110, the integrated ceiling is bonded to the integrated walls, as previously described.

At step 6111 the completed floor pan is filled with wet concrete and allowed to cure. Care must be taken to force concrete under each integrated wall and around all plumbing present in the floor pan.

At step 6112, the void formed by the integrated walls and ceiling is filled with concrete through holes 602, 604, 606, 608, and 610. Those of skill will recognize that the cured concrete now present in the floor pan serves as a lower bound to the void formed by the integrated walls, and prevents wet concrete from escaping during the pour.

At step 6113, once cured, the formwork is left in place to strengthen and protect the concrete and provide a pleasing aesthetic appearance.

Figure 6G:
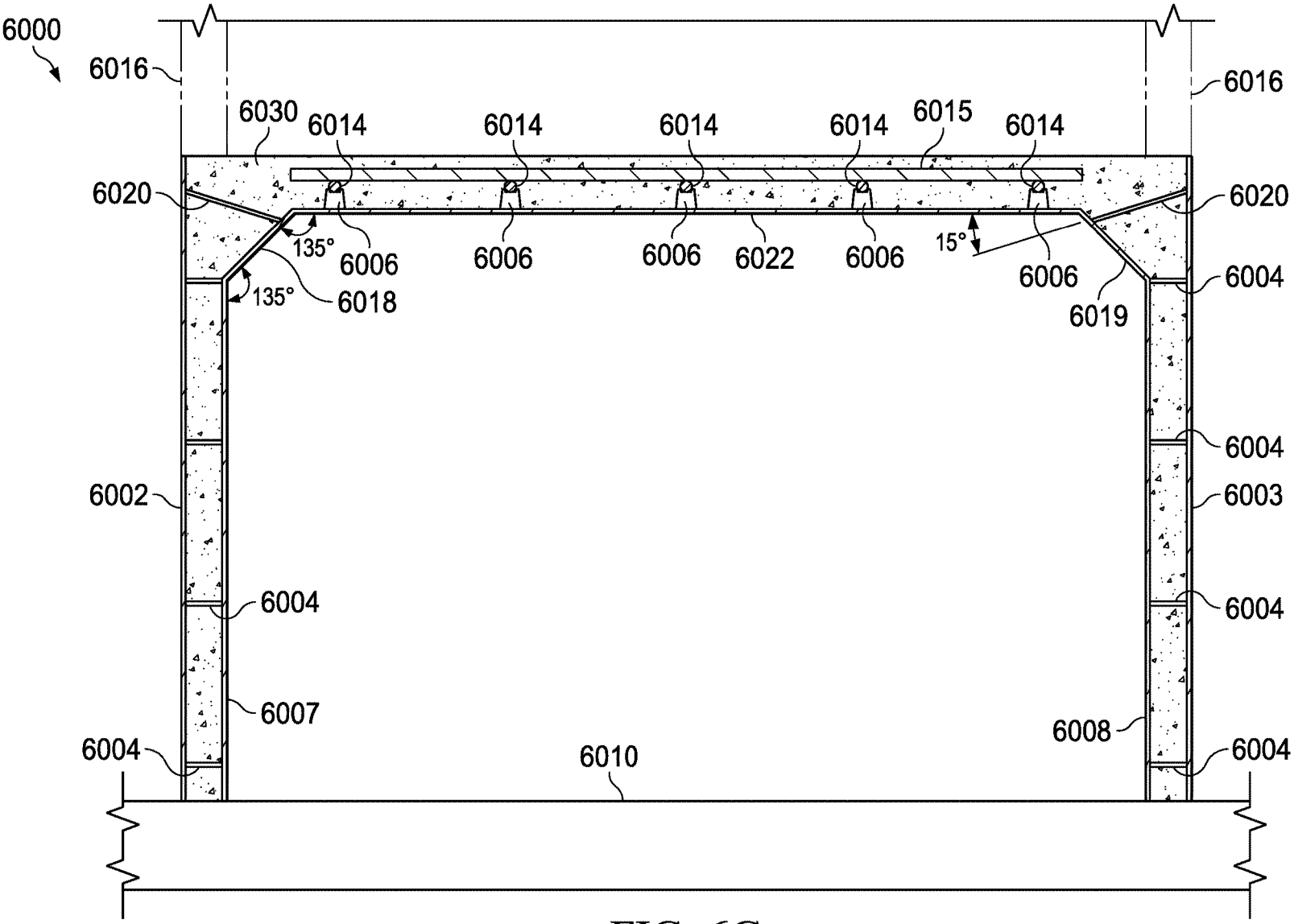
FIG. 6G is cross-sectional side view of an assembled formwork structure for concrete reinforcement.
Figure 6H:
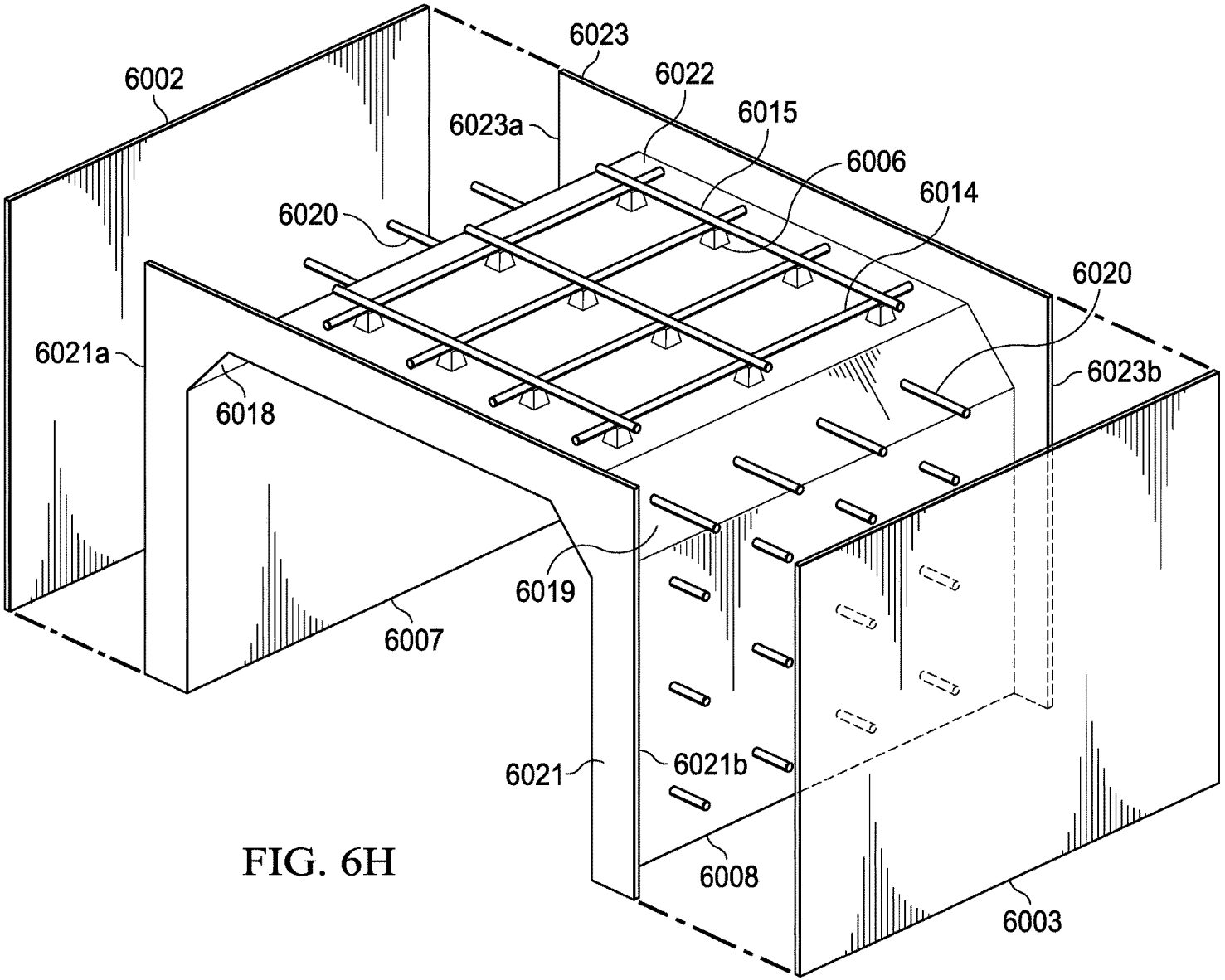
FIG. 6H is an exploded isometric view of a form structure for concrete reinforcement.

Referring then to FIGS. 6G and 6H, multi-unit formwork 6000 is described. In general, multi-unit formwork 6000 is designed to accommodate structures with multiple stories where the ceiling of the structure below forms the floor of the structure above.

Multi-unit formwork 6000 is comprised of inner panel 6007 and inner panel 6008. Inner panel 6007 is integrally formed with diagonal panel 6018. Inner panel 6008 is integrally formed with diagonal panel 6019. The diagonal panels form about a 135° angles with the inner panels. These angles may vary. The diagonal panels are connected to upper panel 6022. Diagonal panels 6018 and 6019 form about a 135° angles with upper panel 6022. The panels preferably are FRP sheet material. The panels are bonded together using a suitable industrial adhesive, or are integrally formed, as previously described.

Multi-unit formwork 6000 is further comprised of front flange 6021 and rear flange 6023. Front flange 6021 and rear flange 6023 bonded to inner panels 6007 and 6008, diagonal panels 6019 and 6022 and upper panel 6022 may form a rectangular archway. Multi-unit formwork 6000 is further comprised of outer panel 6002 and outer panel 6003. The outer panels are comprised of FRP sheets, as previously described. Front flange 6021 is bonded to outer panel 6002 along edge 6021*a*. Rear flange 6023 is bonded to outer panel 6002 along edge 6023*a*. Front flange 6021 is bonded to outer panel 6003 along edge 6021*b*. Outer panel 6003 is bonded to rear flange 6023 along edge 6023*b*. The flanges and panels are bonded together using epoxy or a suitable industrial adhesive, as previously described. Alternatively, mechanical fasteners may be used, such as screws or rivets. Heat welding may also suffice.

Outer panels 6002 and 6003 are generally parallel to inner panels 6007 and 6008. Outer panels 6002 and 6003 are connected to inner panels 6007 and 6008, respectively, via a plurality of stanchions 6004. Outer panels 6002 and 6003 are connected to diagonal panels 6018 and 6019 via a plurality of stanchions 6020. Preferably, stanchions 6020 are positioned about 15° from horizontal, but other angles may be used. The stanchions are evenly spaced and bonded to the interior surface of the panels using epoxy, or another suitable resin material. Stanchions 6004 and 6020 prevent the panels from deflecting due to outward pressures created by concrete placement. The stanchions are preferably about ¼" to about ½" in diameter and are comprised of FRP bar stock.

Positioning chairs 6006 are bonded to the top surface of upper panel 6022 at evenly spaced intervals. Chairs 6006 are comprised of FRP bar stock having a diameter between about ¼" and about ½". A plurality of rebar 6014 is positioned and bonded to chairs 6006. Optionally, longitudinal rebars 6014 may include complementary lateral rebar 6015 positioned at even intervals to add additional structural support as needed.

Multi-unit formwork 6000 is suitable for construction of multi-unit construction, such as hotels and apartments, or storm shelters. Once assembled, concrete 6030 is introduced into the formwork and allowed to cure. The formwork then remains in place to support and protect the concrete.

Multi-unit formwork 6000 may be positioned on a concrete foundation 6010. Likewise, upper structure 6016 may be supported by the formwork once the concrete is cured to desired strength.

Figure 6I:
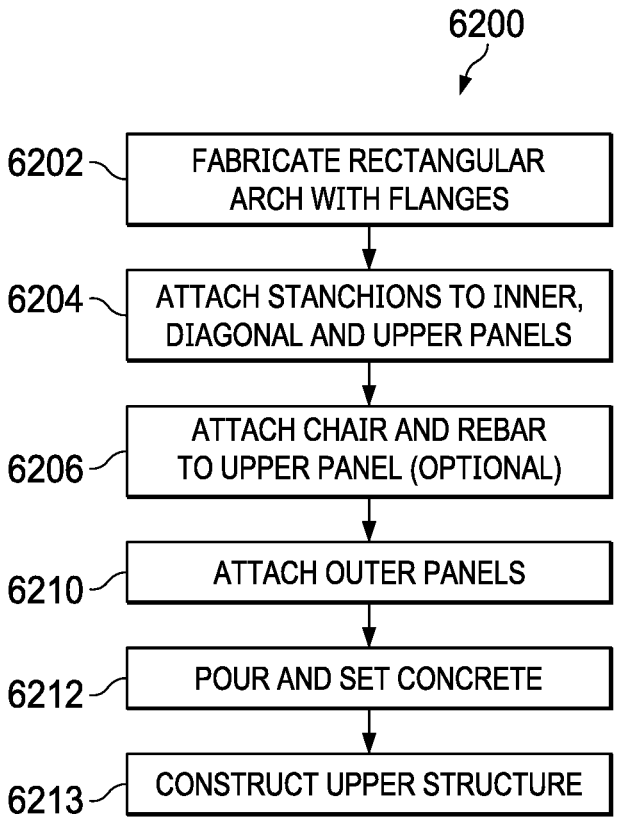
FIG. 6I is a preferred method of assembly for a precast formwork structure.

Referring then to FIG. 6I, preferred method 6200 of assembling multi-unit formwork 6000 will be further described.

At step 6202, the rectangular archway is fabricated with flanges. The rectangular archway consists of inner panels 6007 and 6008, diagonal panels 6018 and 6019, upper panel 6022, and flanges 6021 and 6023.

At step 6204, stanchions 6004 are attached to the internal surfaces of inner panels 6007 and 6008.

At step 6206, optionally, chairs 6006 and rebar 6014 are bonded in place on top of upper panel 6022.

At step 6210, outer panel 6002 is bonded to the stanchions and front and rear panels along edges 6021*a* and 6023*a*, respectively. Outer panel 6003 is bonded to the stanchions and front and rear panels along edges 6021*b* and 6023*b*, respectively.

At step 6212, the formwork is filled with concrete. Once cured, the formwork is left in place to strengthen and protect the concrete. At step 6213, upper structure 6016 may be similarly constructed.

Figure 7A:
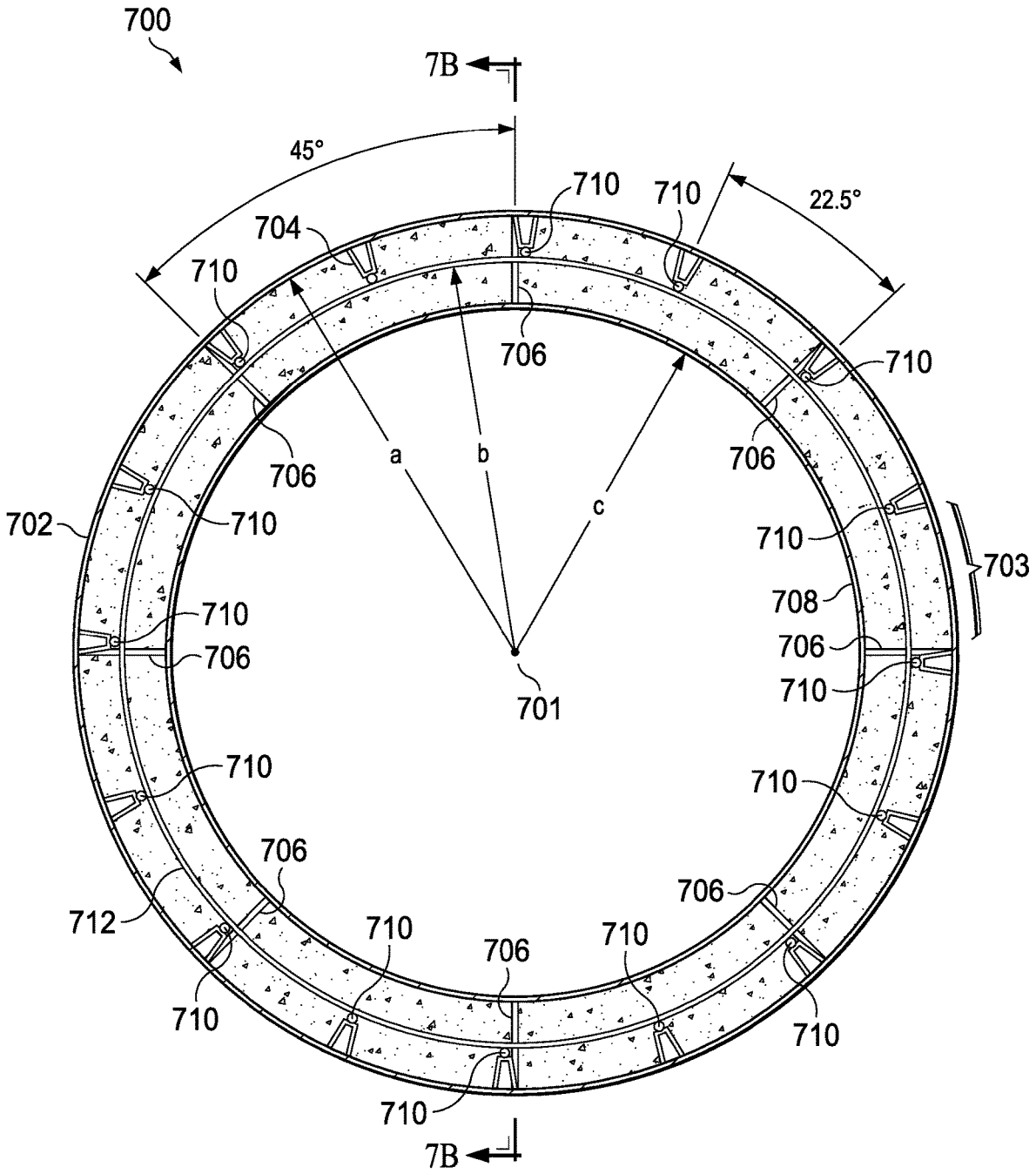
FIG. 7A is cross-sectional view of a preferred embodiment of a pre-cast formwork structure.
Figure 7B:
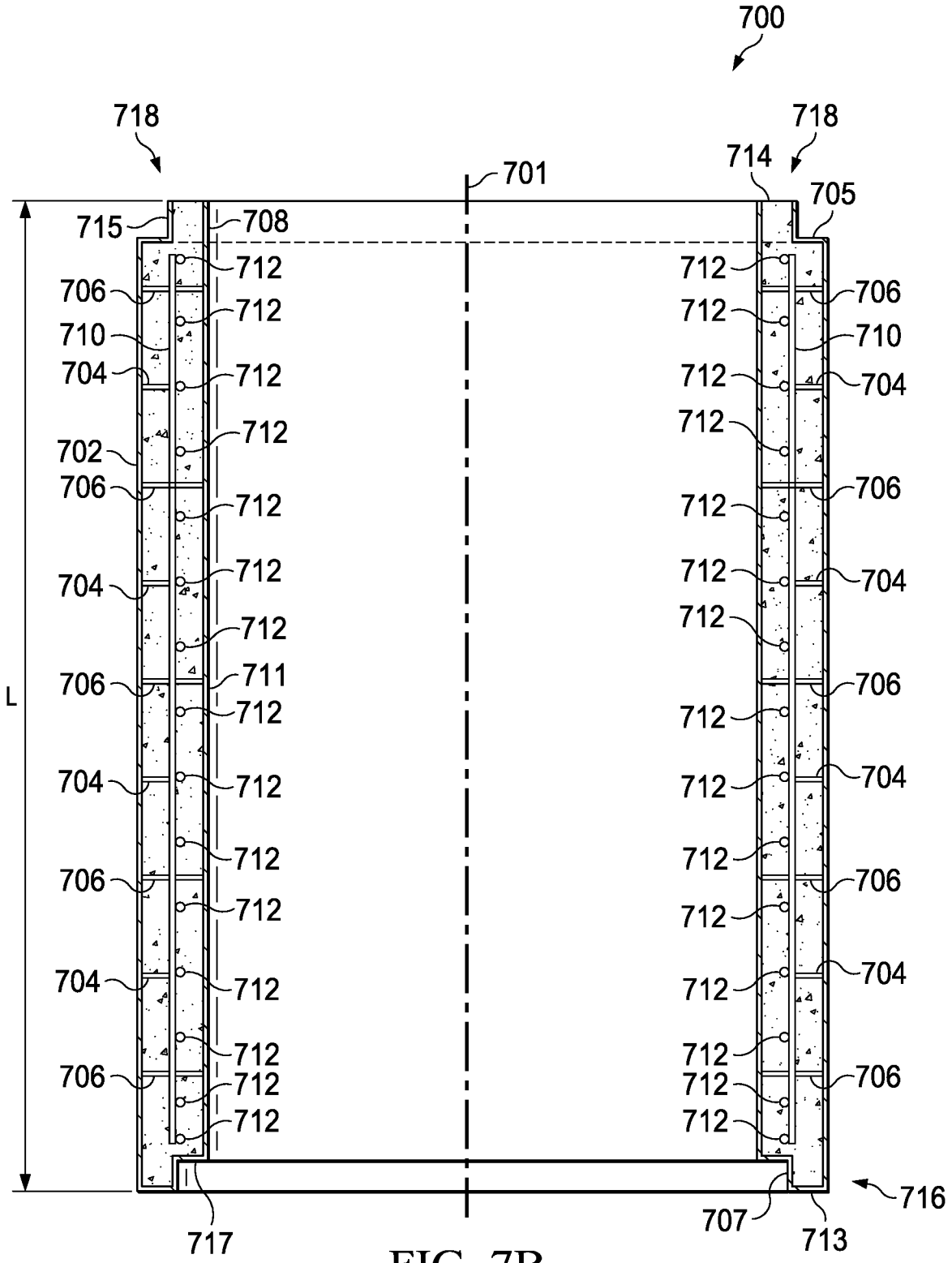
FIG. 7B is cross-sectional view of a preferred embodiment of a pre-cast formwork structure.
Figure 7C:
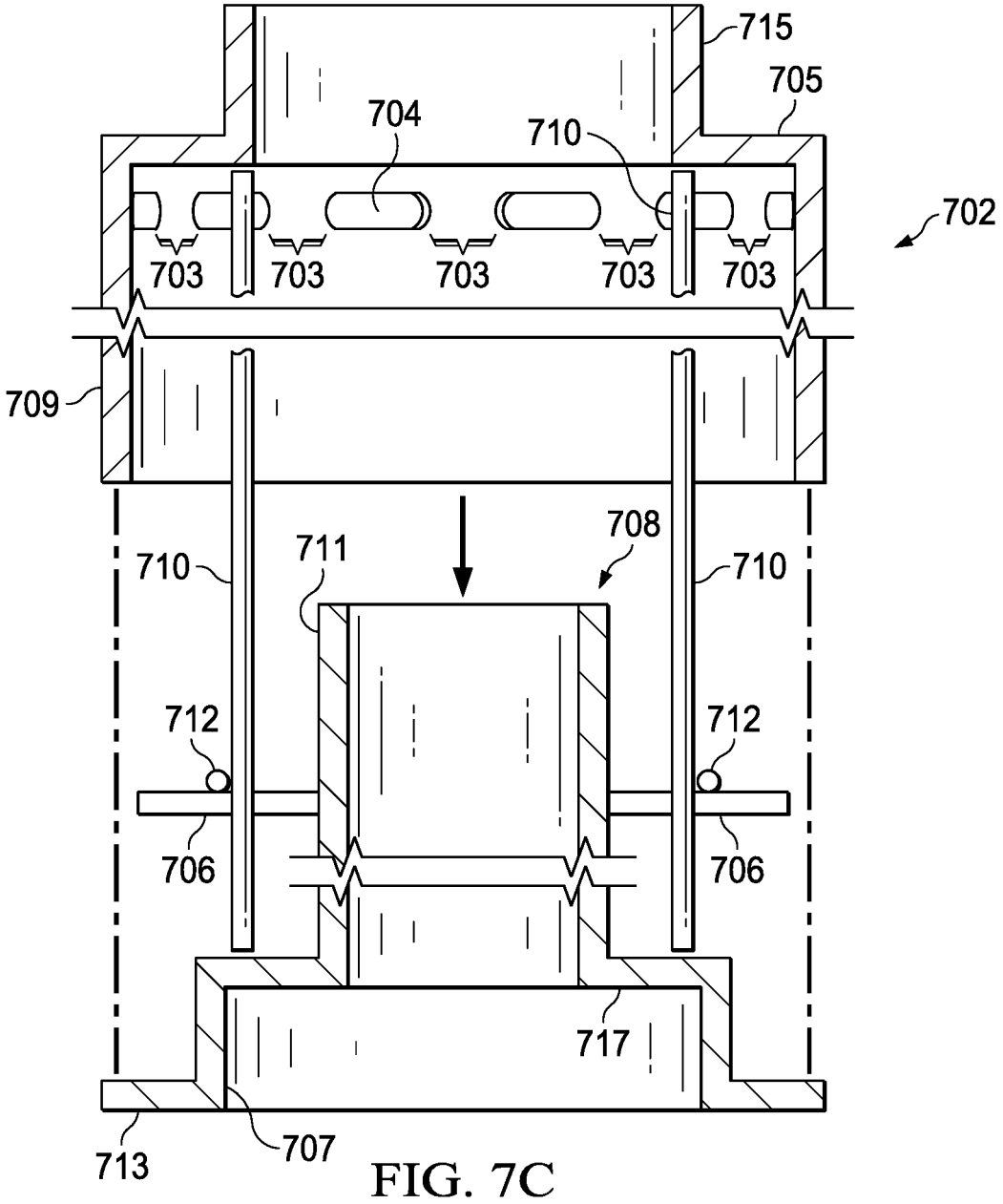
FIG. 7C is an exploded cross section view of a pre-cast formwork structure.

Referring then to FIGS. 7A, 7B and 7C, cylindrical formwork 700 will be described.

Cylindrical formwork 700 is generally a hollow cylinder with central axis 701 having an outer radius α, central radius κ, inner radius c, and length l. Other cross section shapes may be employed. The dimensions may vary based on structural requirements. Cylindrical formwork 700 is comprised of interior cylinder 708, and external cylinder 702. Cylinders 702 and 708 when assembled, are coaxial cylindrical FRP, each having a thickness between about ¼" and about 1" as required for adequate strength.

The cylinders are secured by a suitable adhesive. Alternatively, other connection means may be used including mechanical fasteners, such as screws or rivets.

The formwork has the following preferred dimensions.

TABLE 1

| | |
|---|---|
| Radius A | 72" |
| Radius B | 66" |
| Radius C | 60" |
| Length D | 120" |

External cylinder 702 is further comprised of outer wall 709. Outer wall 709 is adjacent annular stop surface 705. Annular stop surface 705 is integrally formed with the external cylinder. Annular stop surface 705 is integrally formed with and adjacent to guide surface 715, also formed in cylinder 702. When the cylinders are assembled, annular stop surface 705, guide surface 715 and inner wall 711 form internal flange 718.

Likewise, interior cylinder 708 is further comprised of inner wall 711 adjacent annular stop surface 717. Annular stop surface 717 is integrally formed with and adjacent to guide surface 707, also integrally formed with interior cylinder 708 adjacent guide surface 707 is annular stop surface 713. When external cylinder 702 and interior cylinder 708 are assembled, annular stop surface 713, outer wall 709, guide surface 707 and annular stop surface 717, form external flange 716.

External cylinder 702 is connected to interior cylinder 708 by radially aligned stanchions 706. The stanchions are comprised of FRP bar stock with a diameter between about ¼" and about 1". Stanchions 706 are evenly spaced and bonded to the interior of the cylinders. In a preferred embodiment, the stanchions are displaced radially at about 45° intervals around central axis 701. Longitudinally, the stanchions are aligned, on about 25" centers. Other angles of dispersion and center distances may be employed based on design considerations. Preferably, each longitudinal line of stanchions is positioned adjacent a longitudinal line of chairs.

Cylindrical formwork 700 is further comprised of chairs 704 bonded at even radially aligned intervals to the inner surface of outer wall 709. In a preferred embodiment, the chairs are displaced radially at about 22.5° intervals around central axis 701 forming interstitial spaces 703. Longitudinally, the chairs are positioned in rings on about 25" centers. Other angles of dispersion and center distances may be employed based on design considerations. In an alternative embodiment, chairs 704 may be bonded to the interior surface of inner wall 711. Chairs 704 are comprised FRP bar stock having a diameter between about ¼" and about ½".

Chairs 704 support a plurality of longitudinal rebars 710, which span the length of the formwork.

Longitudinal rebars 710 support a plurality of circular retainers 712. Circular retainers 712 are bonded to the rebar.

The retainers are comprised of FRP bar stock or steel having a diameter of about ¼" to about 1", as structurally required.

Figure 7D:
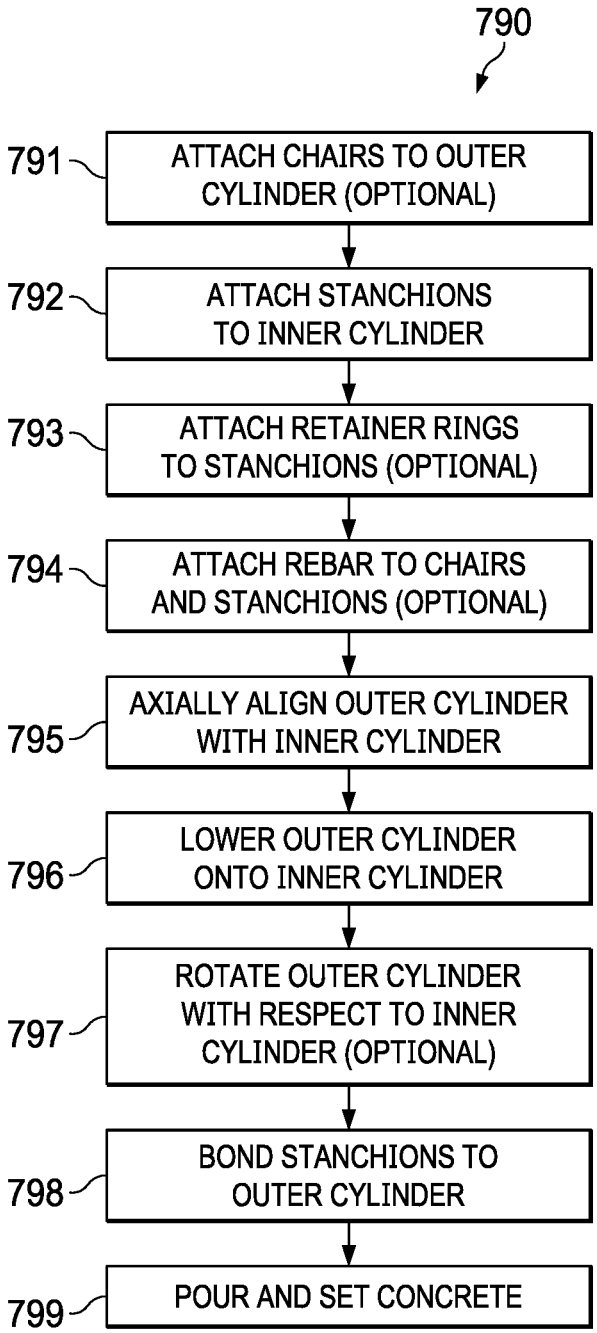
FIG. 7D is a preferred method of assembly for a precast formwork structure.

Referring to FIG. 7D, preferred method 790 of assembling cylindrical formwork 700 will be further described.

At step 791, optionally, chairs 704 are attached to the inner surface of outer wall 709 in a radial and longitudinally dispersed pattern, as previously described.

At step 792, stanchions 706 are attached to the internal surface of inner wall 711 in radially longitudinally dispersed pattern, as previously described.

At step 793, circular retainers 712 may optionally be attached to stanchions 706 and bonded in place.

At step 794, longitudinal rebar 710 is attached to chairs 704 and stanchions 706, optionally.

At step 795, external cylinder 702 is axially aligned with interior cylinder 708 such that stanchions 706 are positioned in interstitial spaces 703.

At step 796, external cylinder 702 is lowered onto inner cylinder 708, with care being taken not to rotate the cylinders with respect to each other such that the stanchions pass through the interstitial spaces.

At step 797, when cylinder 702 contacts annular stop surface 713, the outer cylinder is rotated clockwise with respect to the inner cylinder such that stanchions 706 abut chairs 704, optionally.

At step 798, stanchions 706 are bonded to the interior surface of the outer cylinder.

At step 799, the formwork is filled with concrete through annular opening 714, as shown in FIG. 7B. Once set, the formwork is left in place to strengthen and protect the concrete.

Figure 8:
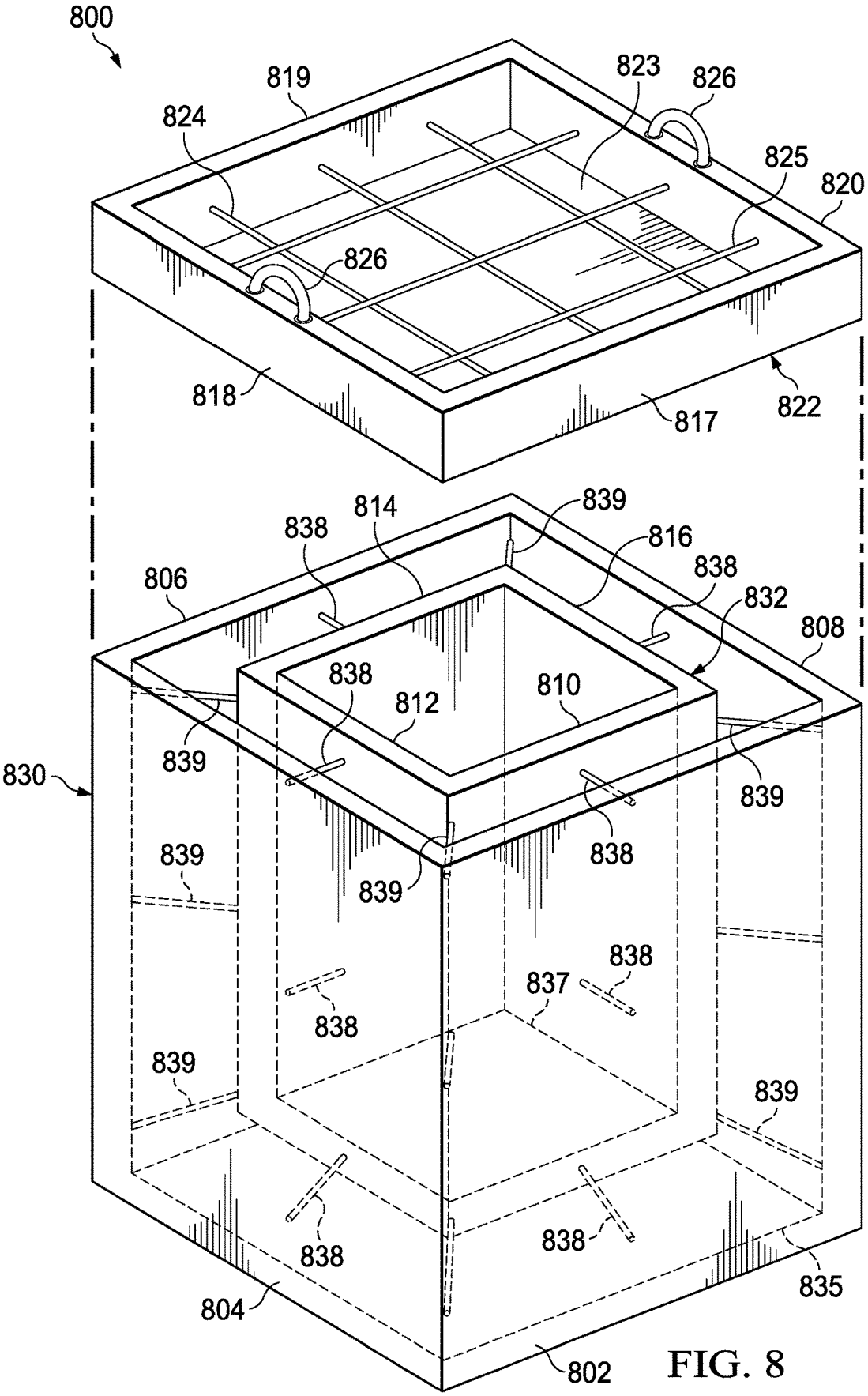
FIG. 8 is an exploded isometric view of a preferred embodiment of a formwork structure.

Referring then to FIG. 8, a preferred embodiment of catch basin formwork 800 will be described.

Formwork 800 is comprised of exterior form 830 and interior form 832. Exterior form 830 is generally an open cube comprised of four (4) side panels 802, 804, 806, and 808, and base panel 835. Side panel 802 is connected to side panels 804 and 808, and base panel 835. Side panel 804 is further connected to side panel 806 and base panel 835. Side panel 806 is further connected to side panel 808 and base panel 835. Side panel 808 is further connected to base panel 835. Side panel 802 is generally parallel to side panel 806. Side panel 804 is generally parallel to side panel 808. The side panels are connected at generally perpendicular angles forming a square shape. The side panels are connected to the base panel at generally a perpendicular angle. The panels are comprised of FRP sheets having a thickness between about ¼" and about 1", as required for adequate strength.

Formwork 800 is further comprised of interior form 832. Interior form 832 is generally an open cube comprised of four (4) side panels 810, 812, 814, and 816, and base panel 837. Side panel 810 is connected to side panels 812 and 816, and base panel 837. Side panel 812 is further connected to side panel 814 and base panel 837. Side panel 814 is further connected to side panel 816 and base panel 837. Side panel 816 is further connected to base panel 837. Side panel 810 is generally parallel to side panel 814. Side panel 812 is generally parallel to side panel 816. The side panels are connected at generally perpendicular angles forming a square shape. The side panels are connected to the base panel at generally a perpendicular angle. The panels are comprised of FRP sheets having a thickness between about ¼" and about 1", as required for adequate strength.

Interior form 832 is centrally positioned within exterior form 830. Interior form 832 is held in position within exterior form 830 by a plurality of center stanchions 838 and corner stanchions 839. In a preferred embodiment, the stanchions are displaced radially at about 45° angles with respect to the longitudinal axis of the formwork. Longitudinally the stanchions are aligned and positioned on about 24" centers. The stanchions position the interior form with regard to the exterior form during concrete placement and prevent the panels from bowing out due to outward pressures.

Formwork 800 includes lid form 822. Lid form 822 is generally square. The lid form is comprised of four (4) diametrically placed side panels 817, 818, 819, and 820, and base panel 823. Side panel 817 is connected to side panels 818 and 820, and base panel 823. Side panel 818 is further connected to side panel 819. Side panel 819 is further connected to side panel 820 and base panel 823. Side panel 820 is further connected to base panel 823. Side panel 817 is generally parallel to side panel 819. Side panel 818 is generally parallel to side panel 820. The side panels are connected at generally perpendicular angles forming a square shape. The side panels are connected to the base panel at generally a perpendicular angle. The panels are comprised of FRP sheets, as previously described.

Latitudinal rebars 824 and longitudinal rebars 825 are centrally positioned on the interior of the side panels to prevent the panels from bowing out due to outward pressures during concrete placement.

Lid form 822 is further comprised of handles 826 bonded to side panels 818 and 820 via epoxy. The handles are comprised of FRP bar stock having a diameter of about ¼" to about ½" as required.

Figure 9:
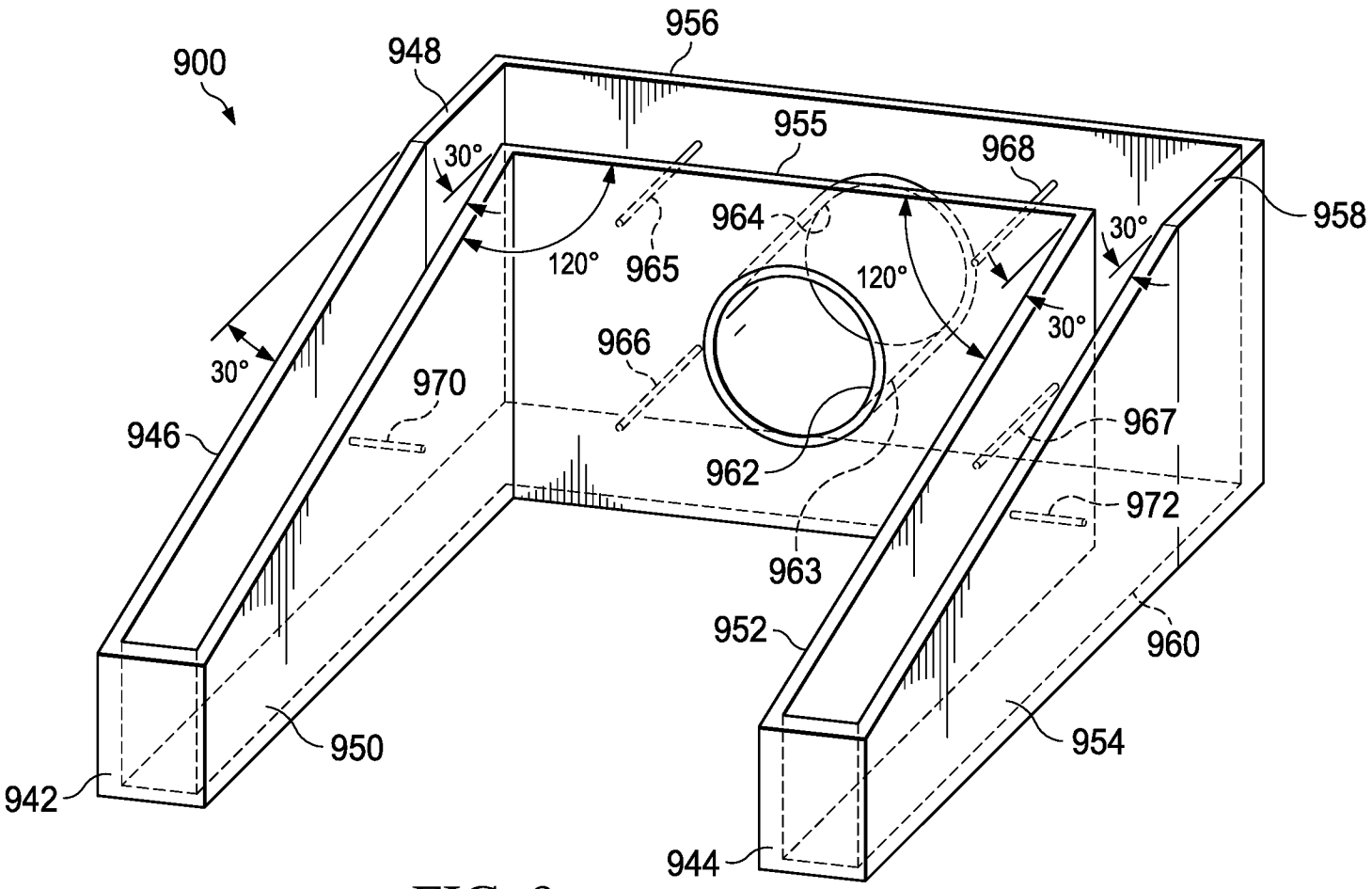
FIG. 9 is an isometric view of a preferred embodiment of a formwork structure.

Referring then to FIG. 9, a preferred embodiment of drain outlet formwork 900 will be described.

Formwork 900 is comprised of front panel 942. Front panel 942 is generally rectangular and is formed of FRP having a thickness between about ¼" and about 1", as required. Front panel 942 is bonded to external side panel 946.

External side panel 946 is generally trapezoidal with an angle of inclination of approximately 30° with respect to side panel 948. External side panel 946 is further bonded to side panel 948.

Side panel 948 is generally rectangular and is bonded to rear panel 956.

Rear panel 956 is generally rectangular and is bonded to side panel 958. Rear panel 956 includes center hole 964, as will be further described.

Side panel 958 is generally rectangular and is bonded to external side panel 954.

External side panel 954 is generally trapezoidal with an angle of inclination of approximately 30° with respect to side panel 958 and is bonded to front panel 944.

Front panel 944 is generally rectangular and is bonded to internal side panel 952.

Internal side panel 952 is generally trapezoidal with an angle of inclination of approximately 30° with respect to external side panel 958 and is further bonded to central panel 955.

Central panel 955 is generally rectangular and is bonded to internal side panel 950. Central panel 955 includes center hole 962, as will be further described. Internal side panels 950 and 952 each form an angle of approximately 120° with central panel 955.

Internal side panel 950 is generally trapezoidal with an angle of inclination of approximately 30° with respect to external side panel 948 and is bonded to front panel 942.

Duct cylinder 963 extends from center hole 962 to center hole 964. Duct cylinder 963 is bonded to rear panel 956 and central panel 955.

Bottom panel 960 is a complex planar shape and is bonded to all side, front, central, and back panels along its outside perimeter.

In another preferred embodiment, the bottom and all side, front and back panels and the duct cylinder may be integrally formed.

Formwork 900 further comprises stanchions 965, 966, 967 968, 970, and 972. Stanchion 970 is centrally positioned between external side panel 946 and internal side panel 950. Stanchion 972 is centrally positioned between external side panel 954 and internal side panel 952. Stanchions 965, 966, 967 and 968 are positioned at even intervals between central panel 955 and rear panel 956, equally radially dispersed about duct cylinder 963.

The FRP panels remain in place lining the inner and outer surfaces of concrete systems greatly reducing the exposure of moisture, salts and other corrosive chemicals to the concrete and reinforcement. The FRP formwork also aids in the concrete curing process by significantly minimizing evaporative moisture loss.

Figure 10:
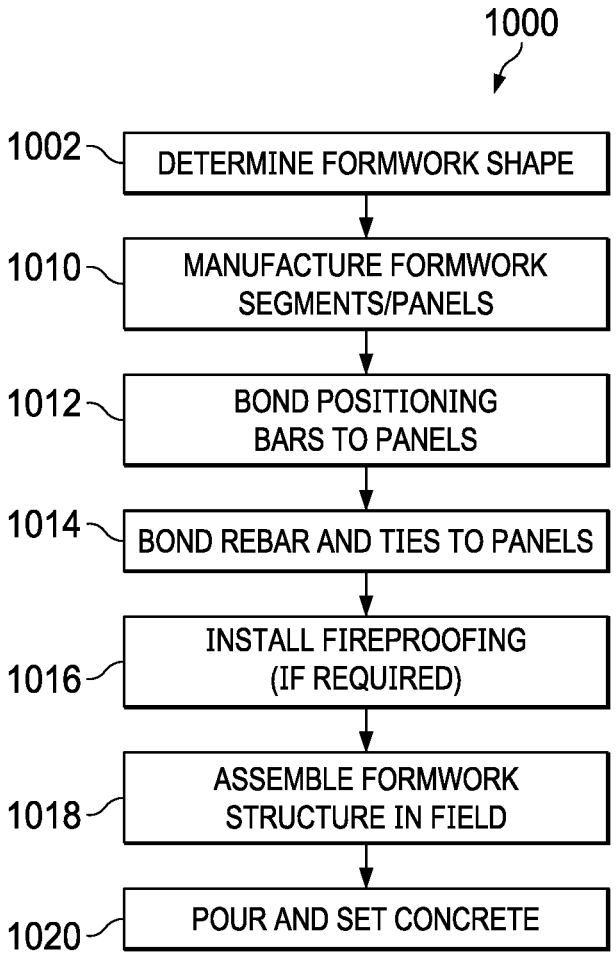
FIG. 10 is a method for manufacturing and installing a formwork structure.

Referring then to FIG. 10, preferred method 1000 for manufacturing and constructing a segmented formwork structure is described.

At step 1002, the formwork shape is determined based on the desired final structure.

At step 1010, the formwork is constructed. The formwork may be assembled by bonding multiple panels together or integrally formed, as previously described.

At step 1012, chairs, stanchions and rebar may be bonded to the panels.

At step 1014, if a rebar system is being preinstalled, the rebar, rebar stirrups, and rebar cages are bonded to the rebar positioning bars.

At step 1016, if fireproofing is being preinstalled, the outer surface of the formwork segments is coated with a fireproof foam.

At step 1018, if air duct or electrical suspension channels are to be provided, they are attached to the formwork, as previously described.

At step 1020, the formwork is filled with concrete and allowed to cure.

The invention claimed is:

1. A composite concrete structure formwork system comprising:

a base pan;

a set of intersecting rebar, held at a fixed position within the base pan by set of standoffs;

an exterior container;

the exterior container further comprising a first singular integrally formed outside wall panel adjacent and touching a second singular integrally formed outside wall panel at a first right angle mitered corner;

a third singular integrally formed outside wall panel adjacent and touching the second singular integrally formed outside wall panel at a second right angle mitered corner;

a fourth singular integrally formed outside wall panel adjacent and touching the third singular integrally formed outside wall panel at a third right angle mitered corner;

the fourth singular integrally formed outside wall panel adjacent and touching the first singular integrally formed outside wall panel at a fourth right angle mitered corner;

an interior container;

the interior container further comprising a first singular integrally formed inside wall panel adjacent and touching a second singular integrally formed inside wall panel at a fifth right angle mitered corner;

the second singular integrally formed inside wall panel adjacent and touching a third singular integrally formed inside wall panel at a sixth right angle mitered corner;

the third singular integrally formed inside wall panel adjacent and touching a fourth singular integrally formed inside wall panel at a seventh right angle mitered corner;

the fourth singular integrally formed inside wall panel adjacent and touching the first singular integrally formed inside wall panel at an eighth right angle mitered corner;

the interior container, maintained at a fixed distance within the exterior container, by a set of radial stanchions permanently bonded to the first singular integrally formed outside wall panel, the second singular integrally formed outside wall panel, the third singular integrally formed outside wall panel and the fourth singular integrally formed outside wall panel and the first singular integrally formed inside wall panel, the second singular integrally formed inside wall panel, the third singular integrally formed inside wall panel and the fourth singular integrally formed inside wall panel; and wherein the exterior container and the interior container form an uninterrupted void adjacent the first singular integrally formed outside wall panel, the second singular integrally formed outside wall panel, the third singular integrally formed outside wall panel and the fourth singular integrally formed outside wall panel and the first singular integrally formed inside wall panel, the second singular integrally formed inside wall panel, the third singular integrally formed inside wall panel and the fourth singular integrally formed inside wall panel for containing concrete;

wherein the exterior container and the interior container are sealed to the base pan.

2. The composite concrete structure formwork system of claim 1 further comprising:

a ducted passage between the exterior container and the interior container.

3. The composite concrete structure formwork system of claim 1 wherein the exterior container, the interior container and the set of radial stanchions are formed from a fiberglass material.

4. The composite concrete structure formwork system of claim 1 wherein the interior container forms a first five sided box and the exterior container forms a second five sided box and wherein the first five sided box and the second five sided box are in continuous contact with the uninterrupted void.

5. A composite concrete structure formwork system comprising:

a base pan;

a set of intersecting rebar, held at a fixed position within the base pan by a set of standoffs;

a set of dual panel walls, sealed to the base pan;

each dual panel wall, of the set of dual panel walls, further comprising a singular integrally formed inside panel, having a first perimeter, rigidly fixed to a singular integrally formed outside panel, having a second perimeter;

a dual panel top section, sealed to the set of dual panel walls;

the dual panel top section further comprising a singular integrally formed bottom panel, having a third perimeter, rigidly fixed to a singular integrally formed top panel, having a fourth perimeter;

wherein the first perimeter is smaller than the second perimeter; and wherein the third perimeter is smaller than the fourth perimeter;

wherein a single continuous uninterrupted interior void is formed between and adjacent to each singular integrally formed inside panel, each singular integrally formed outside panel, the singular integrally formed top panel and the singular integrally formed bottom panel.

6. The composite concrete structure formwork system of claim 5 wherein the set of dual panel walls further comprises:

a door portal connecting the singular integrally formed inside panel and the singular integrally formed outside panel.

7. The composite concrete structure formwork system of claim 5 wherein the set of dual panel walls further comprises:

a side wall wherein the singular integrally formed inside panel and the singular integrally formed outside panel are maintained at a fixed distance apart by a set of cylindrical stanchions.

8. The composite concrete structure formwork system of claim 7 wherein the set of cylindrical stanchions are further comprised of a fiberglass material.

9. The composite concrete structure formwork system of claim 7 further comprising:

a duct between the singular integrally formed inside panel and the singular integrally formed outside panel.

10. The composite concrete structure formwork system of claim 9 further comprising:

a duct cover, adjacent the duct, fixed to the singular integrally formed outside panel.

11. The composite concrete structure formwork system of claim 5 wherein the single continuous uninterrupted interior void and the base pan are filled with a cured concrete.

12. The composite concrete structure formwork system of claim 5 wherein the base pan, the set of dual panel walls and the dual panel top section are formed of a fiberglass material.

13. The composite concrete structure formwork system of claim 5 wherein the singular integrally formed outside panel has a patterned outside surface.

14. The composite concrete structure formwork system of claim 5 wherein the singular integrally formed inside panel has an insulated surface.

15. A composite concrete structure formwork system comprising:

a base pan;

a set of dual panel walls, sealed to the base pan;

each dual panel wall, of the set of dual panel walls, further comprising a singular integrally formed inside panel, having a first perimeter, rigidly fixed to a singular integrally formed outside panel, having a second perimeter;

a dual panel top section, sealed to the set of dual panel walls;

the dual panel top section further comprising a singular integrally formed bottom panel, having a third perimeter, rigidly fixed to a singular integrally formed top panel, having a fourth perimeter;

wherein the first perimeter is smaller than the second perimeter;

wherein the third perimeter is smaller than the fourth perimeter;

wherein the singular integrally formed top panel is maintained adjacent the singular integrally formed bottom panel, at a fixed distance, apart by a set of stanchions; and a set of intersecting rebar, held at a fixed position between the singular integrally formed top panel and the singular integrally formed bottom panel, by the set of stanchions;

wherein a single continuous uninterrupted interior void is formed between and adjacent to each singular integrally formed inside panel, each singular integrally formed outside panel, the singular integrally formed top panel and the singular integrally formed bottom panel.

16. The composite concrete structure formwork system of claim 15 wherein the singular integrally formed top panel further comprises:

a set of access ports for receiving uncured concrete.

* * * * *